US011761194B2

(12) United States Patent
Webb et al.

(10) Patent No.: US 11,761,194 B2
(45) Date of Patent: Sep. 19, 2023

(54) MODULAR WORKSPACE SYSTEM

(71) Applicant: OFS Brands Inc., Huntingburg, IN (US)

(72) Inventors: Roger Landon Webb, Chiswick (GB); David Andrew Lancaster, Twickenham (GB); Antonio Jose Fernandes da Costa, Northwood (GB)

(73) Assignee: OFS Brands Inc., Huntingburg, IN (US)

( * ) Notice: Subject to any disclaimer, the term of this patent is extended or adjusted under 35 U.S.C. 154(b) by 84 days.

(21) Appl. No.: 17/340,281

(22) Filed: Jun. 7, 2021

(65) Prior Publication Data

US 2021/0381223 A1 Dec. 9, 2021

Related U.S. Application Data

(60) Provisional application No. 63/035,141, filed on Jun. 5, 2020.

(51) Int. Cl.

| | |
|---|---|
| ***E04B 2/74*** | (2006.01) |
| ***E04B 1/343*** | (2006.01) |
| ***E04B 1/58*** | (2006.01) |
| ***E04B 1/41*** | (2006.01) |

(52) U.S. Cl.

CPC ..... *E04B 1/34326* (2013.01); *E04B 1/34384* (2013.01); *E04B 1/40* (2013.01); *E04B 1/5825* (2013.01)

(58) Field of Classification Search

CPC .... E04B 1/40; E04B 1/34326; E04B 1/34384; E04B 1/5825; E04B 2002/7483; A47B 83/001

USPC ..... 52/36.1, 79.1

See application file for complete search history.

(56) References Cited

U.S. PATENT DOCUMENTS

| | | | | |
|---|---|---|---|---|
| 6,244,002 | B1 * | 6/2001 | Martin | E04B 2/7427 52/282.1 |
| 6,481,169 | B1 * | 11/2002 | Ludwig | E04B 2/7453 52/745.1 |
| 6,484,647 | B2 * | 11/2002 | Lininger Jr. | A47B 83/001 312/265.5 |
| 6,553,730 | B1 * | 4/2003 | Mueller | E04B 2/7433 439/654 |
| 6,701,682 | B2 * | 3/2004 | Ando | G06Q 10/10 52/234 |
| 6,759,589 | B1 * | 7/2004 | VanderVelde | A47B 21/06 174/72 A |
| 6,807,776 | B2 * | 10/2004 | Girdwood | A47B 96/1483 52/36.5 |
| 7,461,484 | B2 * | 12/2008 | Battey | E04B 2/7425 52/293.3 |
| 7,677,182 | B2 * | 3/2010 | Mueller | A47B 21/0314 108/50.01 |
| 7,975,445 | B2 * | 7/2011 | Parshad | E04B 2/7425 52/239 |

(Continued)

*Primary Examiner* — Brian E Glessner
*Assistant Examiner* — James J Buckle, Jr.
(74) *Attorney, Agent, or Firm* — Dentons Bingham Greenebaum LLP; Brian W. Chellgren; James C. Eaves, Jr.

(57) ABSTRACT

A modular workspace system employs a plurality of interchangeable posts, beams/rails, and panels, permitting assembly of modular rooms and modular room structures of varying size, shape, and purpose. Wire management openings permit internal wire management.

18 Claims, 93 Drawing Sheets

(56) References Cited

U.S. PATENT DOCUMENTS

| | | | | |
|---|---|---|---|---|
| 8,015,767 | B2 * | 9/2011 | Glick | E04B 2/76 52/239 |
| 8,046,962 | B2 * | 11/2011 | Glick | E04B 2/7425 52/239 |
| 9,433,282 | B2 * | 9/2016 | Steelman | A47B 13/02 |
| 10,689,844 | B2 * | 6/2020 | Patton | E04B 2/7435 |
| 2002/0029529 | A1 * | 3/2002 | Waalkes | E04B 2/7433 52/36.5 |
| 2006/0278777 | A1 * | 12/2006 | Atkinson | A47B 13/021 248/188.4 |
| 2011/0179741 | A1 * | 7/2011 | Yen | E04B 1/34326 52/655.1 |
| 2020/0018060 | A1 * | 1/2020 | Watanabe | E04H 1/1205 |

* cited by examiner

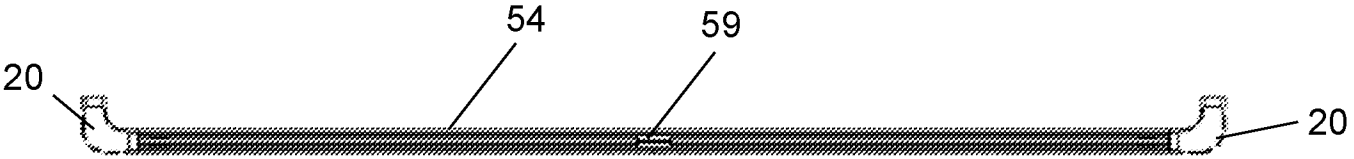
FIG. 8E
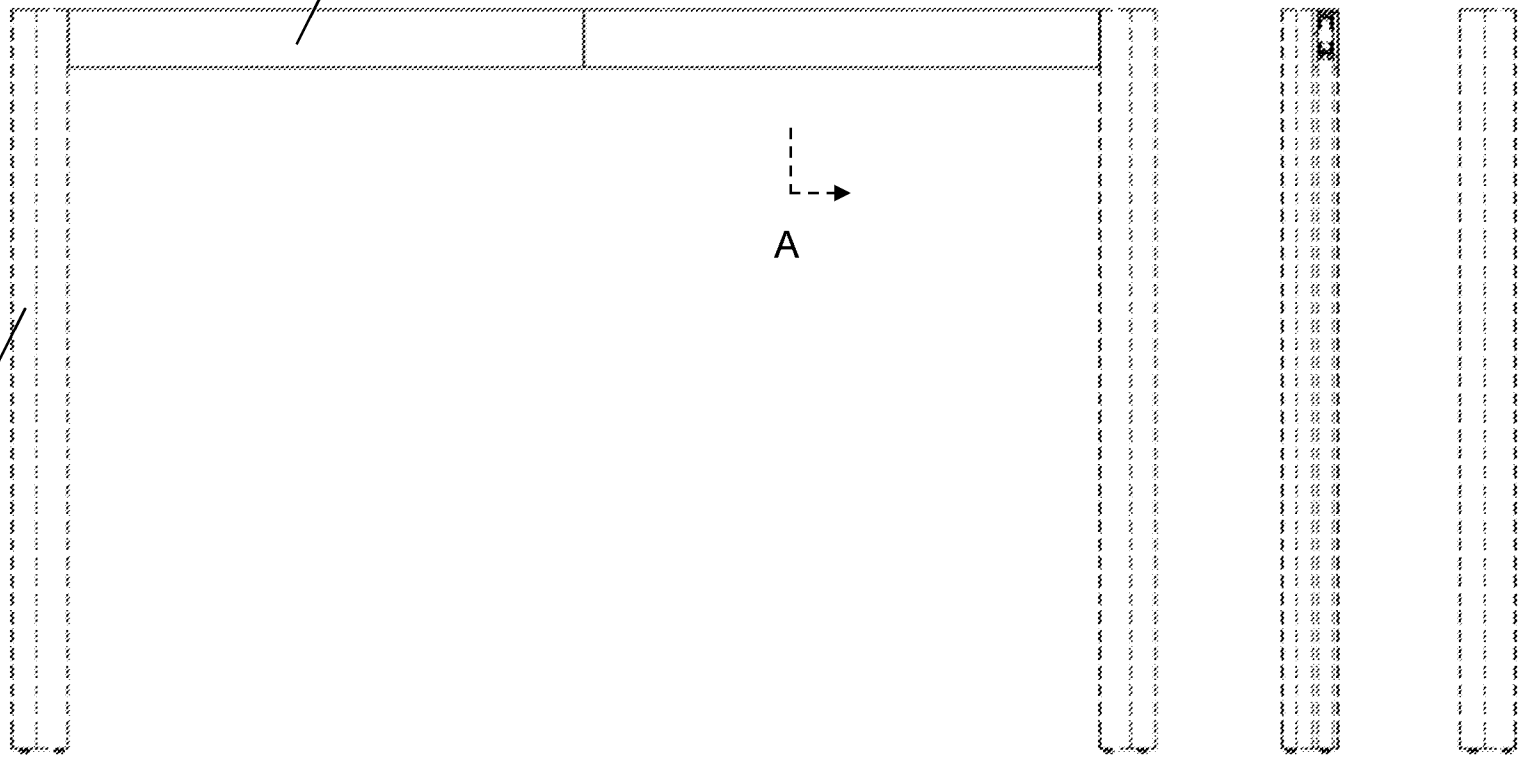
FIG. 8F
FIG. 8C
FIG. 8D

SECTION A-A
A
A 72
78
72
78
SECTION A-A
A
A
54
59

54
78

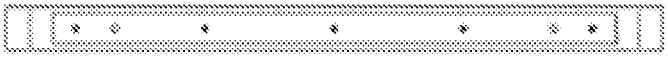
FIG. 13B
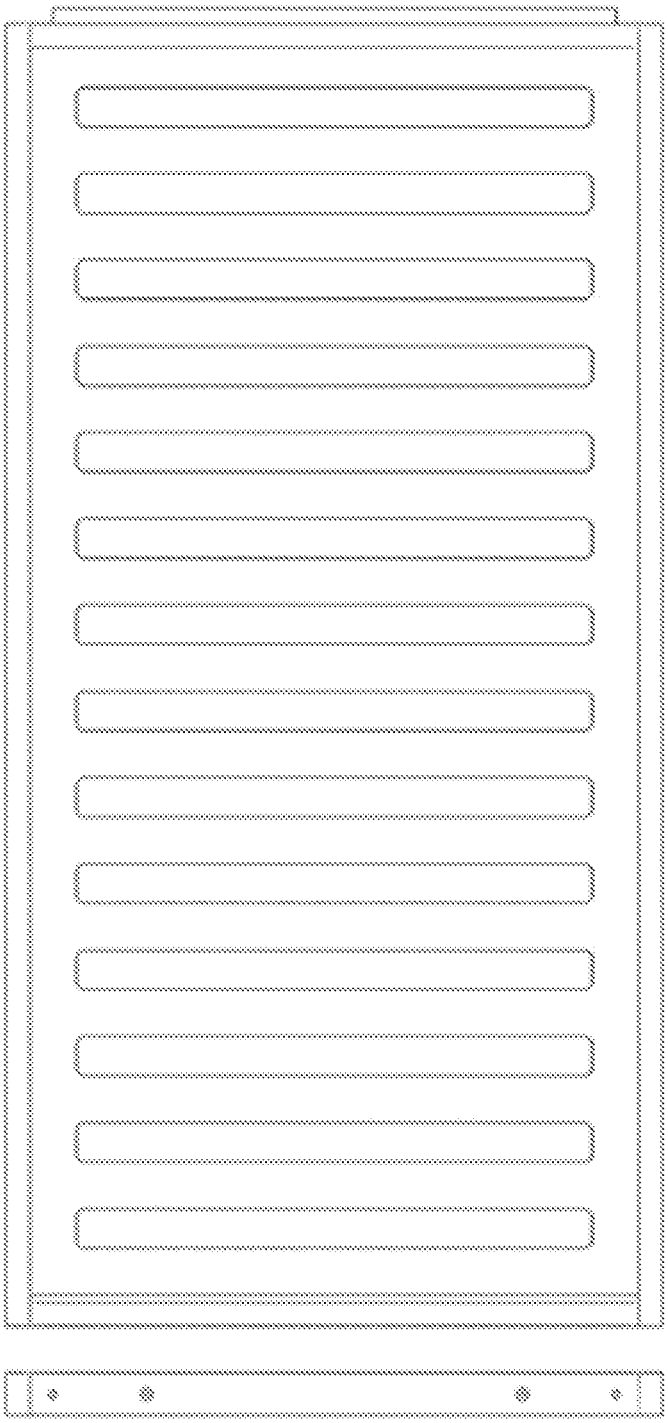
FIG. 13C
FIG. 13D
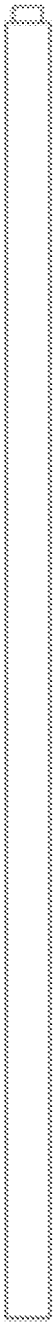
FIG. 13E

SECTION A-A
A
A

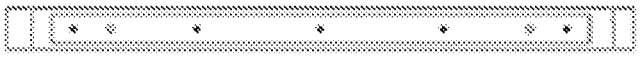
FIG. 14B
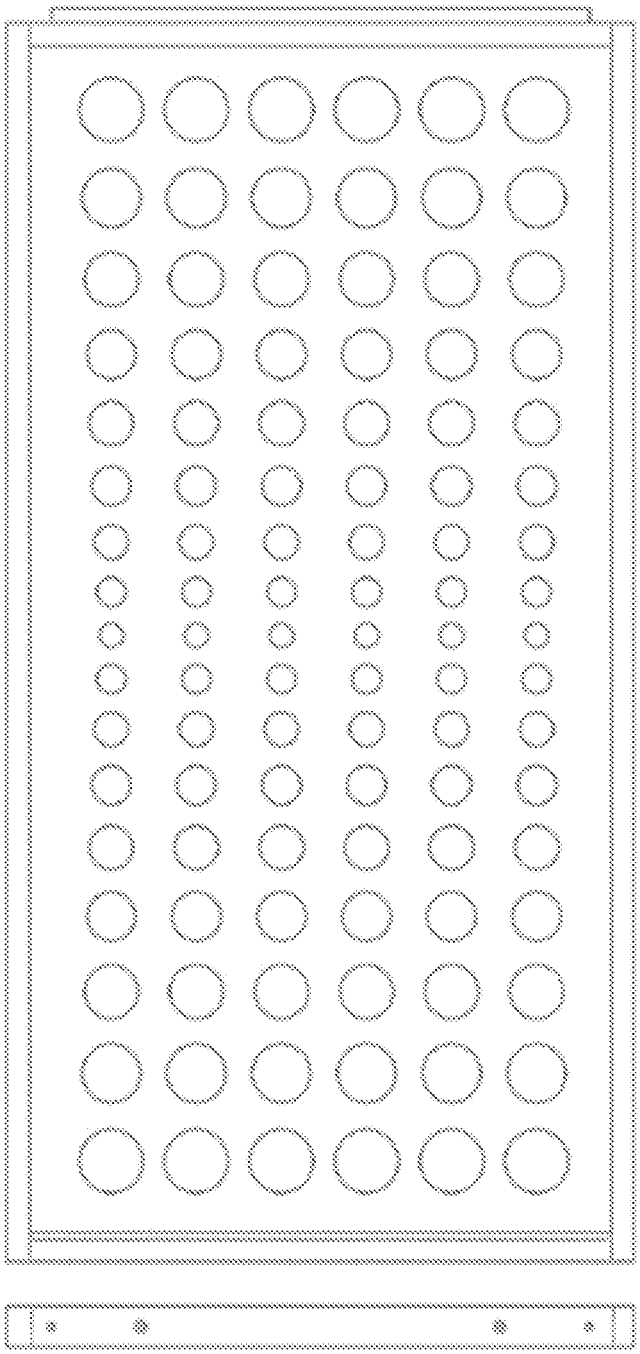
FIG. 14C
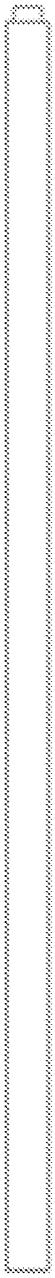
FIG. 14E
FIG. 14D

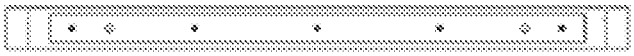
FIG. 15B
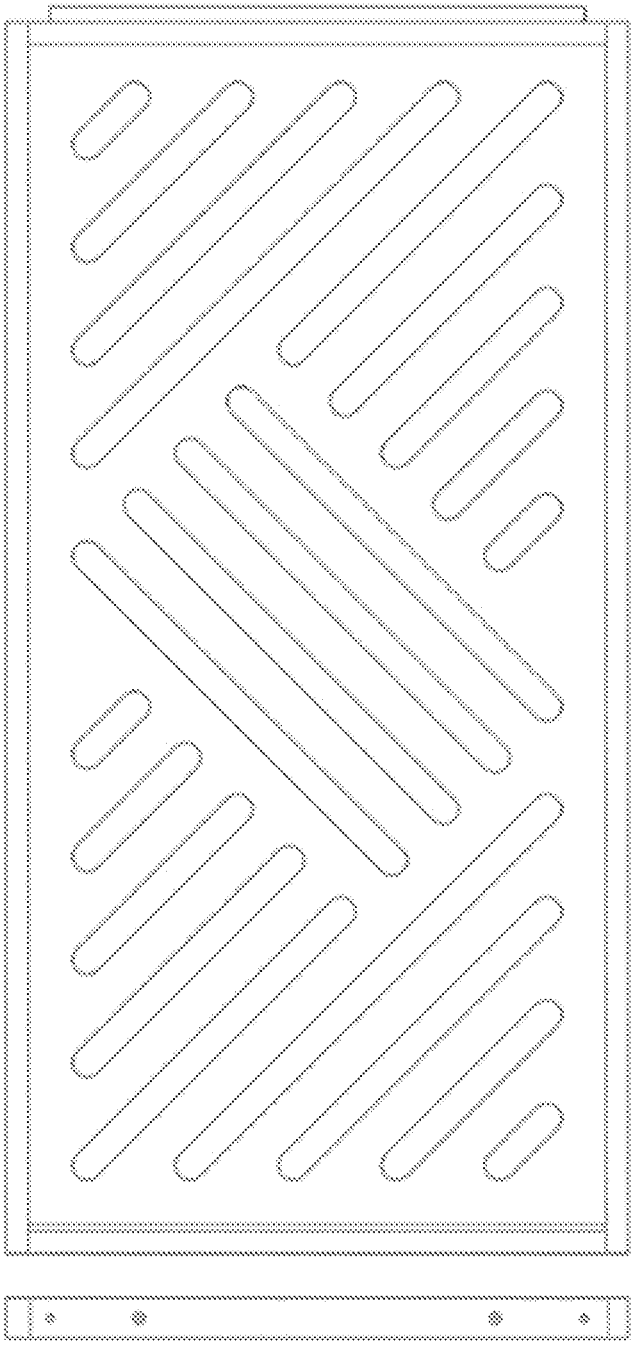
FIG. 15C
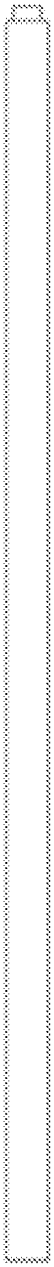
FIG. 15E
FIG. 15D

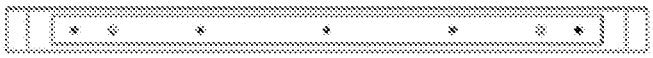
FIG. 16B
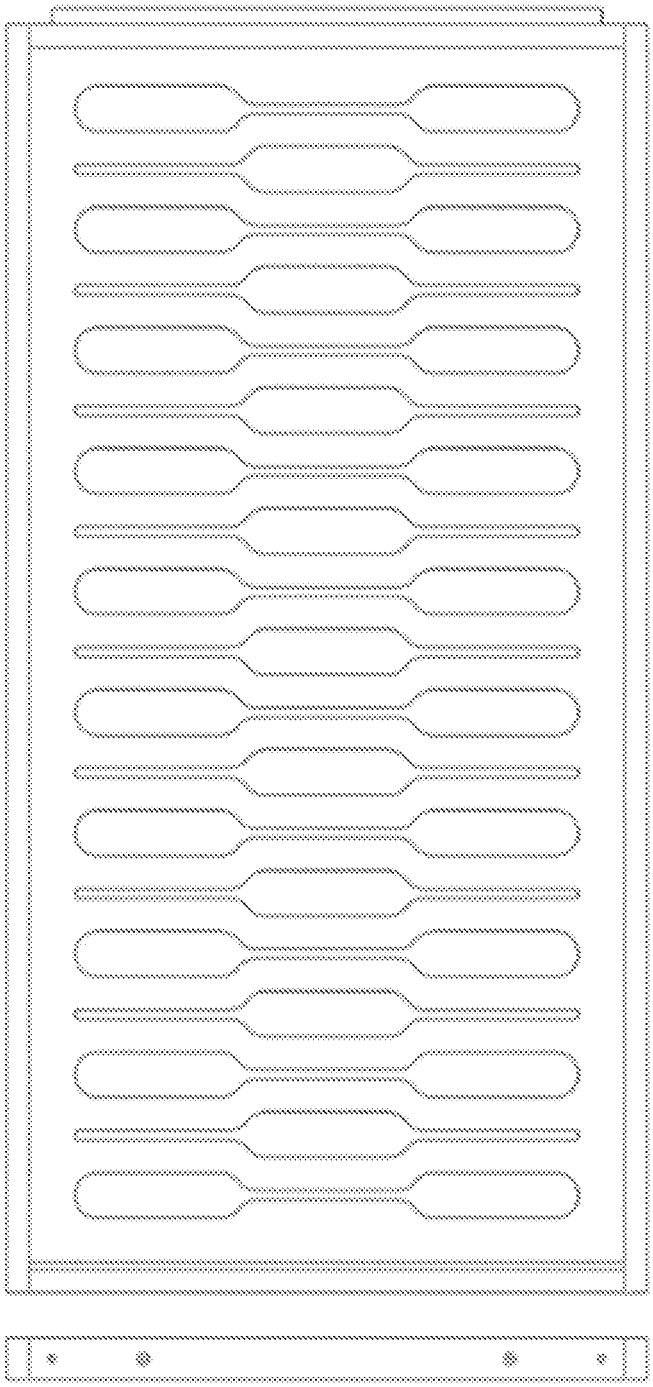
FIG. 16C
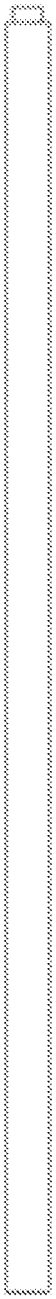
FIG. 16E
FIG. 16D

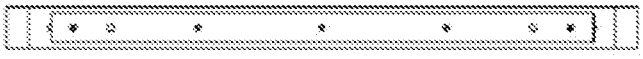
FIG. 18B
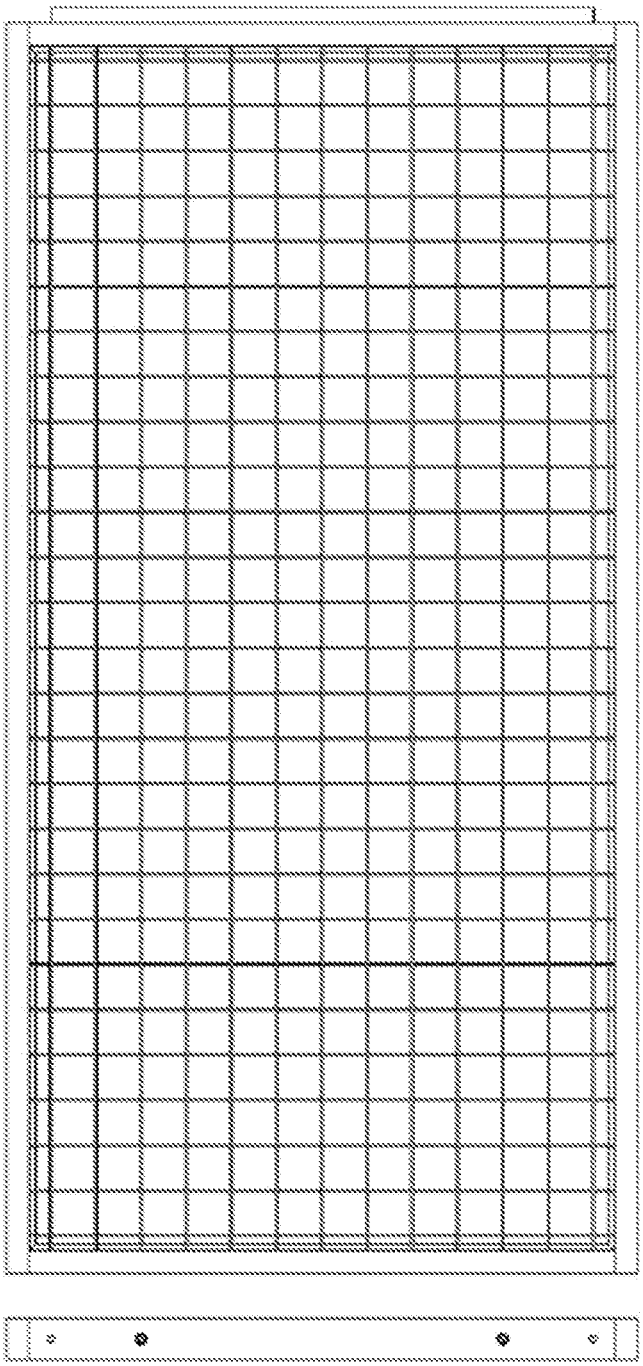
FIG. 18C
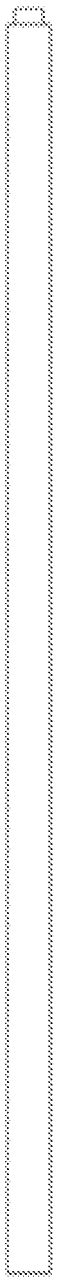
FIG. 18E
FIG. 18D

SECTION A-A
A
A

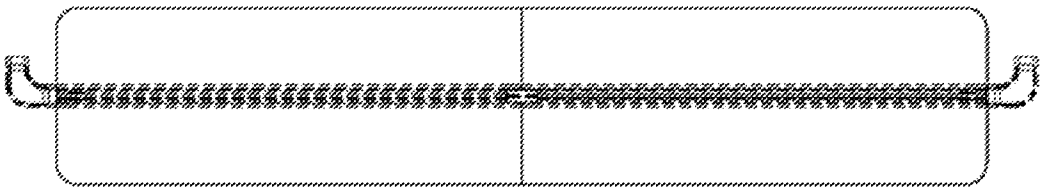
FIG. 22B
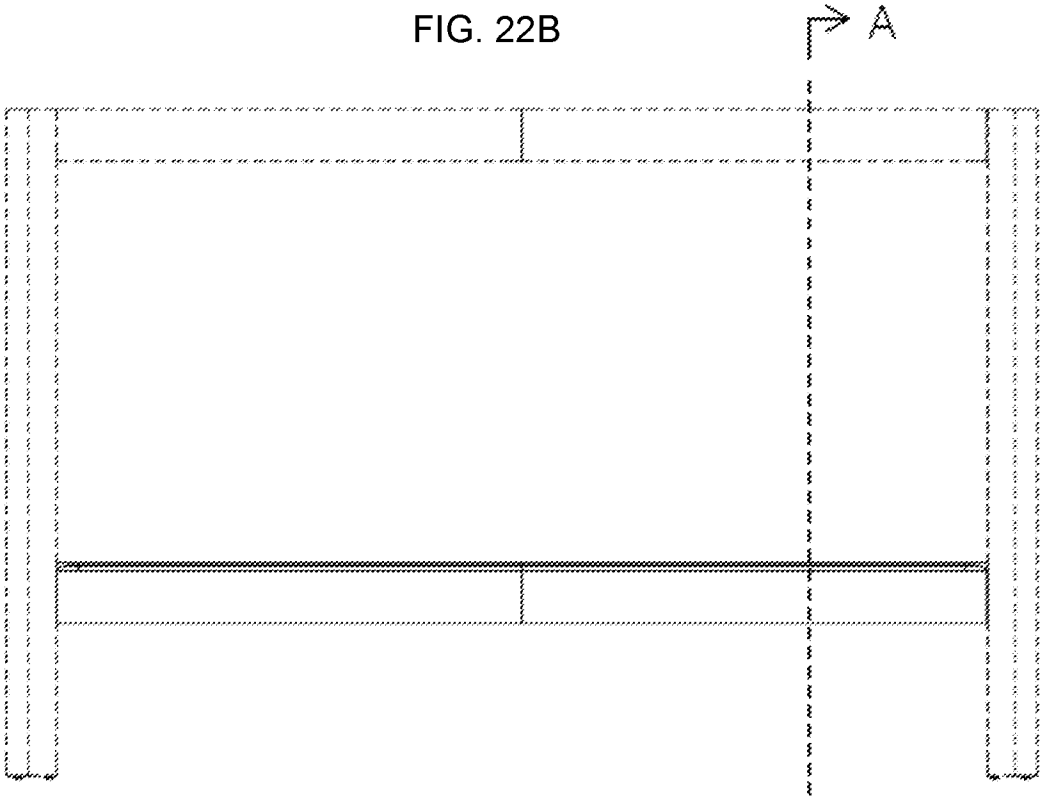
FIG. 22C
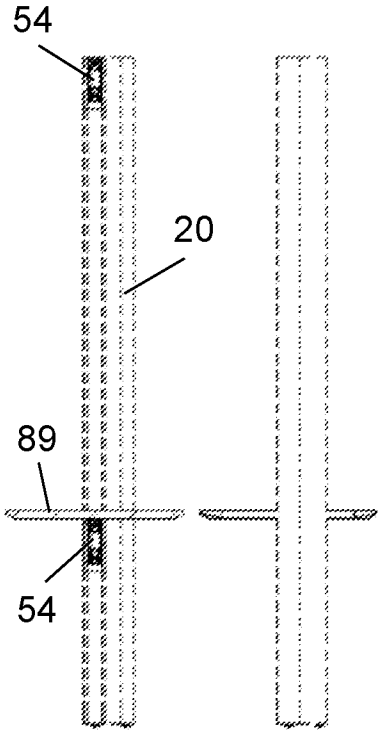
FIG. 22D
SECTION A-A
FIG. 22E

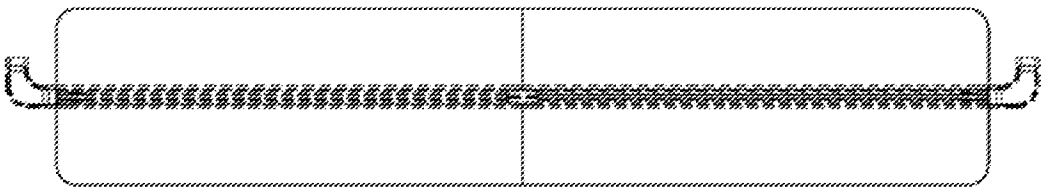
FIG. 23B
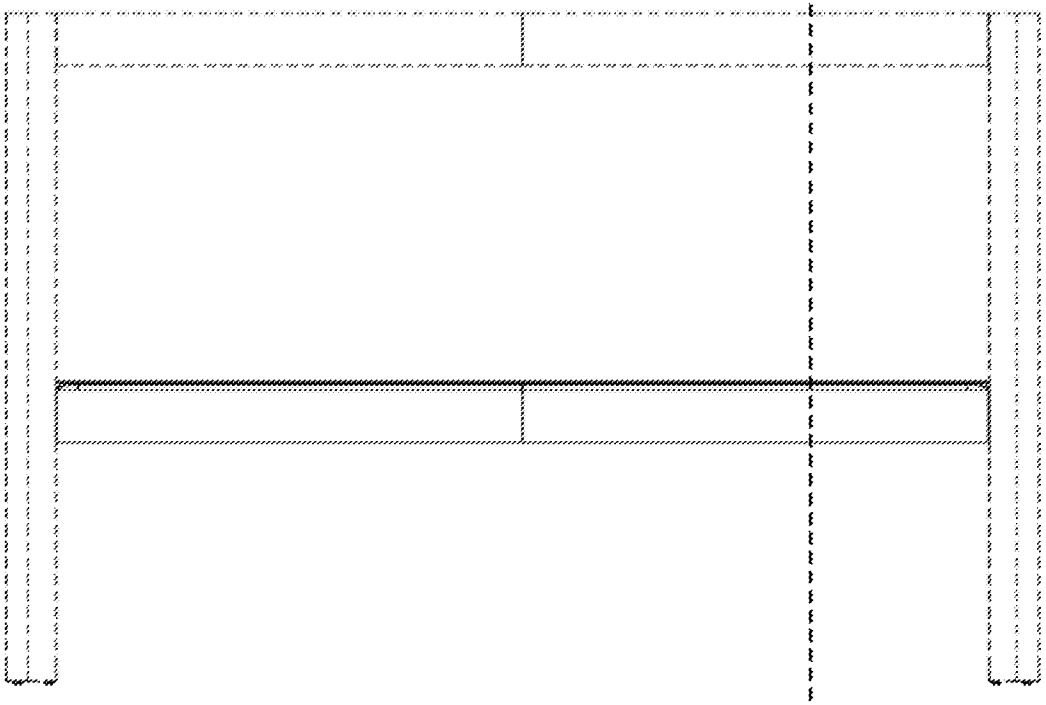
FIG. 23C
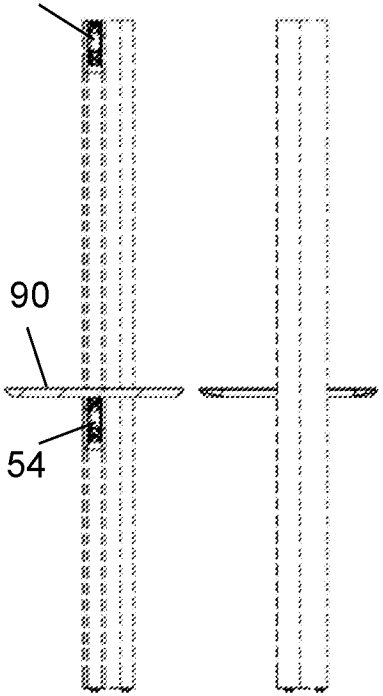
FIG. 23D
FIG. 23E

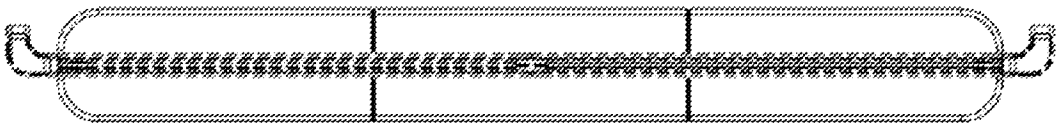
FIG. 24B
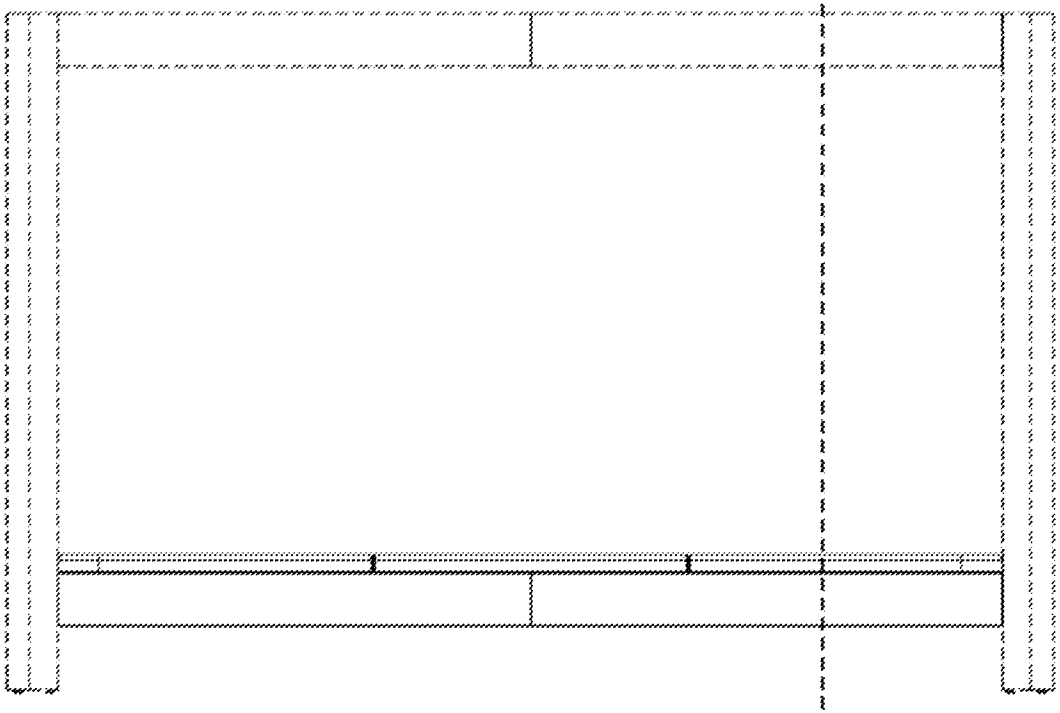
FIG. 24C
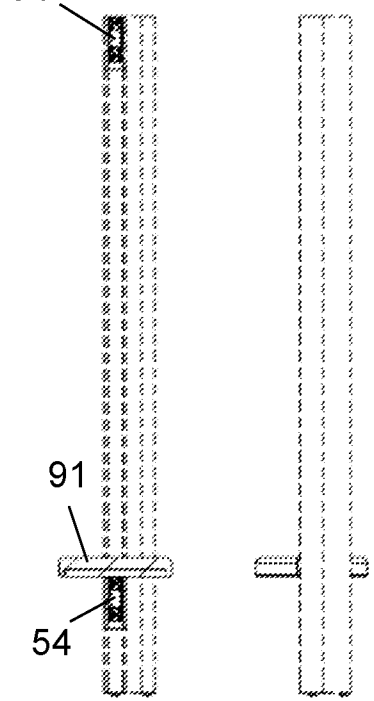
FIG. 24D
FIG. 24E

FIG. 27B
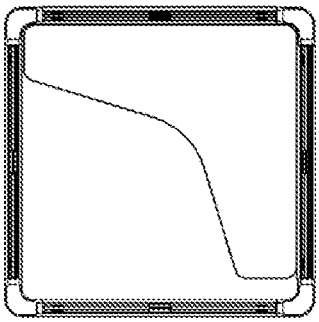
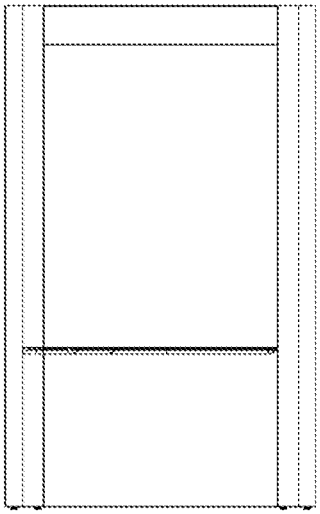
FIG. 27C
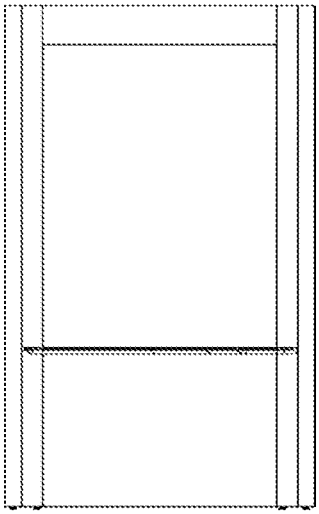
FIG. 27D
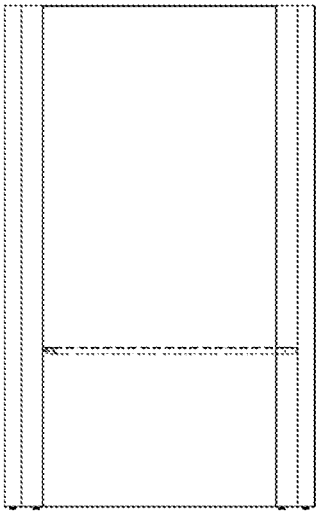
FIG. 27E
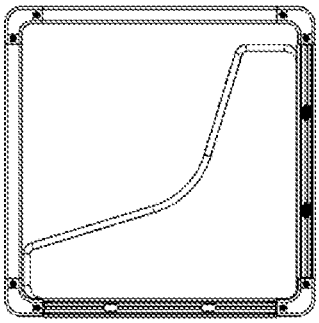
FIG. 27F FIG. 28B
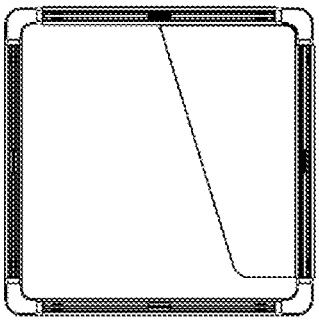
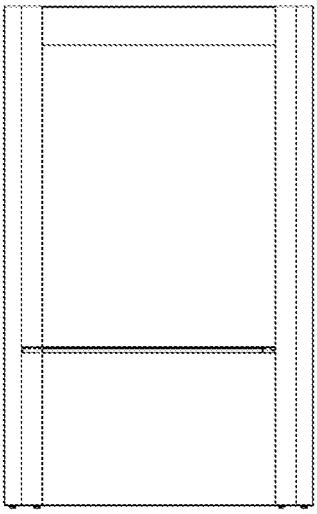
FIG. 28C
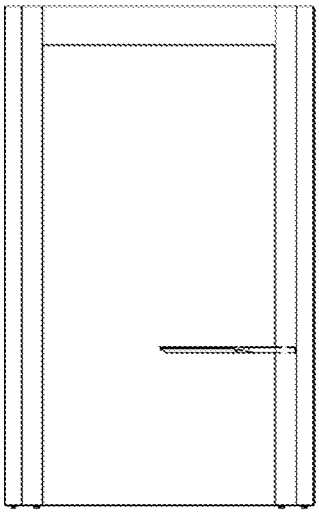
FIG. 28D
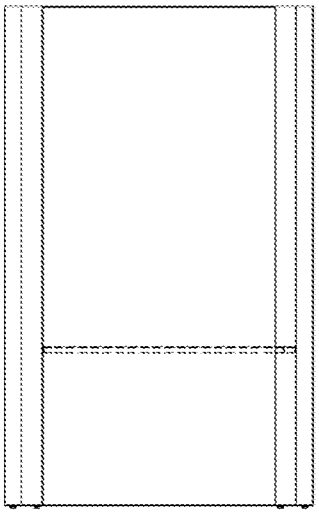
FIG. 28E
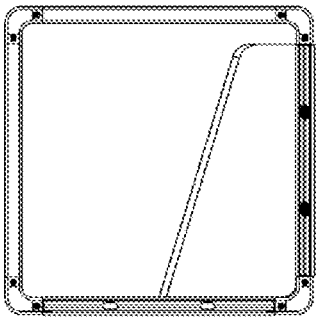
FIG. 28F FIG. 29B
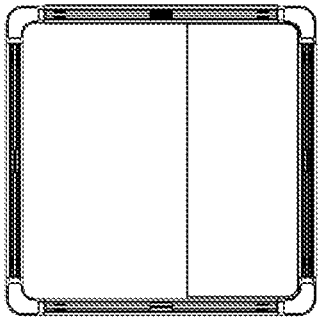
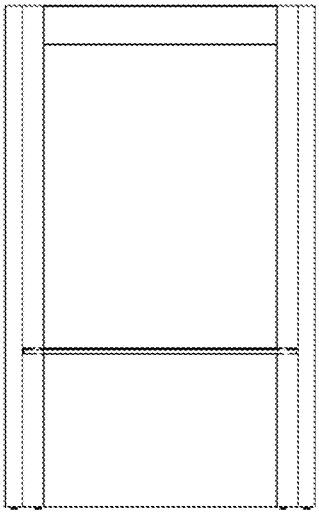
FIG. 29C
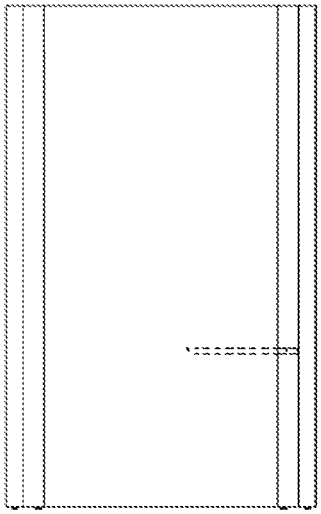
FIG. 29D
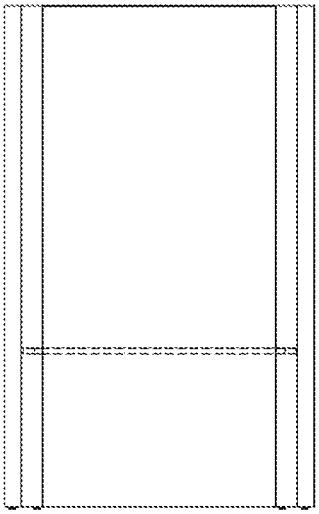
FIG. 29E
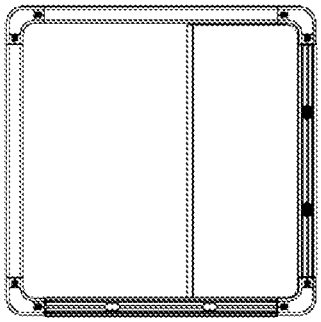
FIG. 29F FIG. 30B
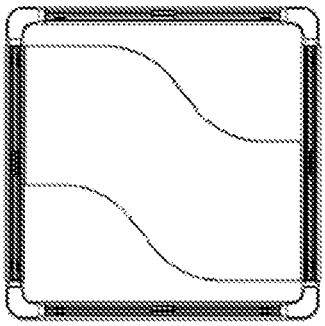
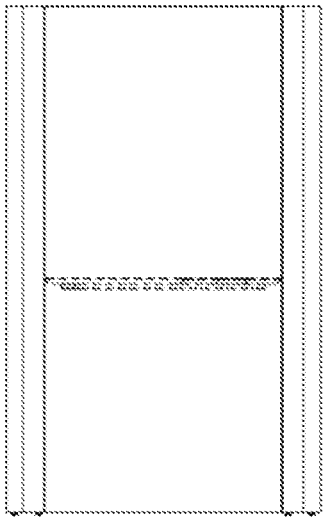
FIG. 30C
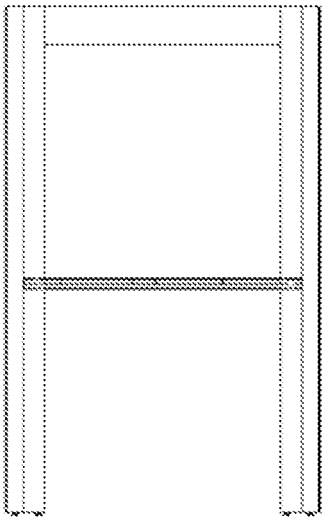
FIG. 30D
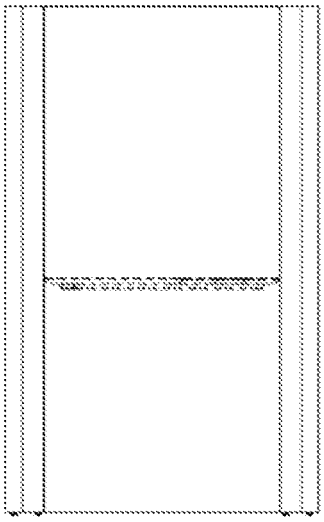
FIG. 30E
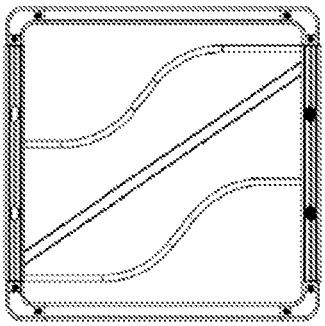
FIG. 30F FIG. 31B
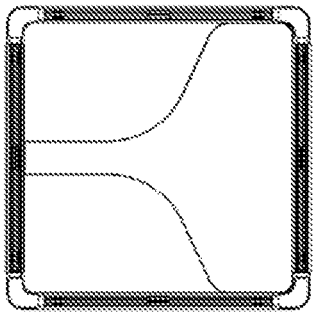
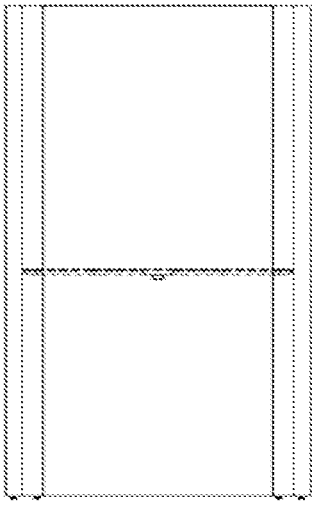
FIG. 31C
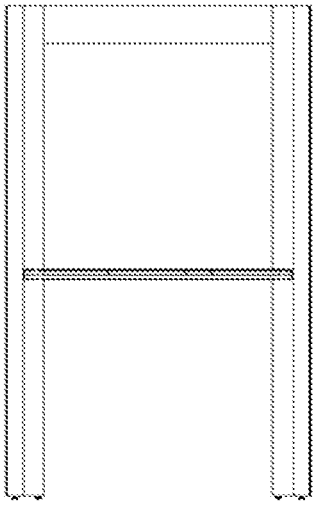
FIG. 31D
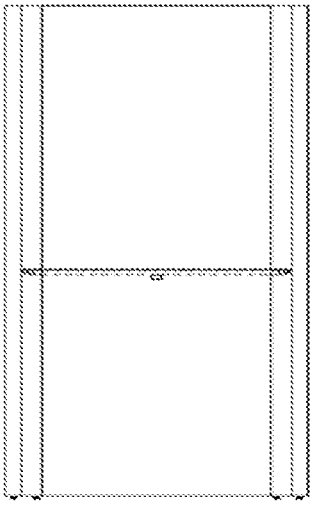
FIG. 31E
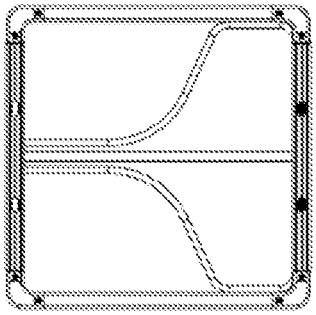
FIG. 31F FIG. 32B
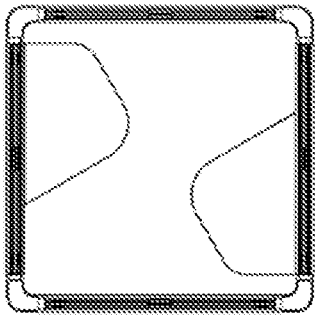
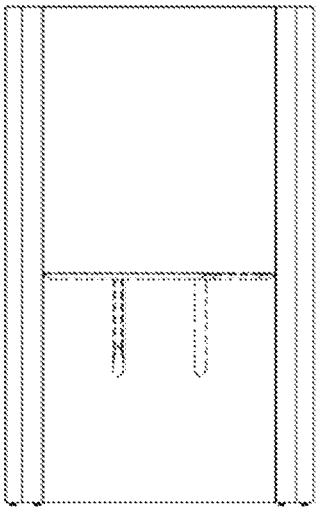
FIG. 32C
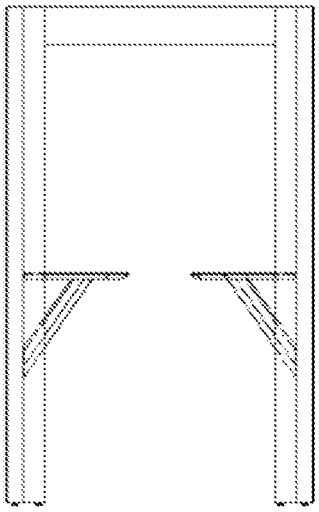
FIG. 32D
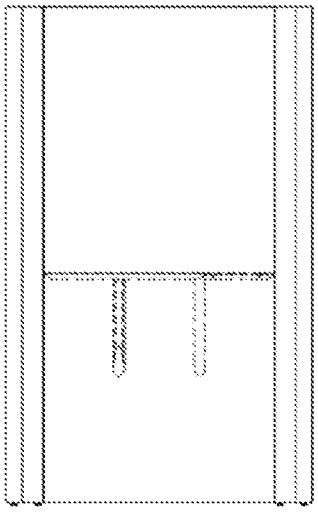
FIG. 32E
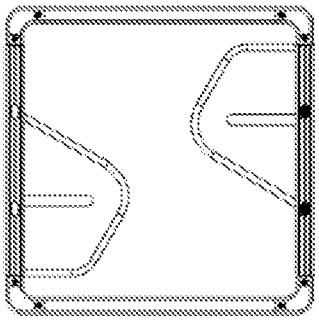
FIG. 32F FIG. 33B
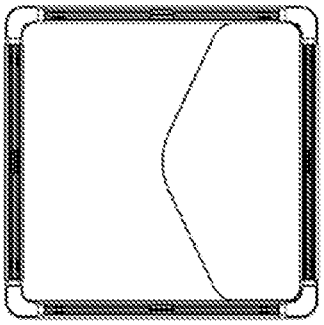
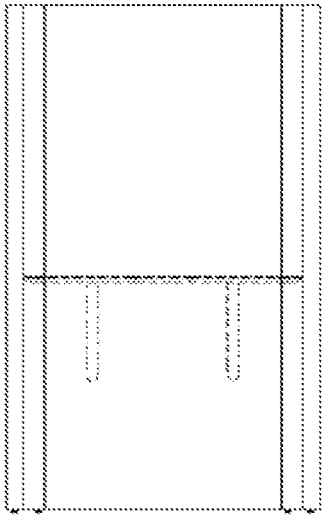
FIG. 33C
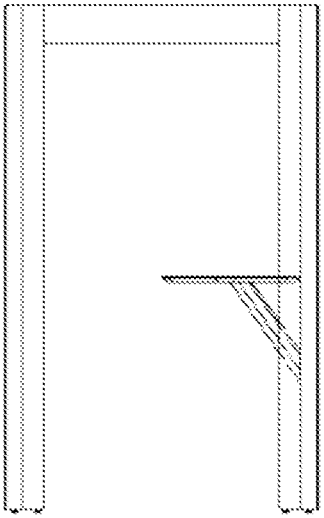
FIG. 33D
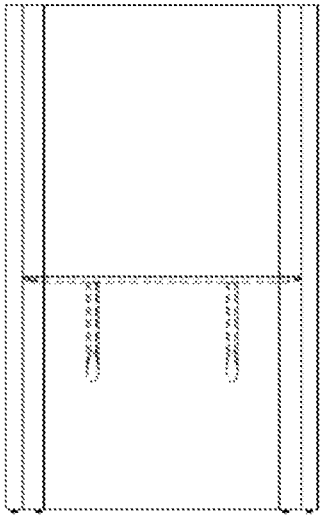
FIG. 33E
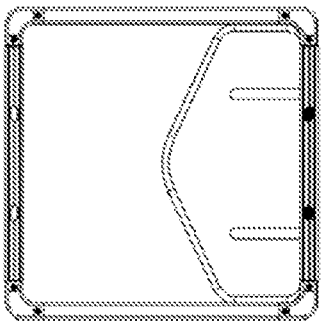
FIG. 33F

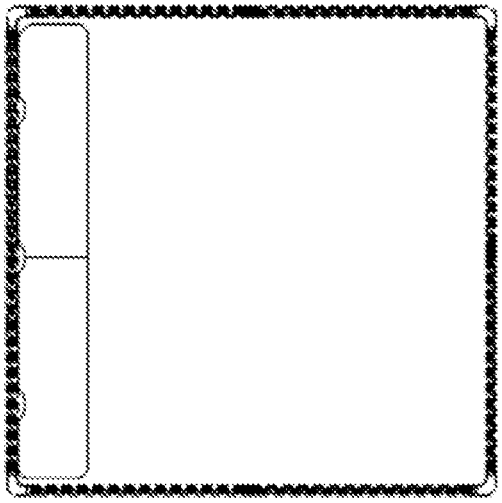
FIG. 34B
FIG. 34E
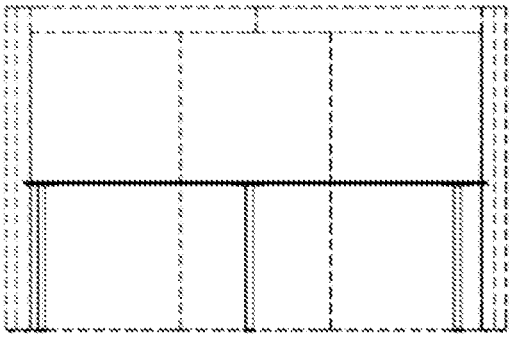
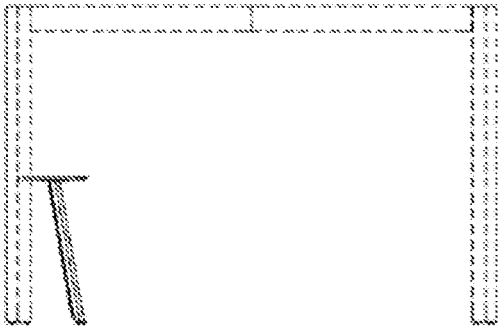
FIG. 34C
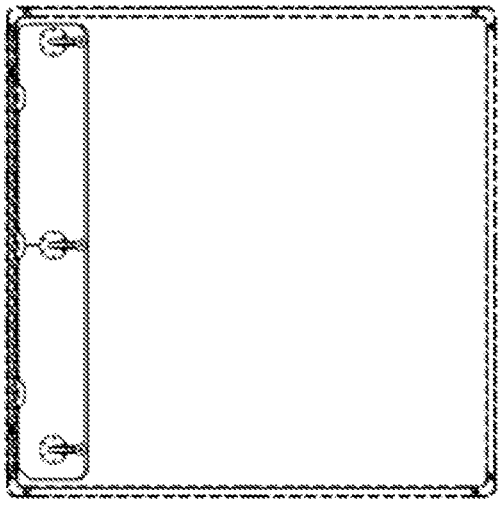
FIG. 34D

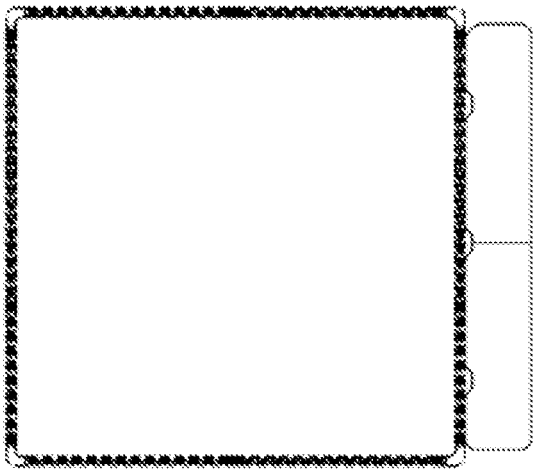
FIG. 35B
FIG. 35E
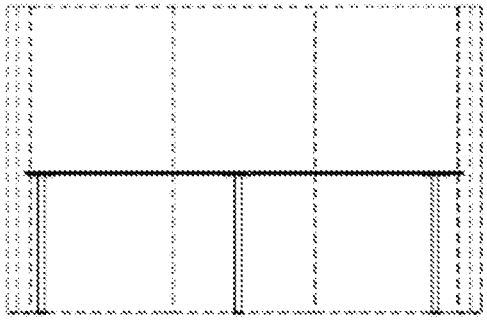
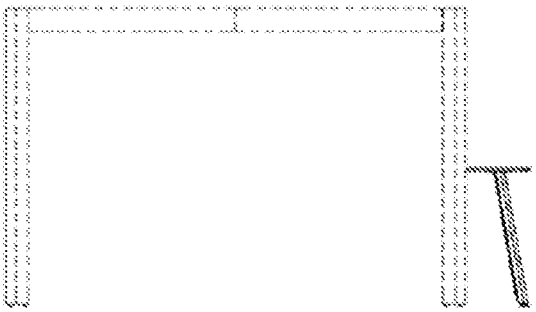
FIG. 35C
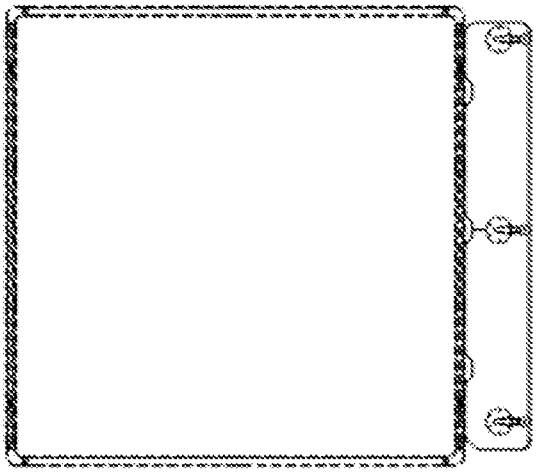
FIG. 35D

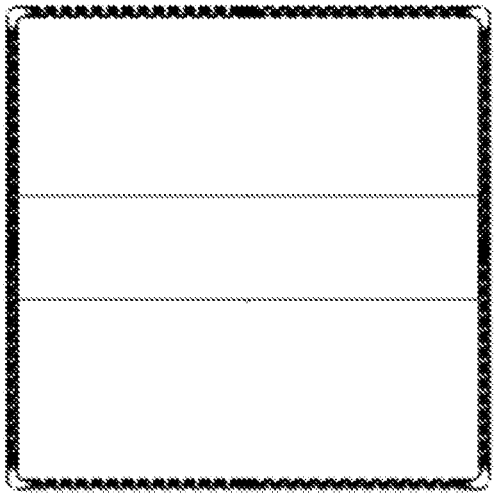
FIG. 36B
FIG. 36E
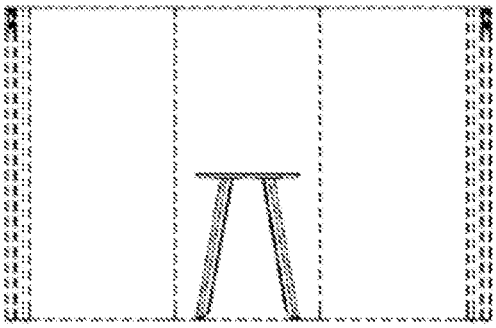
Section A-A
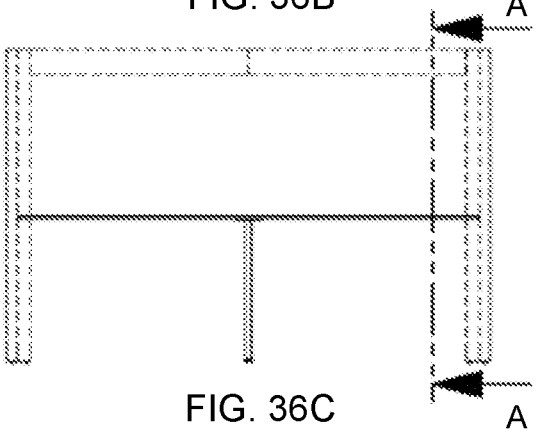
FIG. 36C
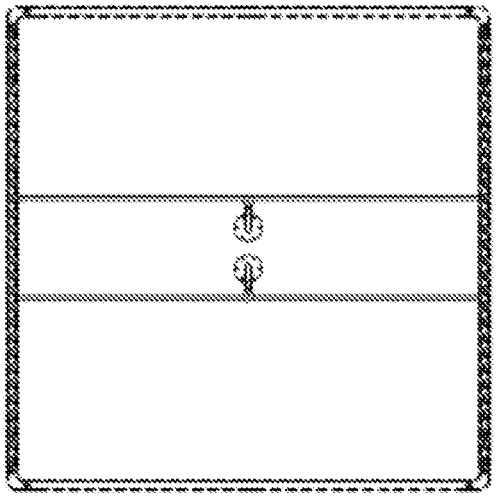
FIG. 36D FIG. 37A
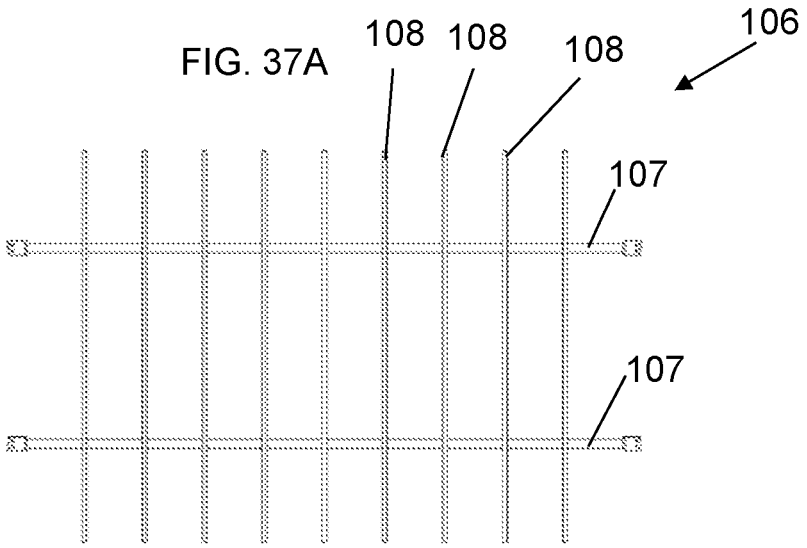
FIG. 37B
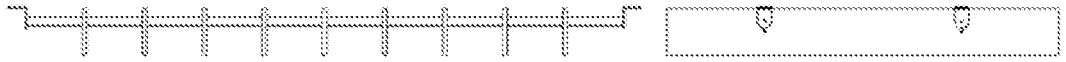
FIG. 37D
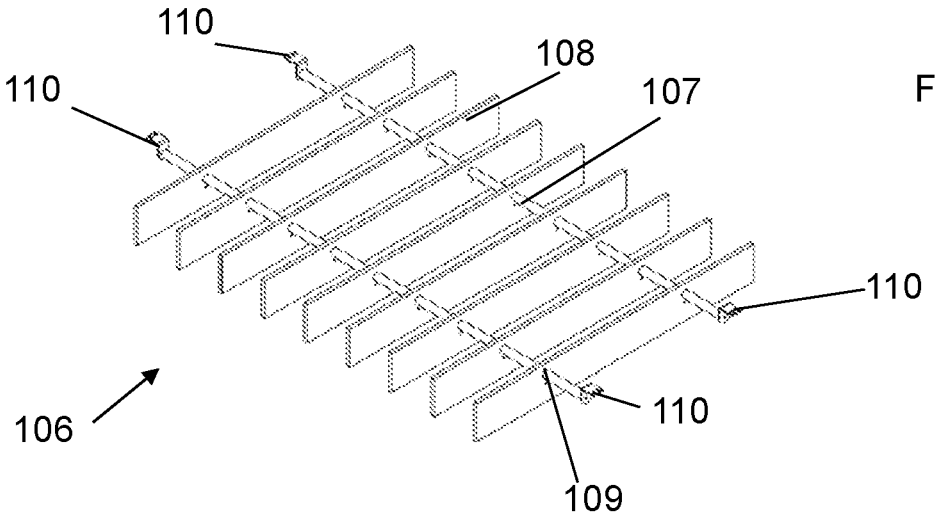
FIG. 37C FIG. 38A
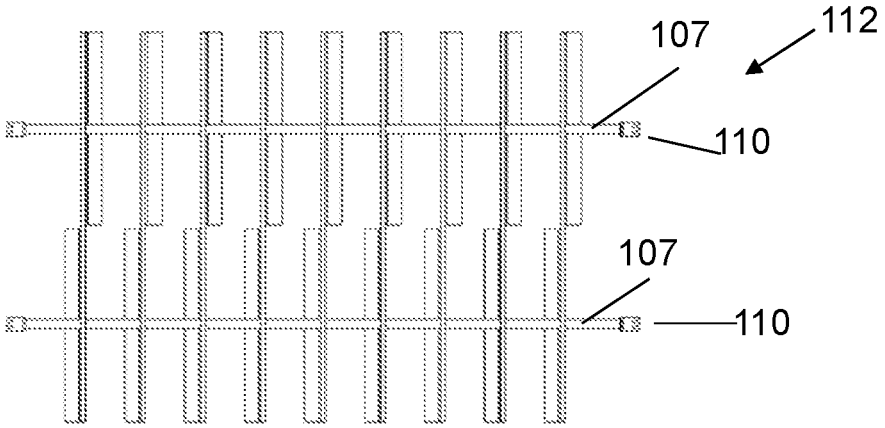
FIG. 38B
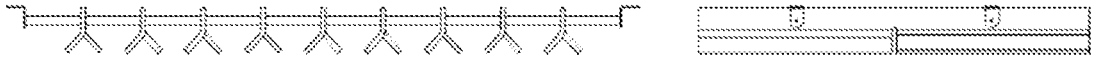
FIG. 38D
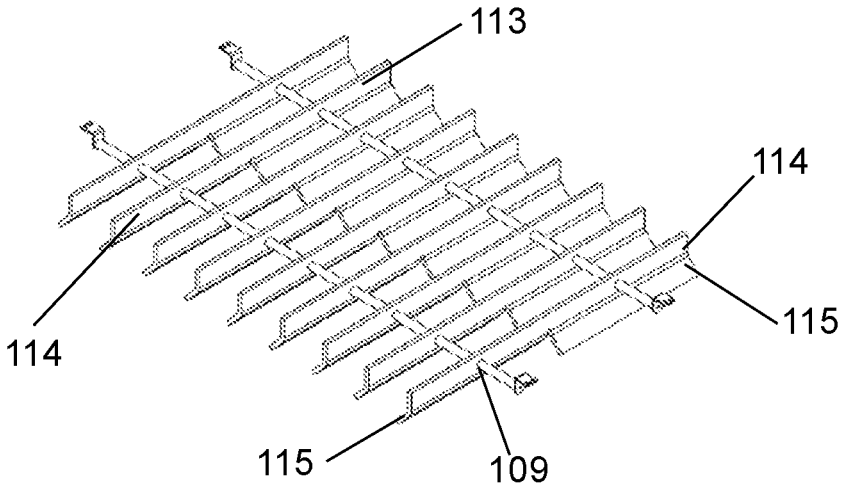
FIG. 38C FIG. 38E
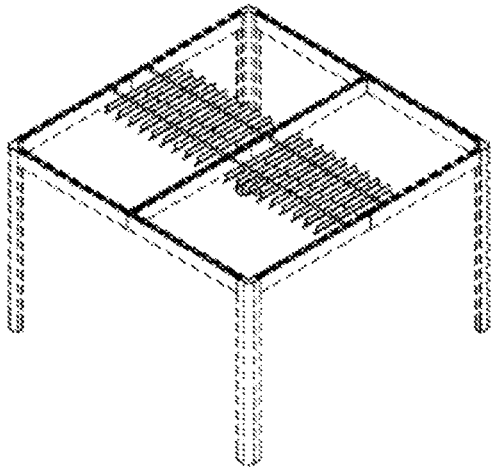
FIG. 38F
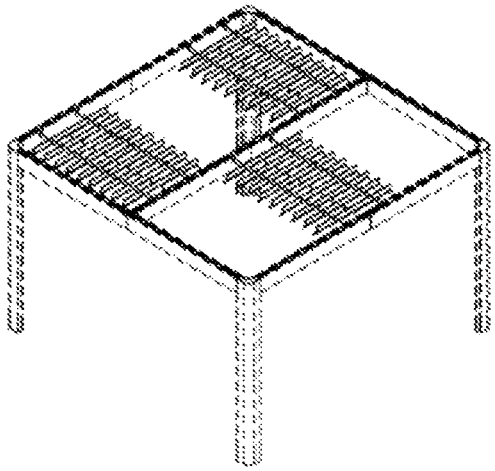
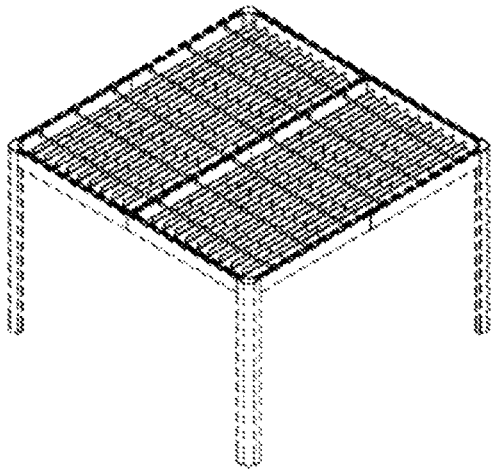
FIG. 38G

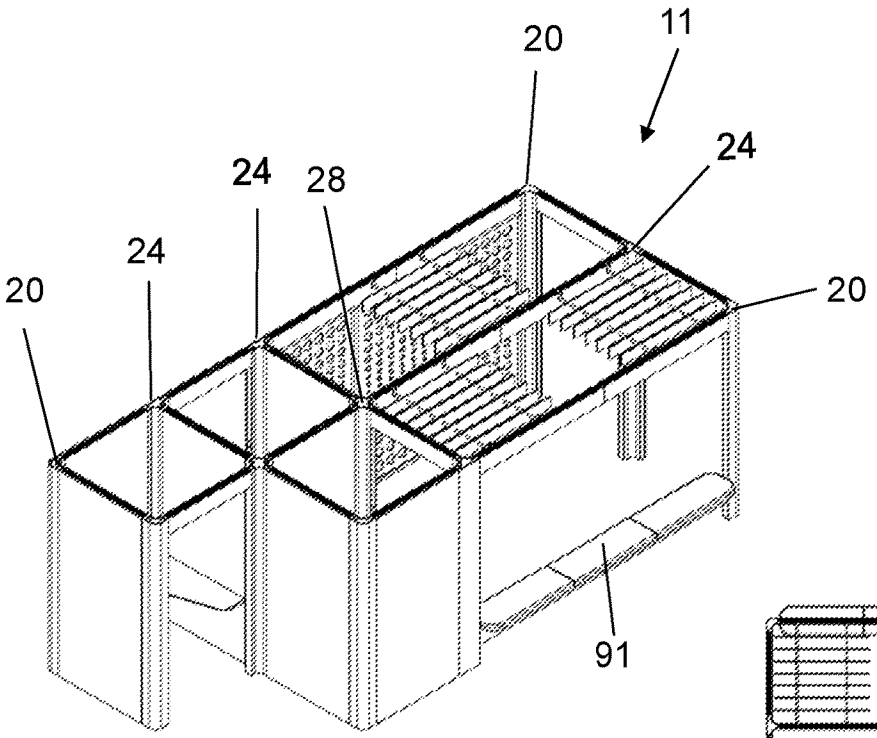
FIG. 41A
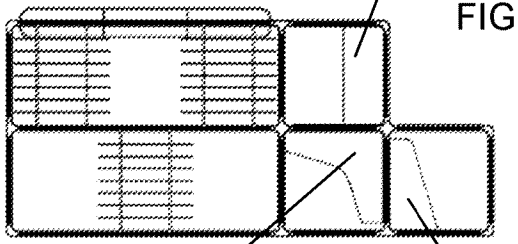
FIG. 41B
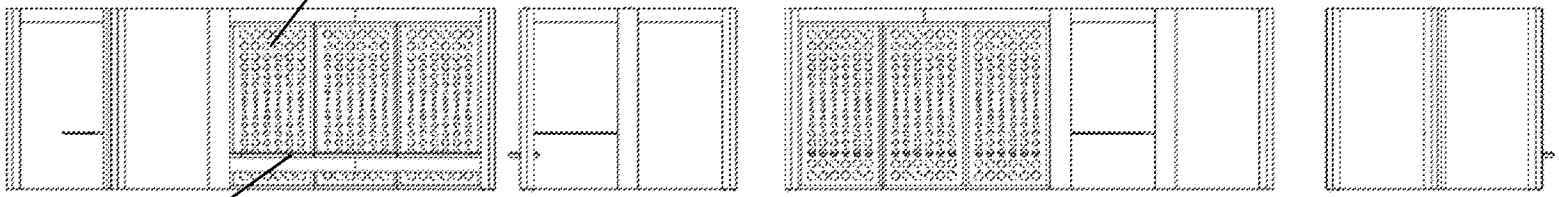
FIG. 41C
FIG. 41D
FIG. 41E
FIG. 41F

MODULAR WORKSPACE SYSTEM

CROSS-REFERENCE TO RELATED APPLICATION

This application claims the benefit of priority to U.S. provisional patent application Ser. No. 63/035,141, filed Jun. 5, 2020, for MODULAR WORKSPACE SYSTEM, incorporated herein by reference.

FIELD OF THE INVENTION

A modular workspace system employs a plurality of interchangeable posts, beams/rails, and panels, permitting assembly of modular rooms and modular room structures of varying size, shape, and purpose. Wire management openings permit internal wire management.

BACKGROUND OF THE INVENTION

Modular rooms and modular room structures are becoming increasingly attractive for use in a variety of markets due to the design flexibility of such rooms and structures. Modular rooms are often employed when additional rooms or room structures are needed within a larger space. Unlike conventional means for constructing rooms within a larger space (e.g., using cinderblock, walls of wood and sheetrock, etc.), modular rooms may be readily assembled and disassembled. Modular rooms are particularly valued in workspaces, as the desired number of rooms and purpose of rooms within a larger space may evolve over time.

Conventional modular rooms employ components that, while similar in shape and function, are not interchangeable with each other. Conventional modular rooms also employ a limited number of panels, restricting the functional and aesthetic options of the rooms. Conventional modular rooms also are not designed to incorporate cabling, such as power lines, phone lines, and data lines, within the internal structure of the rooms, and rely upon external cabling which may be unsightly and pose tripping hazards.

SUMMARY

Embodiments of the present invention address many of the problems and limitations of the prior art. The present invention includes a plurality of interchangeable posts, beams/rails, and panels which may be assembled to form workspaces of varying size, shape, and purpose. Wire management openings in the posts and beams and rails permit internal wire management. The disclosed modular workspace system may be utilized to create offices, breakrooms, meeting rooms, co-working spaces, and other spaces, using both open concept and closed layouts. It is key that multiple, multiple, multiple modular workspace system options are possible using the items described herein.

More particularly, the present invention is for a modular workspace system with a plurality of vertical posts, each of the posts having at least a first vertical rail and a second vertical rail; the first vertical rail having an outward face, the second vertical rail having an outward face; the outward face of each of the first and second vertical rails having a pair of post supports attached to their sides adjacent their outward face; the plurality of vertical posts each receiving at least one of a beam, a top rail, or a cross rail between the outward face of a vertical rail of one post and the outward face of another post, these outward faces facing each other, the facing faces configured such that the at least one of a beam, a top rail, or a cross rail are securely attached to the facing faces and are transverse thereto.

Also, the post supports attached to the sides of the vertical rails create a hollow center section from the top to the bottom of each of the plurality of vertical posts. In the system, at least one of a beam or a top rail is securely attached between the outward face of a vertical rail of one post and the outward face of another post by securing bolts passed through bolt channels in the beam or top rail to be threadably received by threaded bolt receptacles in a mounting plate secured to the outward face of the vertical rail of the one post and in a mounting plate secured to the outward face of the vertical rail of the other post. Each mounting plate can include a wire management opening therethrough and the outward face of the vertical rail to which the mounting plate is secured includes a wire management opening extending from the outward face if the vertical rail into the post hollow center section in alignment with the mounting plate wire management opening. Also, the beam or top rail is an extruded member having a wire management opening through its length such that wire can be run from the hollow center section of one post through the wire management openings in that post and mounting plate, through the length of the beam or top post via its wire management opening, through the wire management openings in the other post mounting plate and other post and into the center hollow portion of that other post.

The beam, top rail, or cross rail can include at least one wire management opening other than at their ends. Also, the outward face of a post vertical rail can include at least one wire management opening at a location where a beam, top rail, or cross rail is not securely attached thereto.

In the system, the plurality of vertical posts can include at least four vertical posts, where the outward face of each vertical rail of each of the at least four vertical posts is securely attached to the outward face of the vertical rail of another of the at least four vertical posts. Also, the plurality of vertical posts can include at least one post with a third vertical rail having an outward face, where that at least one post with a third vertical rail is securely attached to three other posts by one of a beam, top rail, or cross rail secured therebetween and/or can include at least one post with a fourth vertical rail having an outward face, where that at least one post with a fourth vertical rail is securely attached to four other posts by one of a beam, top rail, or cross rail secured therebetween.

Even further, at least one of a beam, top rail, or cross rail secured between two vertical posts can support one of a full wall panel, short wall panel, framed wall panel, acoustic wall panel, table, seat, ceiling component, or lighting batten.

The beam or top rail can include at least one hanging rail along its external length, where clips along the side of a piece of cladding or wall panel engage the at least one hanging rail so that the piece of cladding or wall panel is supported by the beam or top rail.

Additionally, the plurality of vertical posts are preferably wood and, more particularly, the vertical rails are solid wood and the post supports comprise layers of wood veneer.

It will be appreciated that the various systems and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

A better understanding of the present invention will be had upon reference to the following description in conjunction with the accompanying drawings.

FIG. 8C is a top plan view of the beam extending between two first posts.

FIG. 8D is a side elevation view of the beam extending between two first posts.

FIG. 8E is a cross-sectional drawing of the beam extending between two first posts along lines A-A of FIG. 8D.

FIG. 8F is an end view of the beam extending between two first posts.

FIG. 13B is a top plan view of the first embodiment of a framed wall panel.

FIG. 13C is a side elevation view of the first embodiment of a framed wall panel.

FIG. 13D is a bottom plan view of the first embodiment of a framed wall panel.

FIG. 13E is an end elevation view of the first embodiment of a framed wall panel.

FIG. 14B is a top plan view of the second embodiment of a framed wall panel.

FIG. 14C is a side elevation view of the second embodiment of a framed wall panel.

FIG. 14D is a bottom plan view of the second embodiment of a framed wall panel.

FIG. 14E is an end elevation view of the second embodiment of a framed wall panel.

FIG. 15B is a top plan view of the third embodiment of a framed wall panel.

FIG. 15C is a side elevation view of the third embodiment of a framed wall panel.

FIG. 15D is a bottom plan view of the third embodiment of a framed wall panel.

FIG. 15E is an end elevation view of the third embodiment of a framed wall panel.

FIG. 16B is a top plan view of the fourth embodiment of a framed wall panel.

FIG. 16C is a side elevation view of the fourth embodiment of a framed wall panel.

FIG. 16D is a bottom plan view of the fourth embodiment of a framed wall panel.

FIG. 16E is an end elevation view of the fourth embodiment of a framed wall panel.

FIG. 18B is a top plan view of the sixth embodiment of a framed wall panel.

FIG. 18C is a side elevation view of the sixth embodiment of a framed wall panel.

FIG. 18D is a bottom plan view of the sixth embodiment of a framed wall panel.

FIG. 18E is an end elevation view of the sixth embodiment of a framed wall panel.

FIG. 21C is a side elevation view of the acoustic framed wall panel.

FIG. 21D is a bottom plan view of the acoustic framed wall panel.

FIG. 21E is an end elevation view of the acoustic framed wall panel.

FIG. 21F is an exploded view of the acoustic framed wall panel.

FIG. 22A is a side perspective view of a dining height table mounted on a beam and first posts.

FIG. 22B is a top plan view of the dining height table mounted on a beam and first posts.

FIG. 22C is a side elevation view of the dining height table mounted on a beam and first posts.

FIG. 22D is a cross-sectional drawing of the dining height table mounted on a beam and first posts along lines A-A of FIG. 22C.

FIG. 22E is an end elevation view of the dining height table mounted on a beam and first posts.

FIG. 23A is a side perspective view of a bar height table mounted on a beam and first posts.

FIG. 23B is a top plan view of the bar height table mounted on a beam and first posts.

FIG. 23C is a side elevation view of the bar height table mounted on a beam and first posts.

Figure 23A:
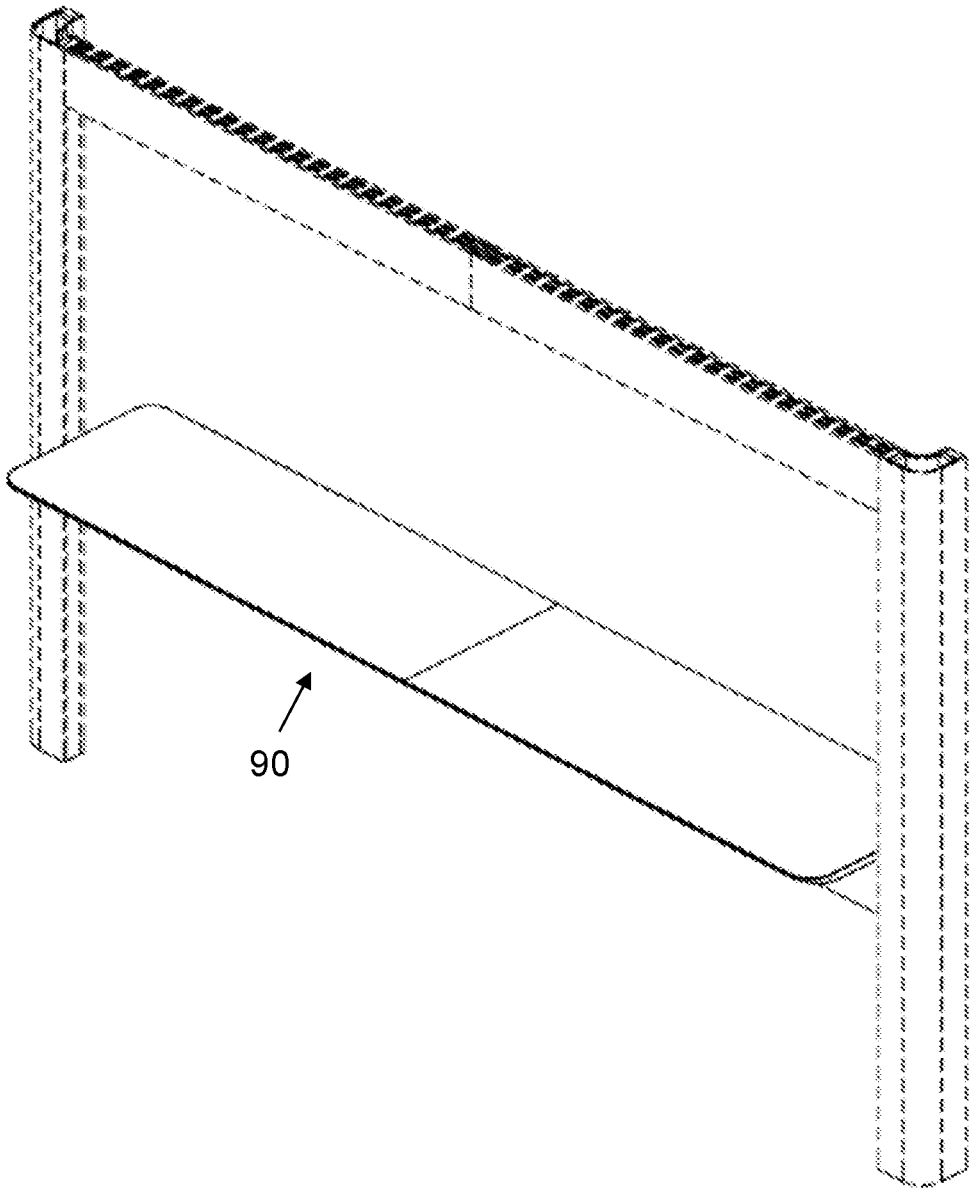

FIG. 23D is a cross-sectional drawing of the bar height table mounted on a beam and first posts along lines A-A of FIG. 23C.

FIG. 23E is an end elevation view of the bar height table mounted on a beam and first posts.

Figure 24A:
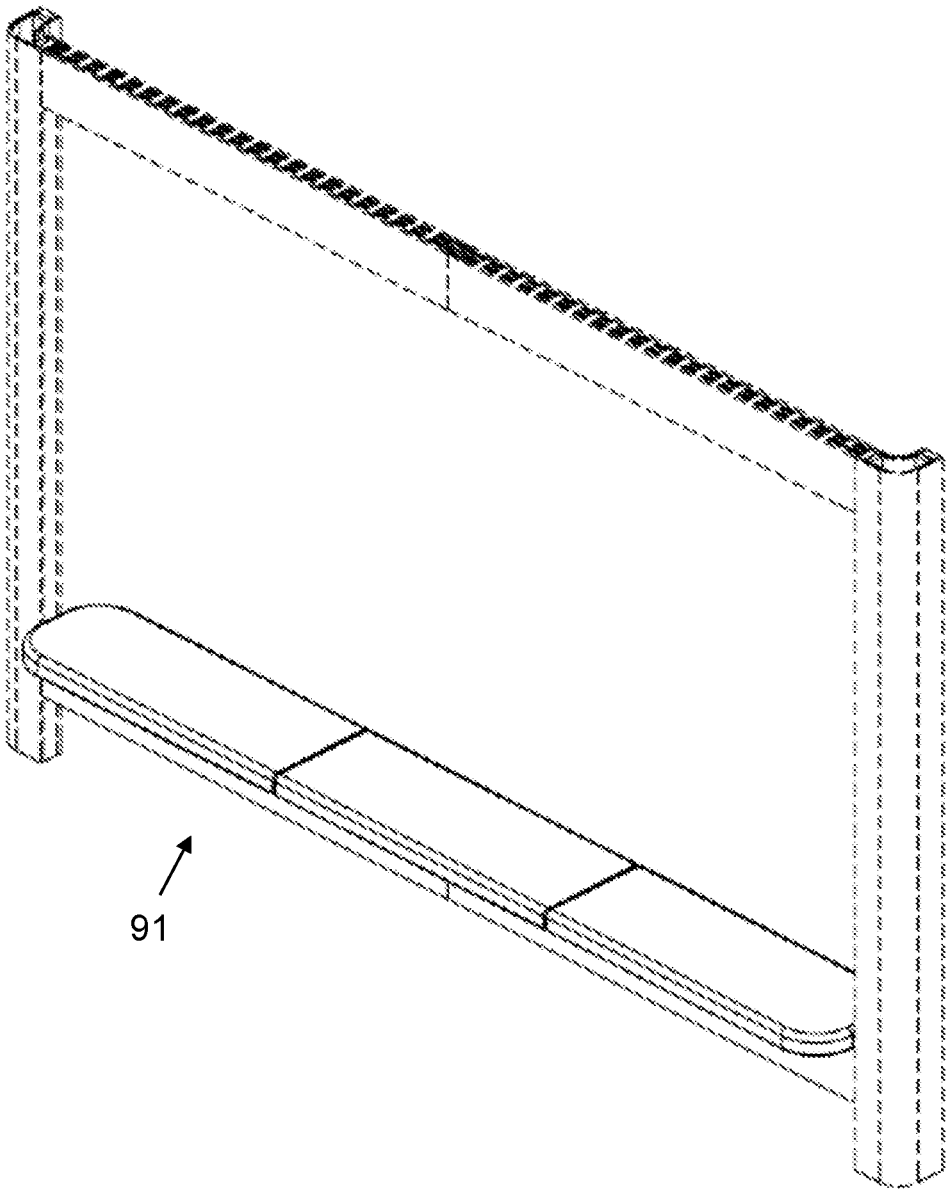

FIG. 24A is a side perspective view of a bench seat mounted on a beam and first posts.

FIG. 24B is a top plan view of the bench seat mounted on a beam and first posts.

FIG. 24C is a side elevation view of the bar height table mounted on a beam and first posts.

FIG. 24D is a cross-sectional drawing of the bar height table mounted on a beam and first posts along lines A-A of FIG. 23C.

FIG. 24E is an end elevation view of the bar height table mounted on a beam and first posts.

Figure 25:
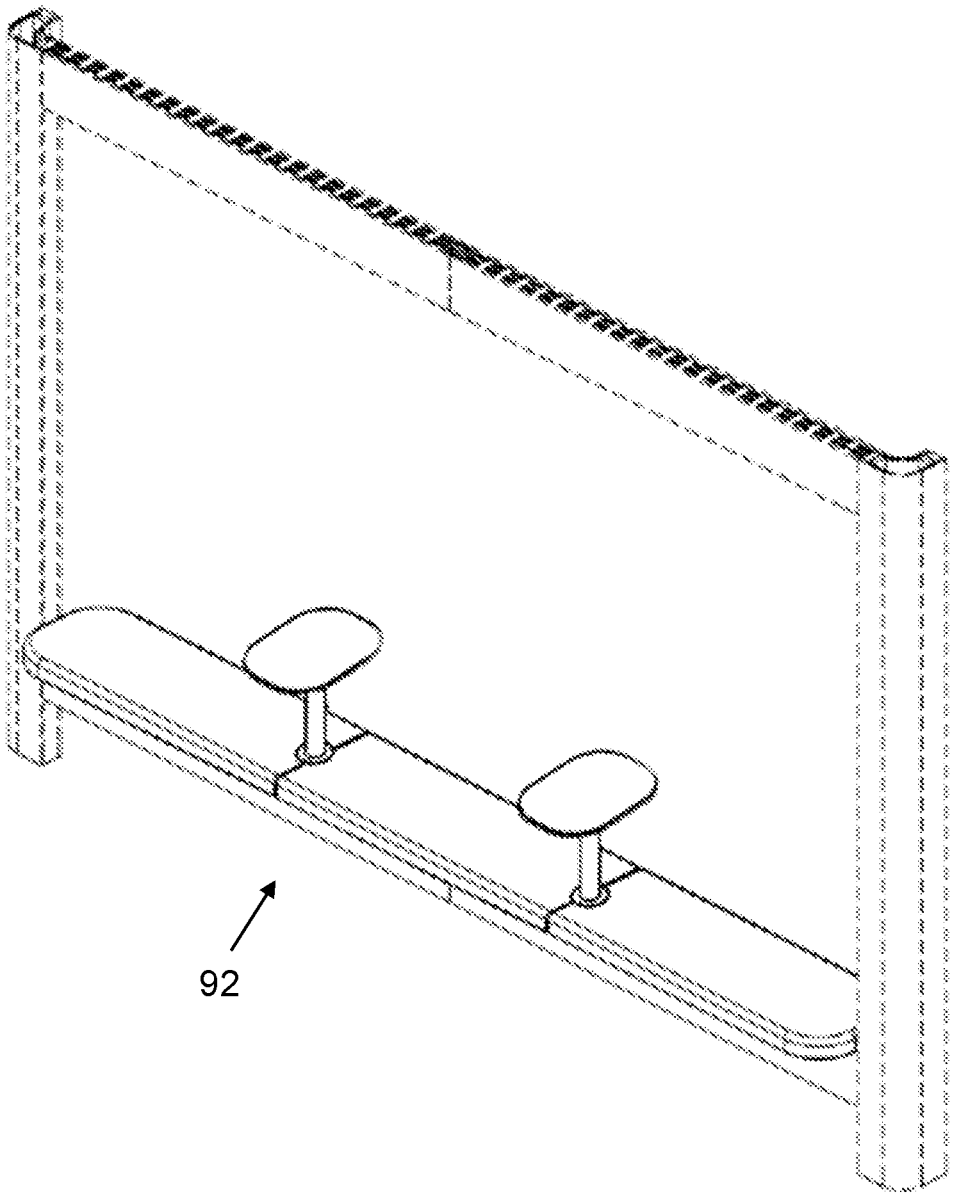

FIG. 25 is a side perspective view of a bench seat with tables mounted on a beam and first posts.

Figure 26:
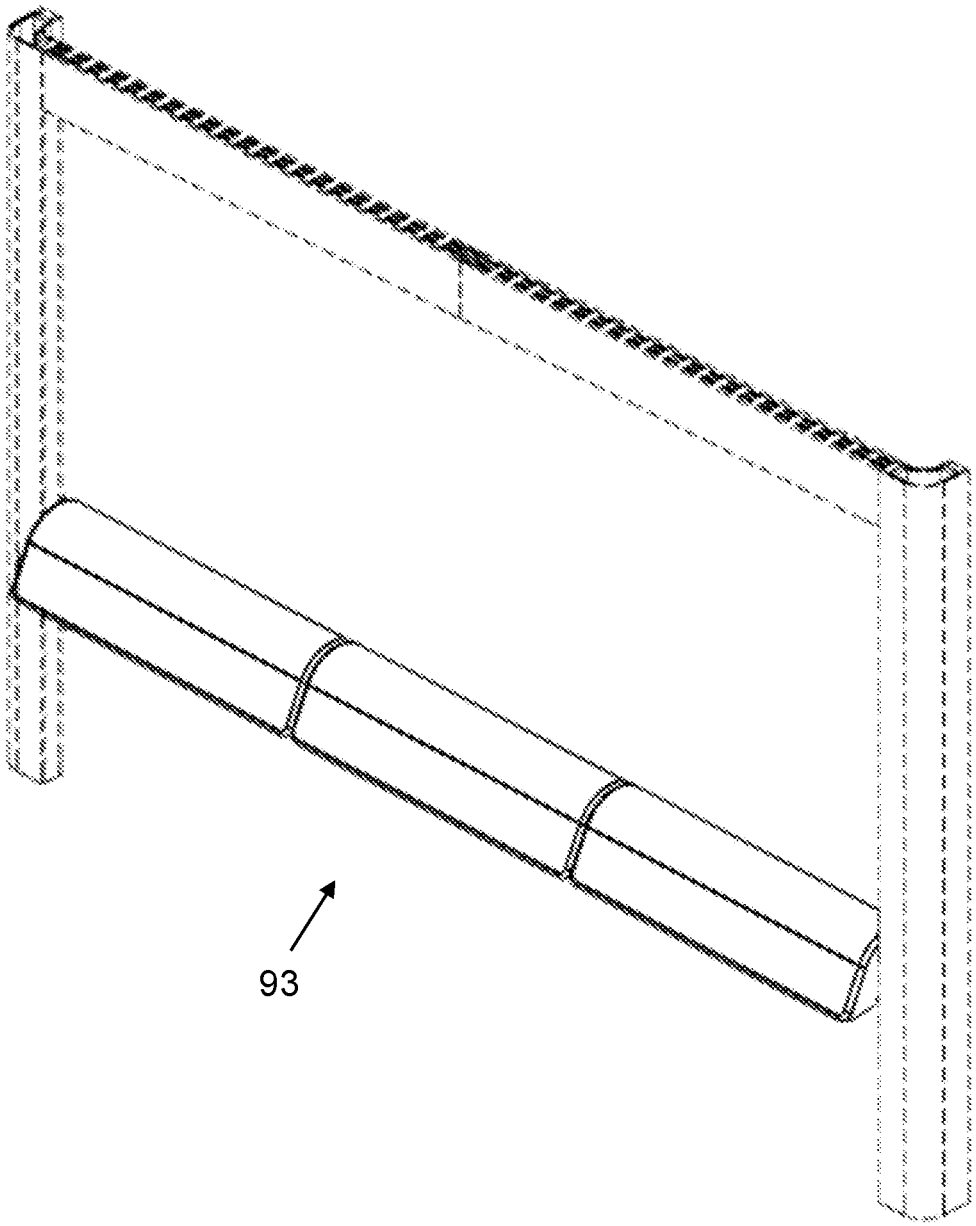
Figure 27A:
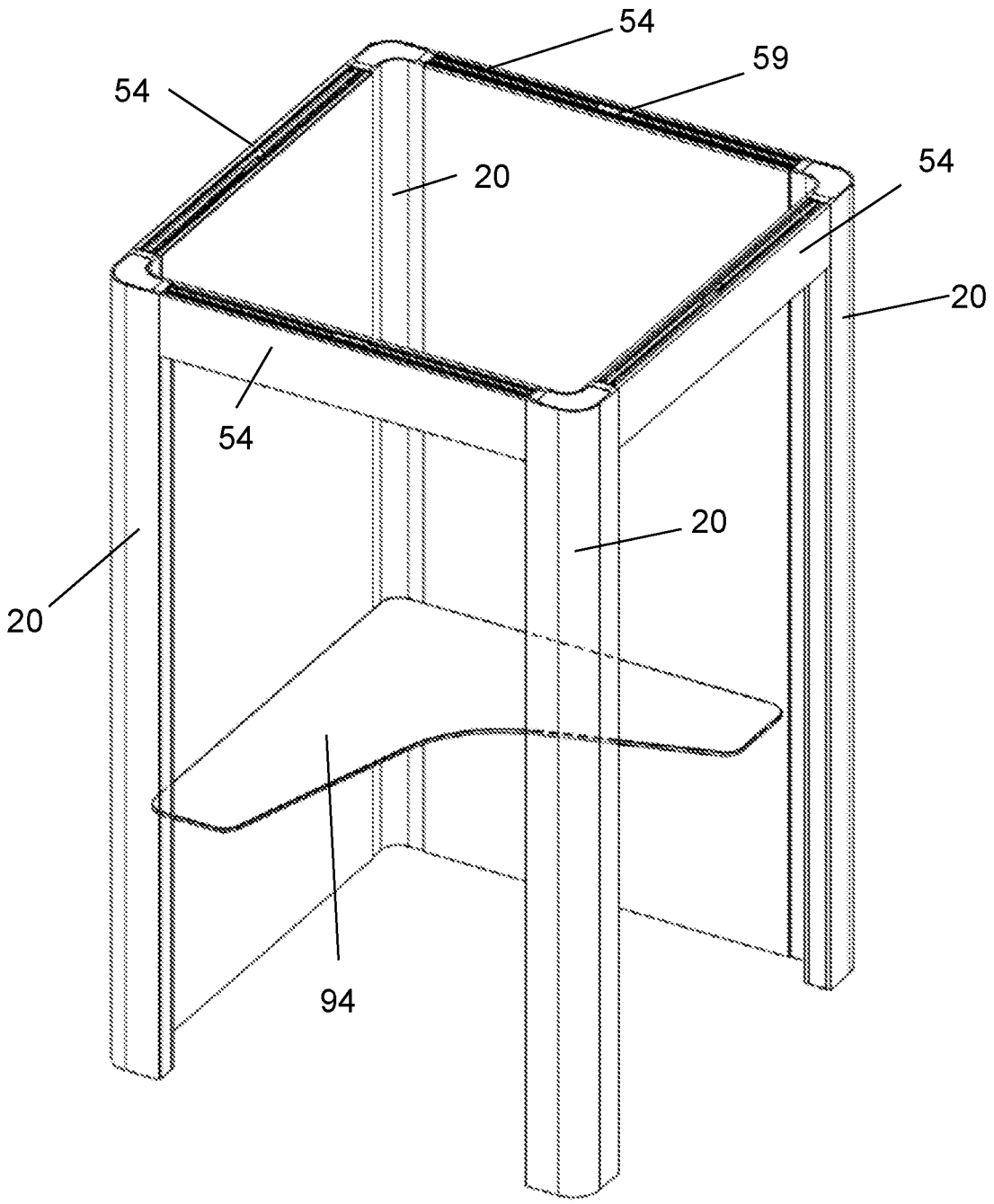

FIG. 26 is a side perspective view of a perch seat mounted on a beam and first posts FIG. 27A is a side perspective view of a 1×1 module with a boomerang table.

FIG. 27B is a top plan view of the 1×1 module with a boomerang table.

FIG. 27C is a left side elevation view of the 1×1 module with a boomerang table.

FIG. 27D is a front elevation view of the 1×1 module with a boomerang table.

FIG. 27E is a right side elevation view of the 1×1 module with a boomerang table.

FIG. 27F is a bottom plan view of the 1×1 module with a boomerang table.

Figure 28A:
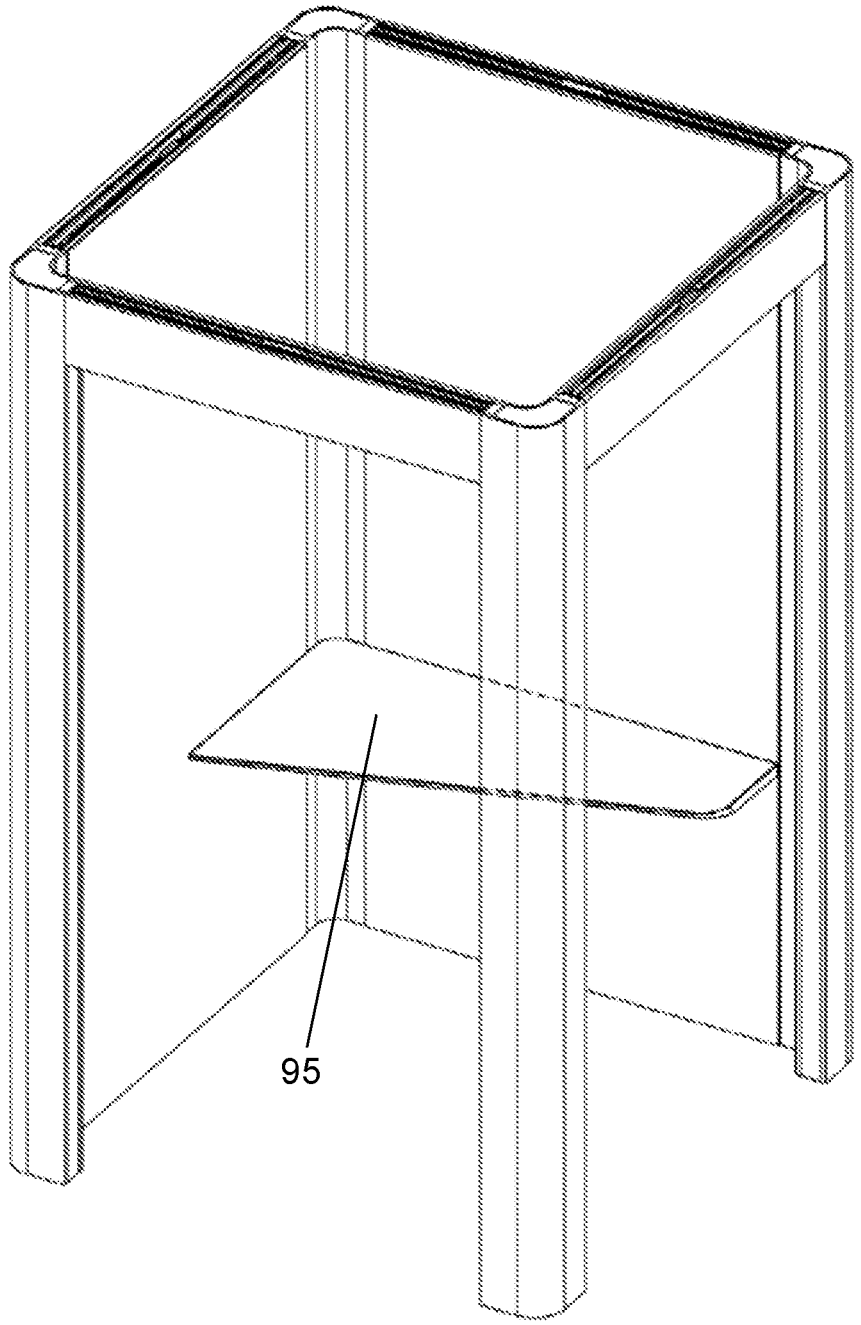

FIG. 28A is a side perspective view of a 1×1 module with an angled table.

FIG. 28B is a top plan view of the 1×1 module with an angled table.

FIG. 28C is a left side elevation view of the 1×1 module with an angled table.

FIG. 28D is a front elevation view of the 1×1 module with an angled table.

FIG. 28E is a right side elevation view of the 1×1 module with an angled table.

FIG. 28F is a bottom plan view of the 1×1 module with an angled table.

Figure 29A:
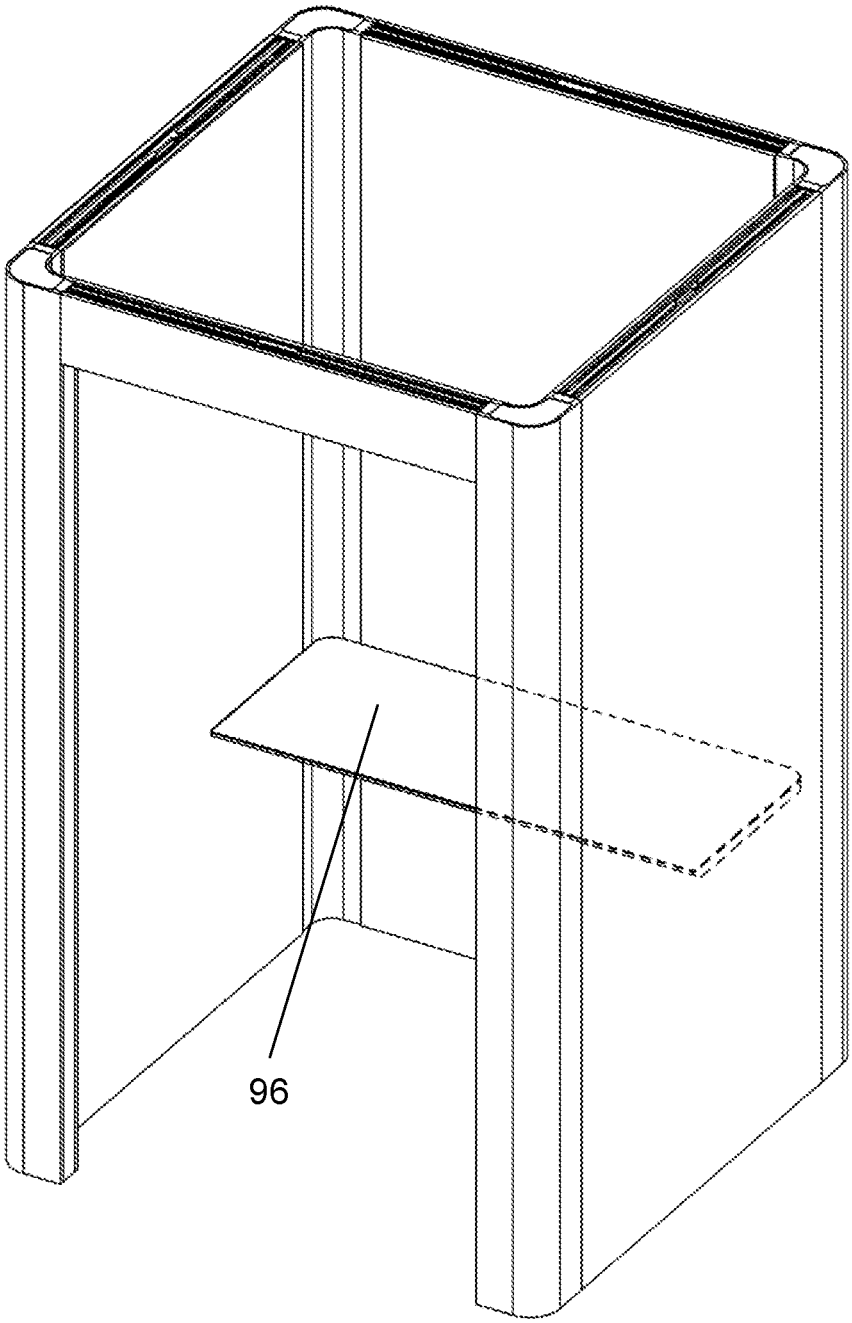

FIG. 29A is a side perspective view of a 1×1 module with a rectangular table.

FIG. 29B is a top plan view of the 1×1 module with a rectangular table.

FIG. 29C is a left side elevation view of the 1×1 module with a rectangular table.

FIG. 29D is a front elevation view of the 1×1 module with a rectangular table.

FIG. 29E is a right side elevation view of the 1×1 module with a rectangular table.

FIG. 29F is a bottom plan view of the 1×1 module with a rectangular table.

Figure 30A:
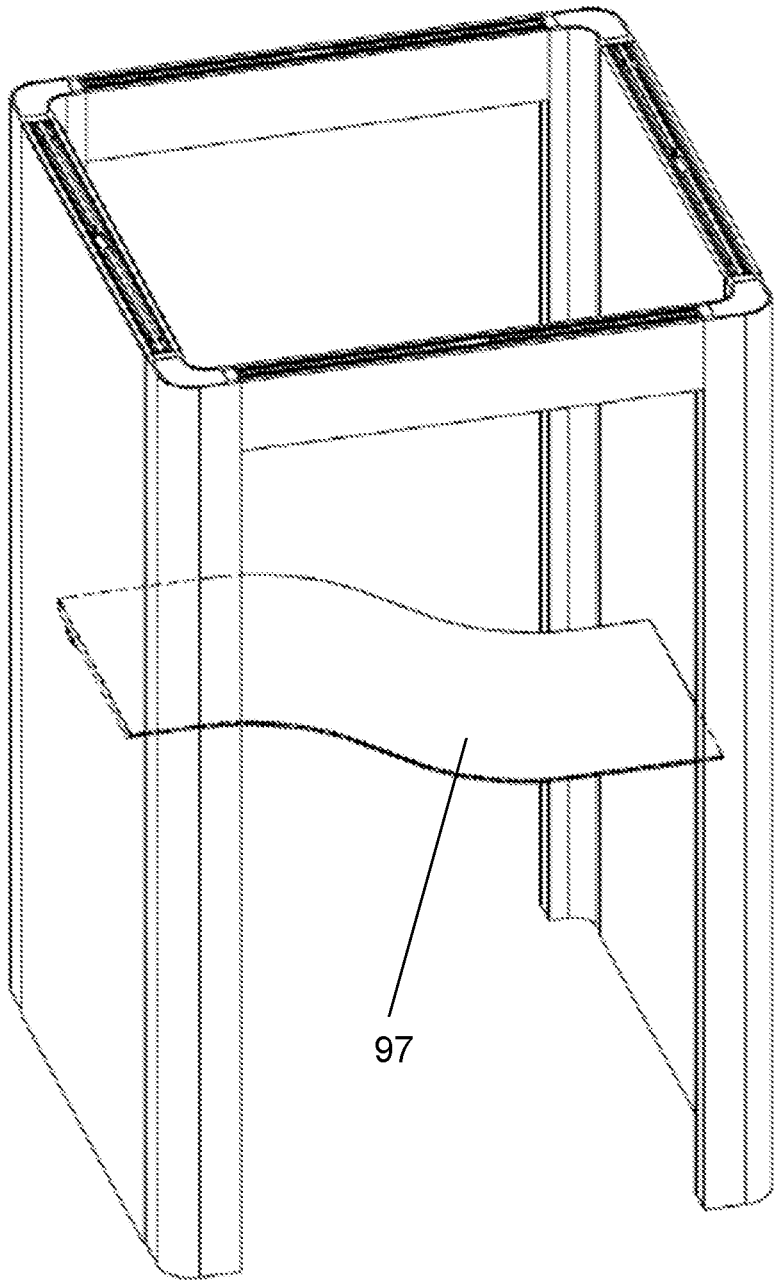

FIG. 30A is a side perspective view of a 1×1 module with a serpentine table.

FIG. 30B is a top plan view of the 1×1 module with a serpentine table.

FIG. 30C is a left side elevation view of the 1×1 module with a serpentine table.

FIG. 30D is a front elevation view of the 1×1 module with a serpentine table.

FIG. 30E is a right side elevation view of the 1×1 module with a serpentine table.

FIG. 30F is a bottom plan view of the 1×1 module with a serpentine table.

Figure 31A:
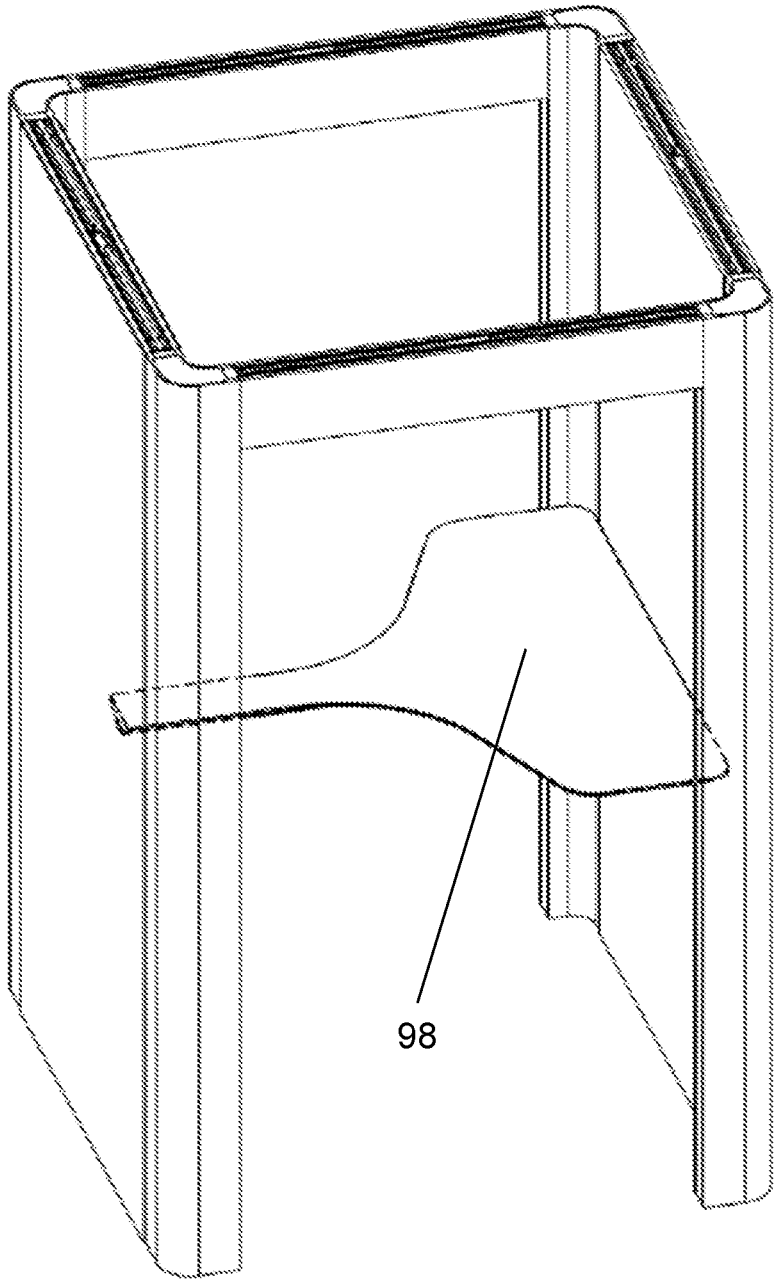

FIG. 31A is a side perspective view of a 1×1 module with a bottleneck table.

FIG. 31B is a top plan view of the 1×1 module with a bottleneck table.

FIG. 31C is a left side elevation view of the 1×1 module with a bottleneck table.

FIG. 31D is a front elevation view of the 1×1 module with a bottleneck table.

FIG. 31E is a right side elevation view of the 1×1 module with a bottleneck table.

FIG. 31F is a bottom plan view of the 1×1 module with a bottleneck table.

Figure 32A:
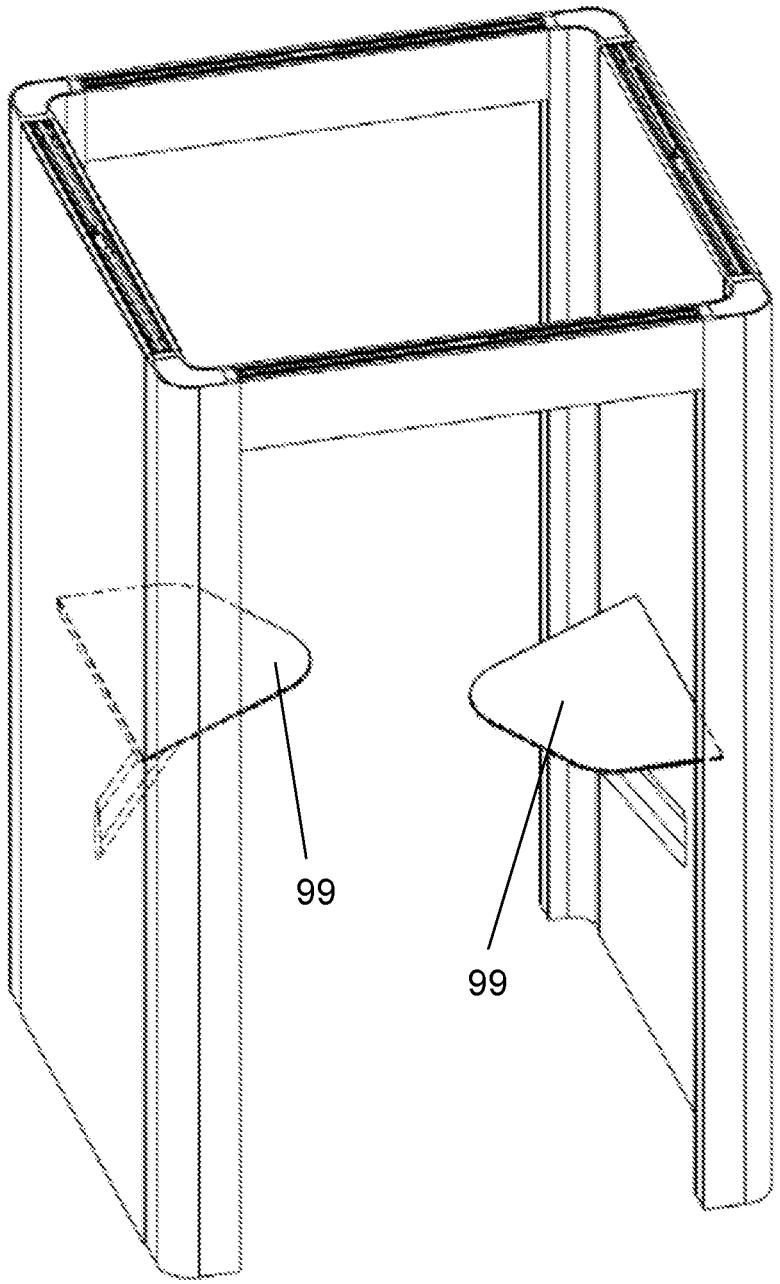

FIG. 32A is a side perspective view of a 1×1 module with opposing tables.

FIG. 32B is a top plan view of the 1×1 module with opposing tables.

FIG. 32C is a left side elevation view of the 1×1 module with opposing tables.

FIG. 32D is a front elevation view of the 1×1 module with opposing tables.

FIG. 32E is a right side elevation view of the 1×1 module with opposing tables.

FIG. 32F is a bottom plan view of the 1×1 module with opposing tables.

Figure 33A:
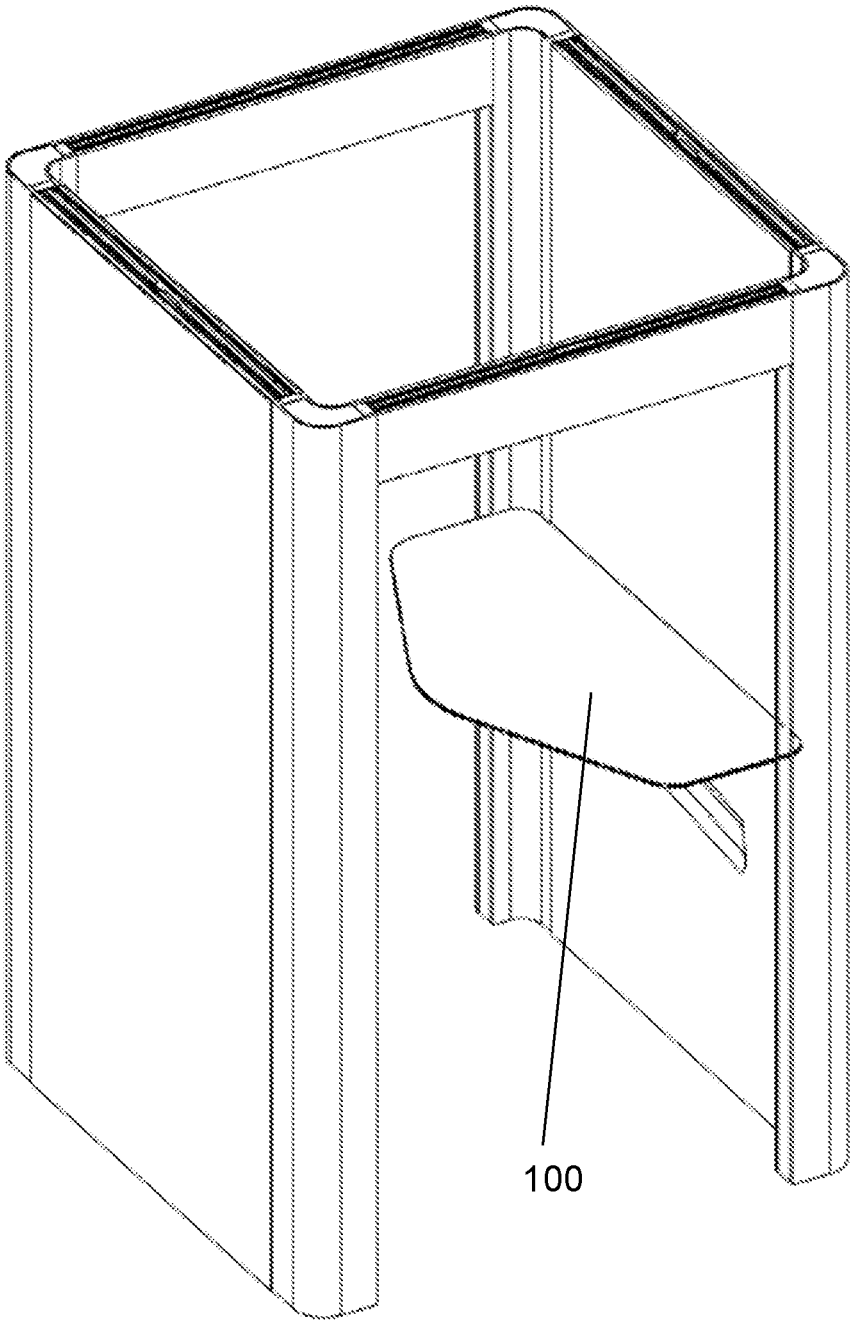

FIG. 33A is a side perspective view of a 1×1 module with a delta table.

FIG. 33B is a top plan view of the 1×1 module with a delta table.

FIG. 33C is a left side elevation view of the 1×1 module with a delta table.

FIG. 33D is a front elevation view of the 1×1 module with a delta table.

FIG. 33E is a right side elevation view of the 1×1 module with a delta table.

FIG. 33F is a bottom plan view of the 1×1 module with a delta table.

Figure 34A:
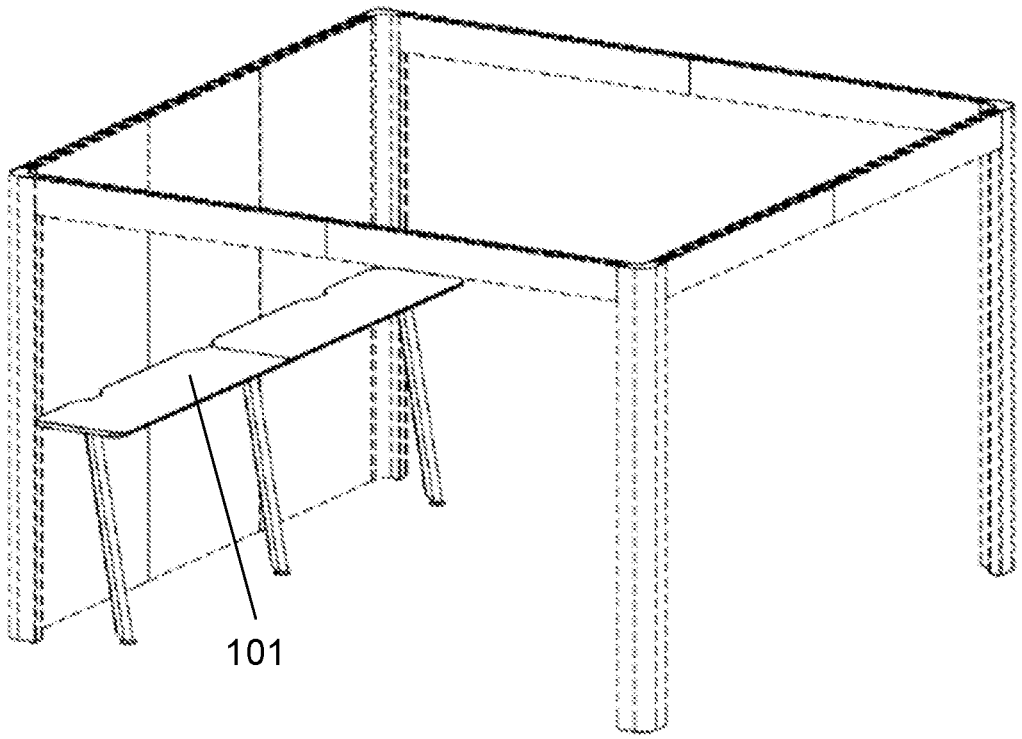

FIG. 34A is a side perspective view of a 3×3 module with an internal bar height table.

FIG. 34B is a top plan view of the 3×3 module with an internal bar height table.

FIG. 34C is a side elevation view of the 3×3 module with an internal bar height table.

FIG. 34D is a bottom plan view of the 3×3 module with an internal bar height table.

FIG. 34E is a front elevation view of the 3×3 module with an internal bar height table.

Figure 35A:
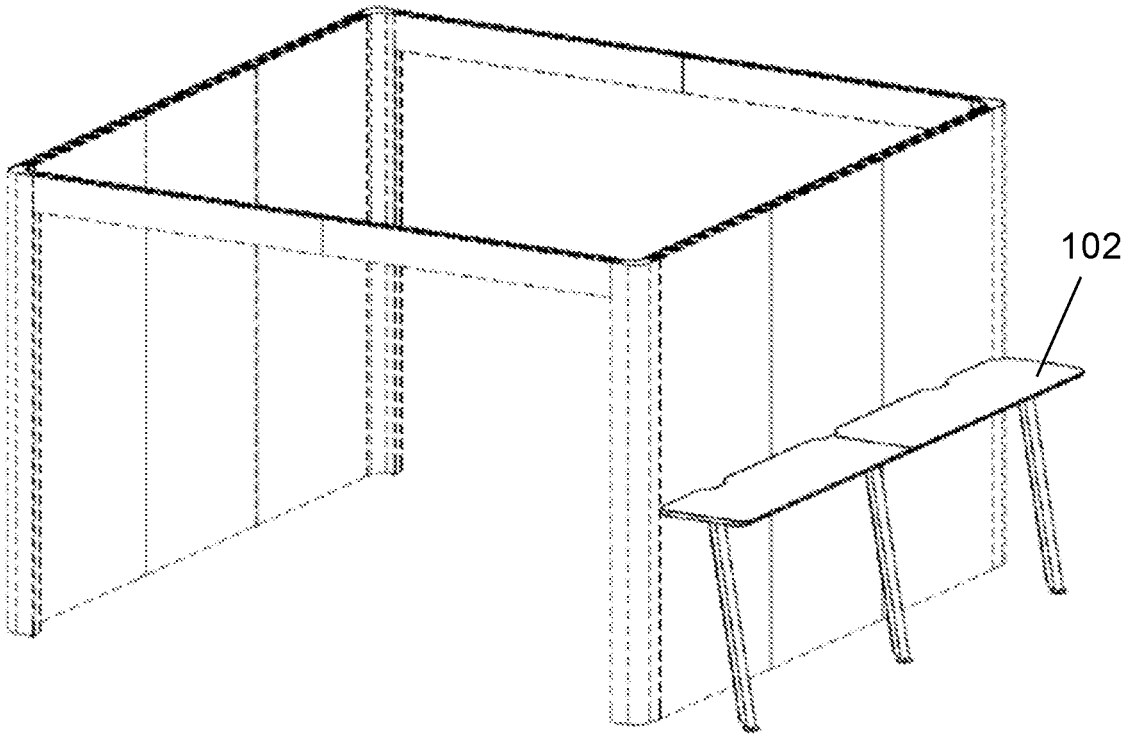

FIG. 35A is a side perspective view of a 3×3 module with an external bar height table.

FIG. 35B is a top plan view of the 3×3 module with an external bar height table.

FIG. 35C is a side elevation view of the 3×3 module with an external bar height table.

FIG. 35D is a bottom plan view of the 3×3 module with an external bar height table.

FIG. 35E is a front elevation view of the 3×3 module with an external bar height table.

Figure 36A:
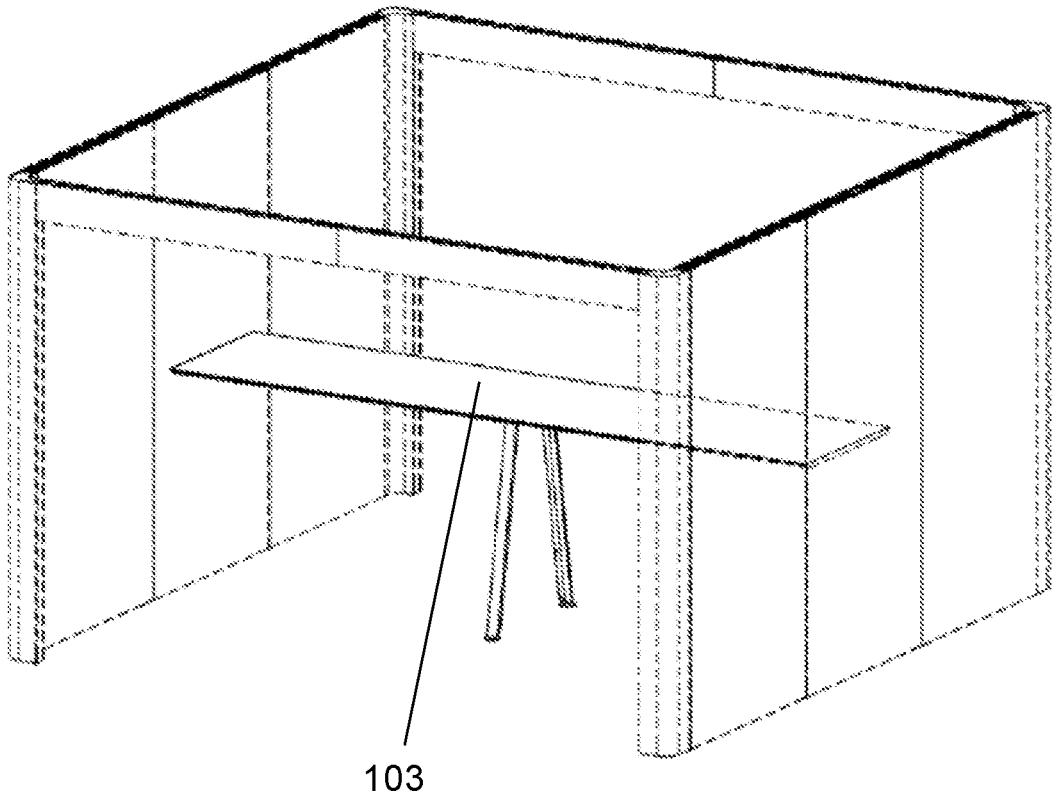

FIG. 36A is a side perspective view of a 3×3 module with a central bar height table extending between the module panels.

FIG. 36B is a top plan view of the 3×3 module with a central bar height table extending between the module panels.

FIG. 36C is a side elevation view of the 3×3 module with a central bar height table extending between the module panels.

FIG. 36D is a bottom plan view of the 3×3 module with a central bar height table extending between the module panels.

FIG. 36E is a front elevation view of the 3×3 module with a central bar height table extending between the module panels.

FIG. 37A is a top plan view of a first ceiling component.

FIG. 37B is a side elevation view of the first ceiling component.

FIG. 37C is a side perspective view of the first ceiling component.

FIG. 37D is an end elevation view of the first ceiling component.

Figure 37E:
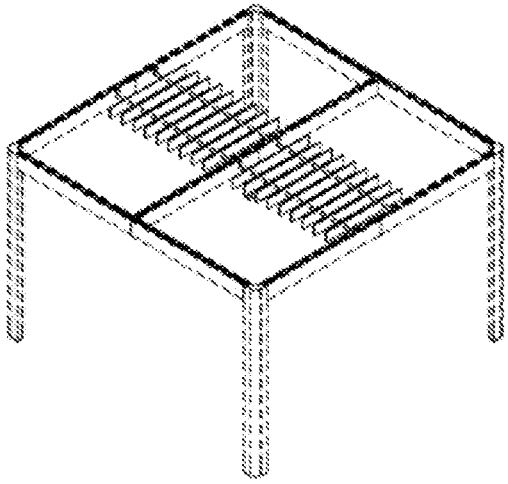

FIG. 37E is a side perspective view of a 2×2 module carrying two first ceiling components.

Figure 37F:
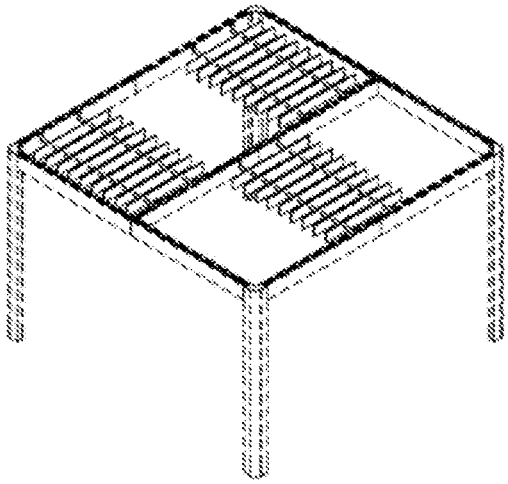

FIG. 37F is a side perspective view of a 2×2 module carrying three first ceiling components.

Figure 37G:
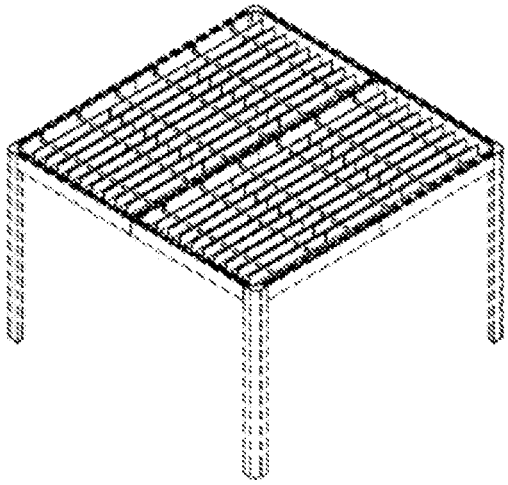

FIG. 37G is a side perspective view of a 2×2 module carrying six first ceiling components.

FIG. 38A is a top plan view of a second ceiling component.

FIG. 38B is a side elevation view of the second ceiling component.

FIG. 38C is a side perspective view of the second ceiling component.

FIG. 38D is an end elevation view of the second ceiling component.

FIG. 38E is a side perspective view of a 2×2 module carrying two second ceiling components.

FIG. 38F is a side perspective view of a 2×2 module carrying three second ceiling components.

FIG. 38G is a side perspective view of a 2×2 module carrying six second ceiling components.

Figure 39B:
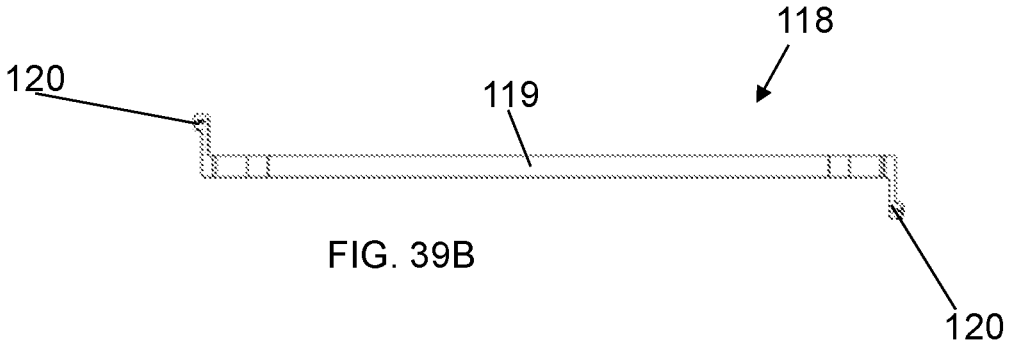
Figure 39A:
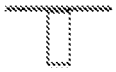

FIG. 39A is an end elevation view of a lighting batten.

FIG. 39B is a top plan view of the lighting batten.

Figure 39C:
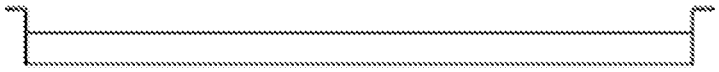

FIG. 39C is a side elevation view of the lighting batten.

Figure 39D:
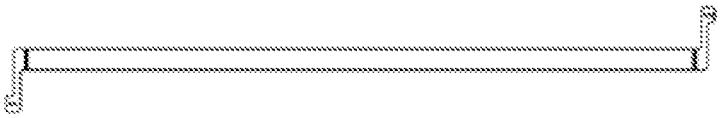

FIG. 39D is a bottom plan view of the lighting batten.

Figure 39E:
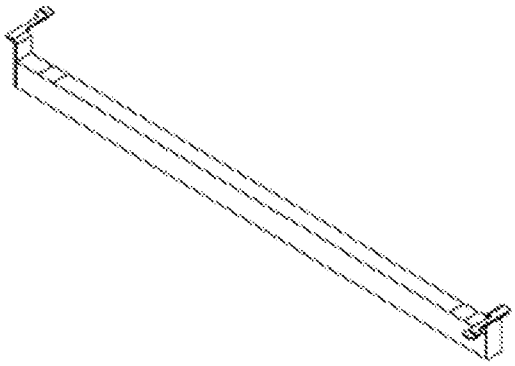

FIG. 39E is a side perspective view of the lighting batten.

Figure 39F:
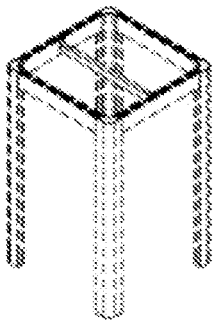

FIG. 39F is a side perspective view of a 1×1 module carrying a lighting batten.

Figure 39G:
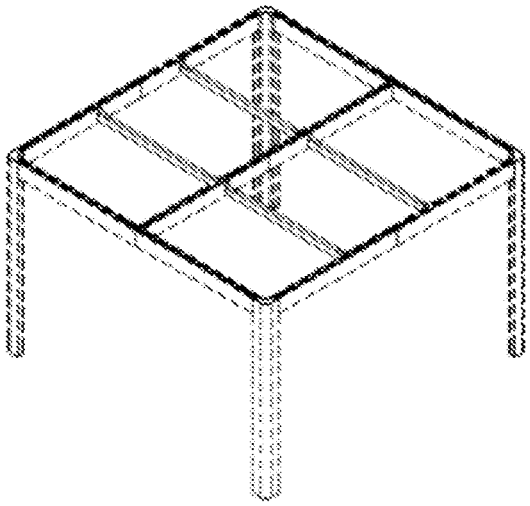

FIG. 39G is a side perspective view of a 3×3 module carrying four lighting battens.

Figure 39H:
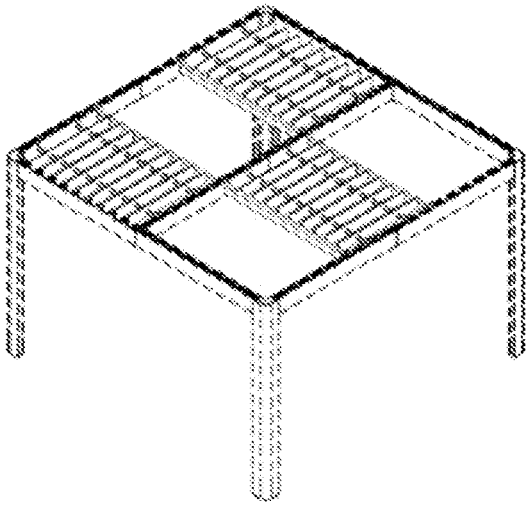

FIG. 39H is a side perspective view of a 3×3 module carrying four lighting battens and three first ceiling components.

Figure 40B:
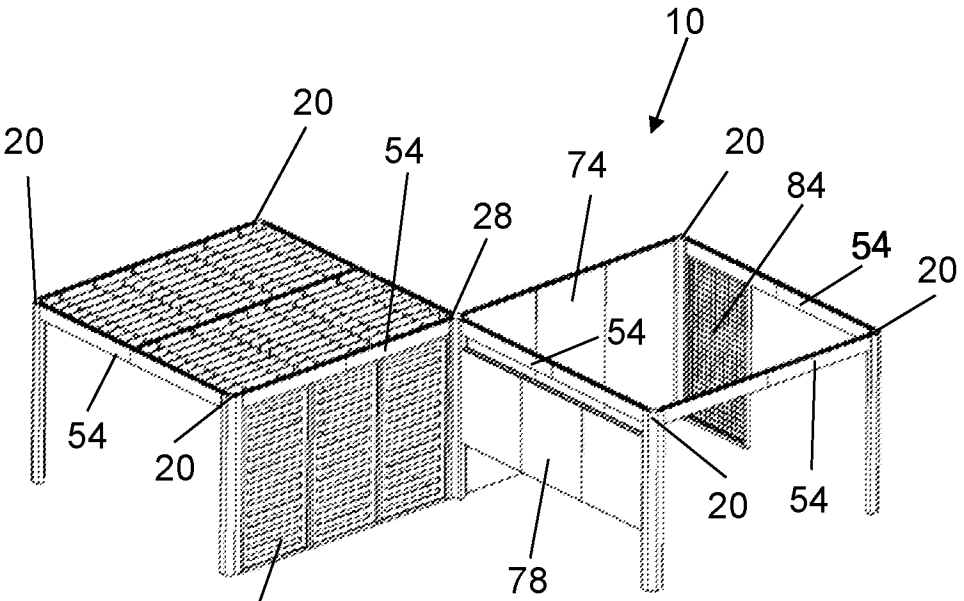
Figure 40D:
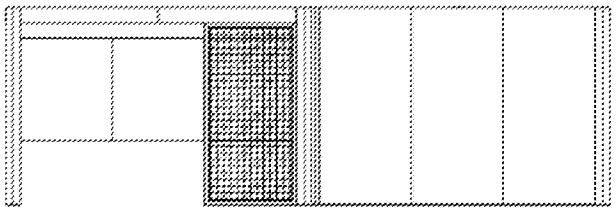
Figure 40A:
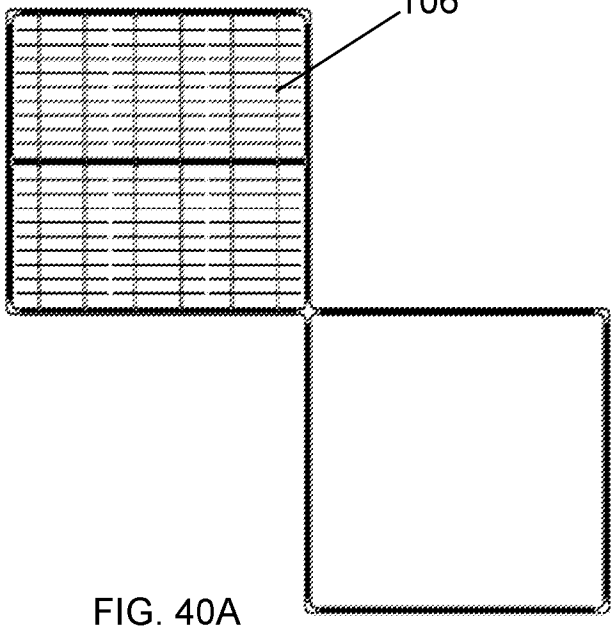

FIG. 40A is a top plan view of an exemplary modular workspace including two 3×3 modules.

FIG. 40B is a side perspective view of the exemplary modular workspace including two 3×3 modules.

Figure 40C:
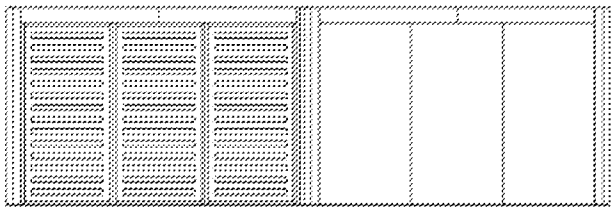

FIG. 40C is a front elevation view of the exemplary modular workspace including two 3×3 modules.

FIG. 40D is a side elevation view of the exemplary modular workspace including two 3×3 modules.

FIG. 41A is a side perspective view of the exemplary modular workspace including two 1×3 modules and three 1×1 modules.

FIG. 41B is a top plan view of an exemplary modular workspace including two 1×3 modules and three 1×1 modules.

FIG. 41C is a front elevation view of the exemplary modular workspace including two 1×3 modules and three 1×1 modules.

FIG. 41D is a left side elevation view of the exemplary modular workspace including two 1×3 modules and three 1×1 modules.

FIG. 41E is a rear elevation view of the exemplary modular workspace including two 1×3 modules and three 1×1 modules.

FIG. 41F is a right side elevation view of the exemplary modular workspace including two 1×3 modules and three 1×1 modules.

Figures 42A, 42B, 42C, 42D, 42E, 42F:
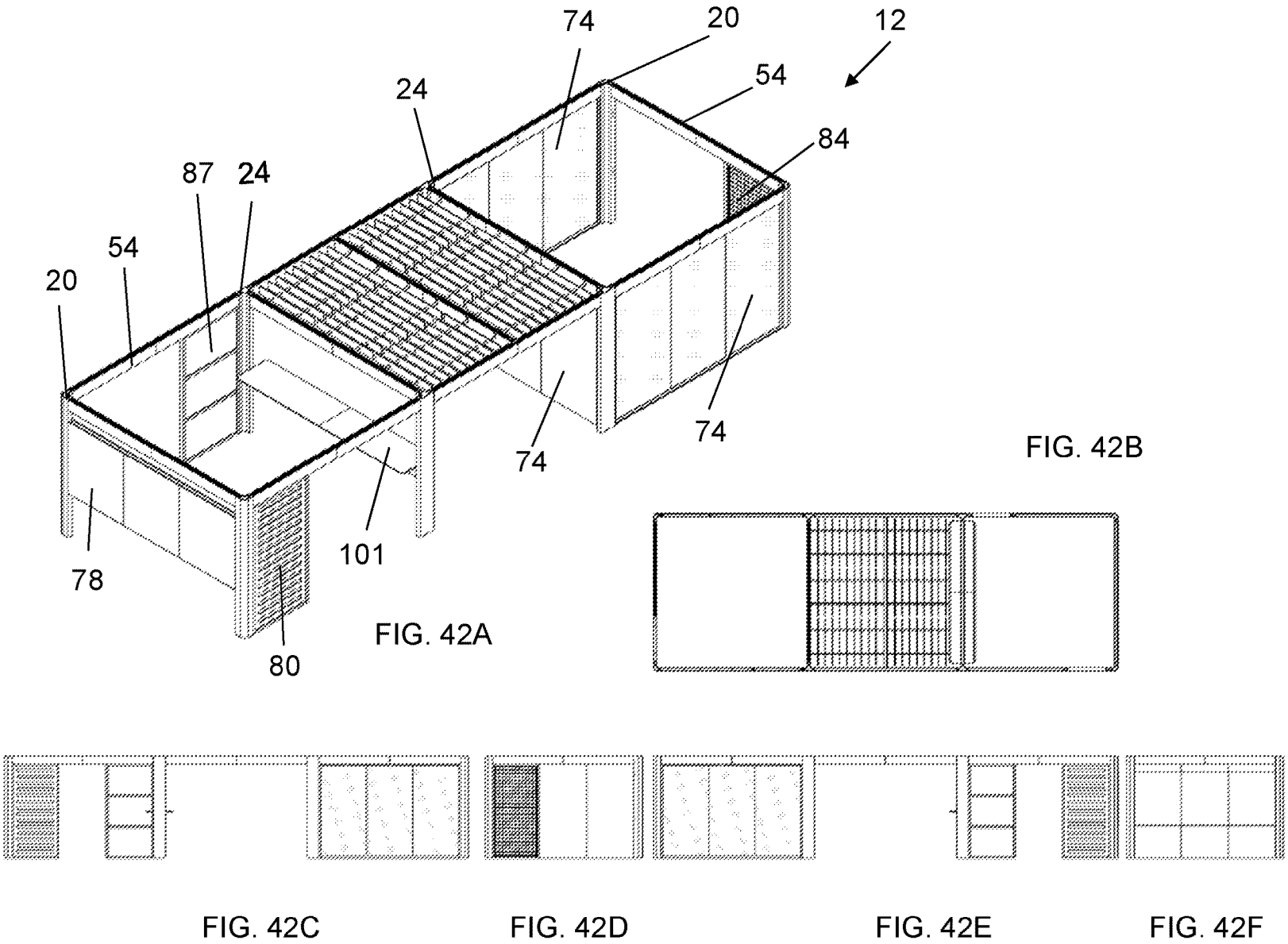

FIG. 42A is a side perspective view of the exemplary modular workspace including three 3×3 modules.

FIG. 42B is a top plan view of an exemplary modular workspace including three 3×3 modules.

FIG. 42C is a front elevation view of the exemplary modular workspace including three 3×3 modules.

FIG. 42D is a left side elevation view of the exemplary modular workspace including three 3×3 modules.

FIG. 42E is a rear elevation view of the exemplary modular workspace including three 3×3 modules.

FIG. 42F is a right side elevation view of the exemplary modular workspace including three 3×3 modules.

Figure 43:
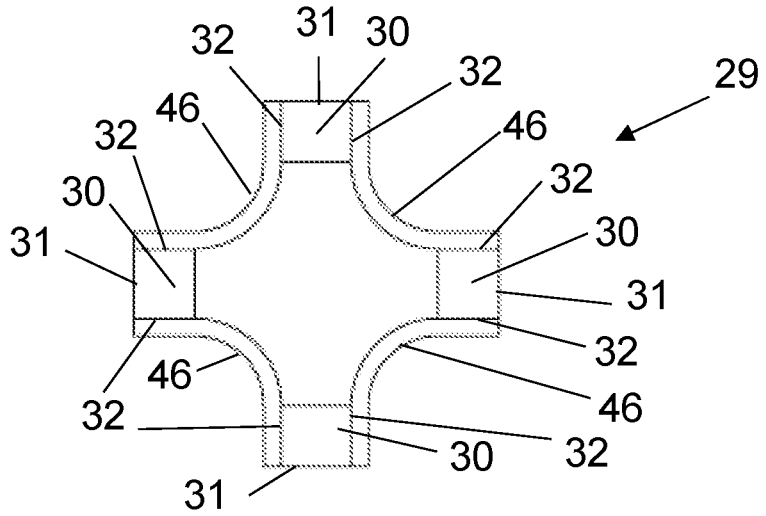

FIG. 43 is a top plan view of a 4-way post without a routed in cap receptacle.

Figure 44:
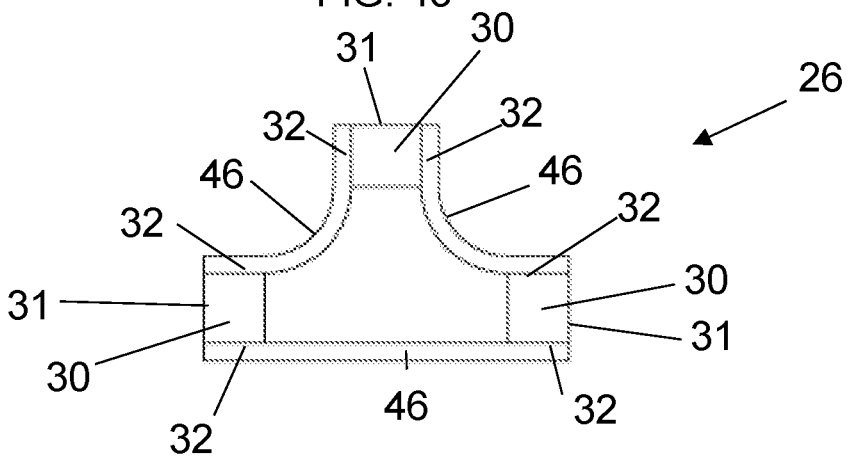

FIG. 44 is a top plan view of a T-post without a routed in cap receptacle.

Figure 45:
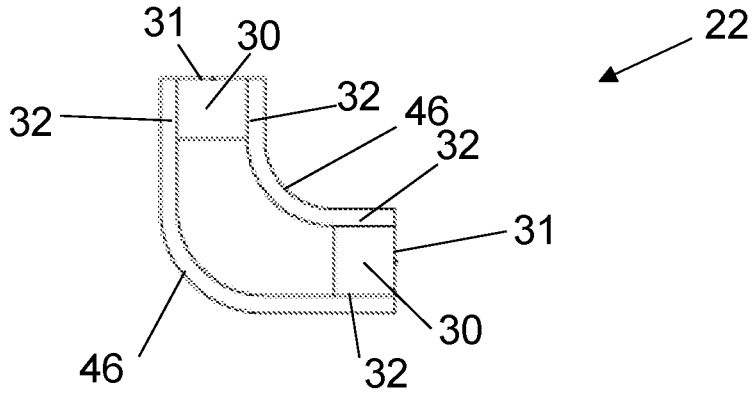

FIG. 45 is a top plan view of a corner post without a routed in cap receptacle.

Figure 46:
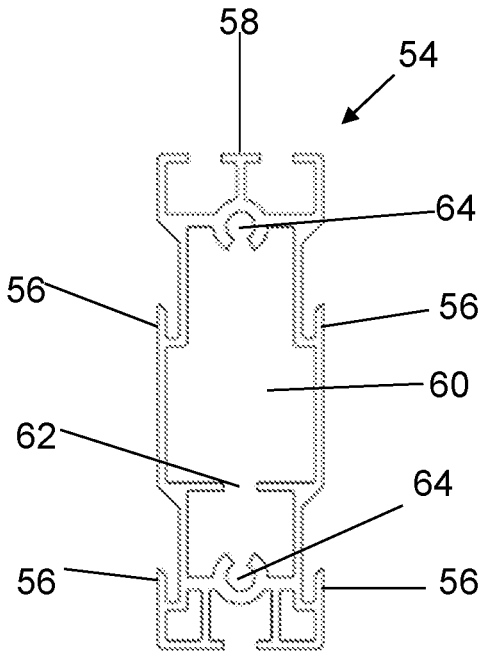

FIG. 46 is an end view of a beam.

Figure 47:
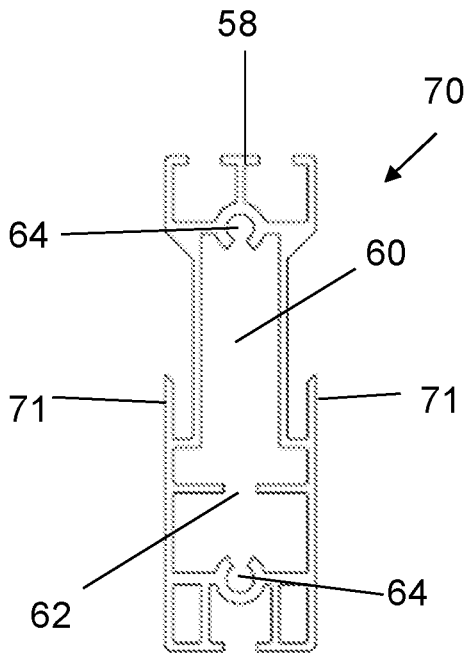

FIG. 47 is an end view of a top rail.

Figure 48:
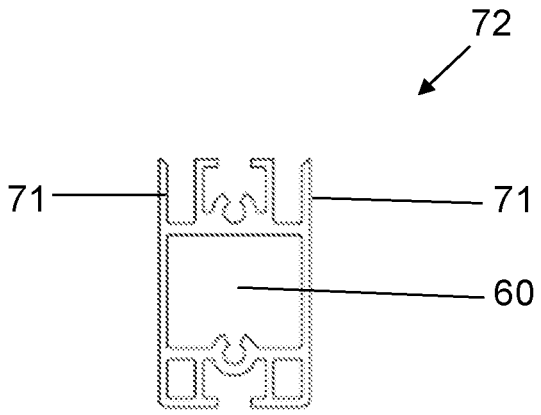

FIG. 48 is an end view of a side or cross rail.

Figure 49:
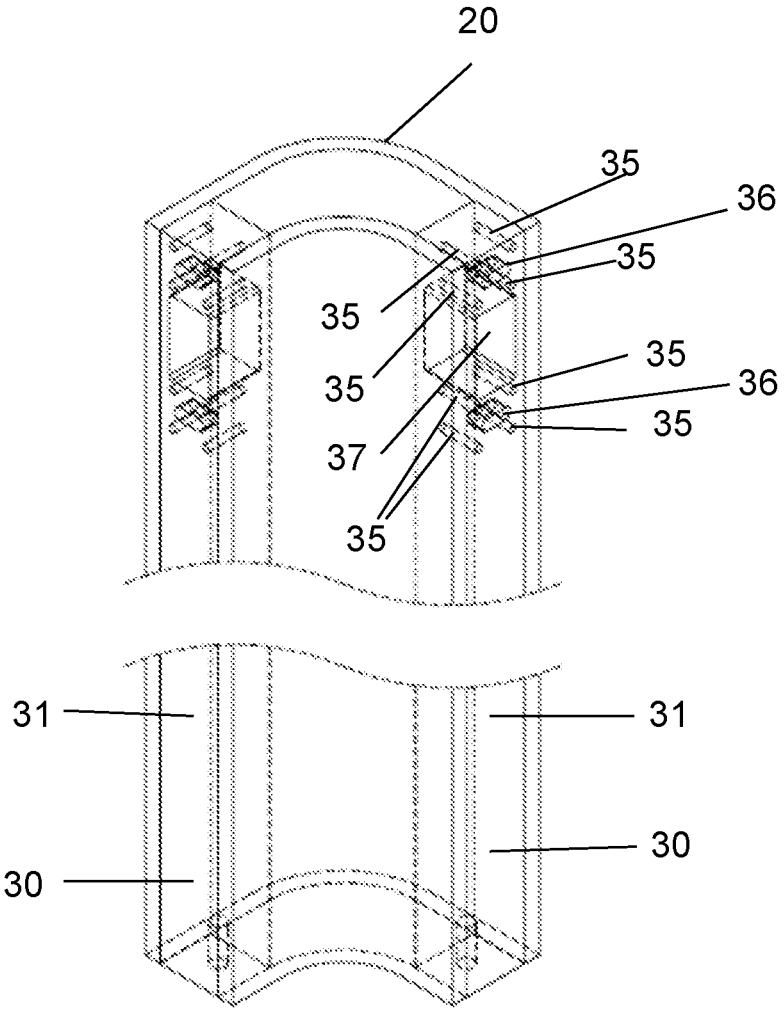

FIG. 49 shows a corner post with the drilled and routed out portions in the vertical rails for attachment of a beam or top rail mounting plate.

Figure 50:
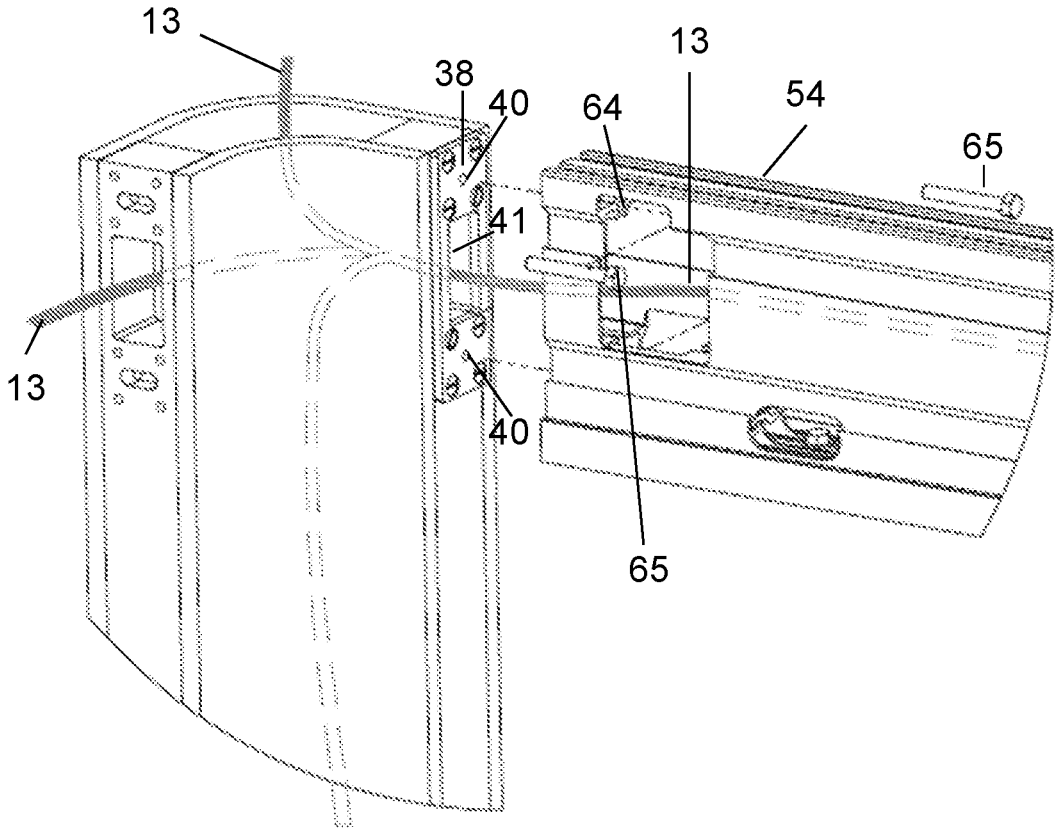

FIG. 50 shows how a beam is bolted to the mounting plate on the outward face of a vertical rail and demonstrates how wire management openings can be used to run wire through the beams and posts.

Figure 51:
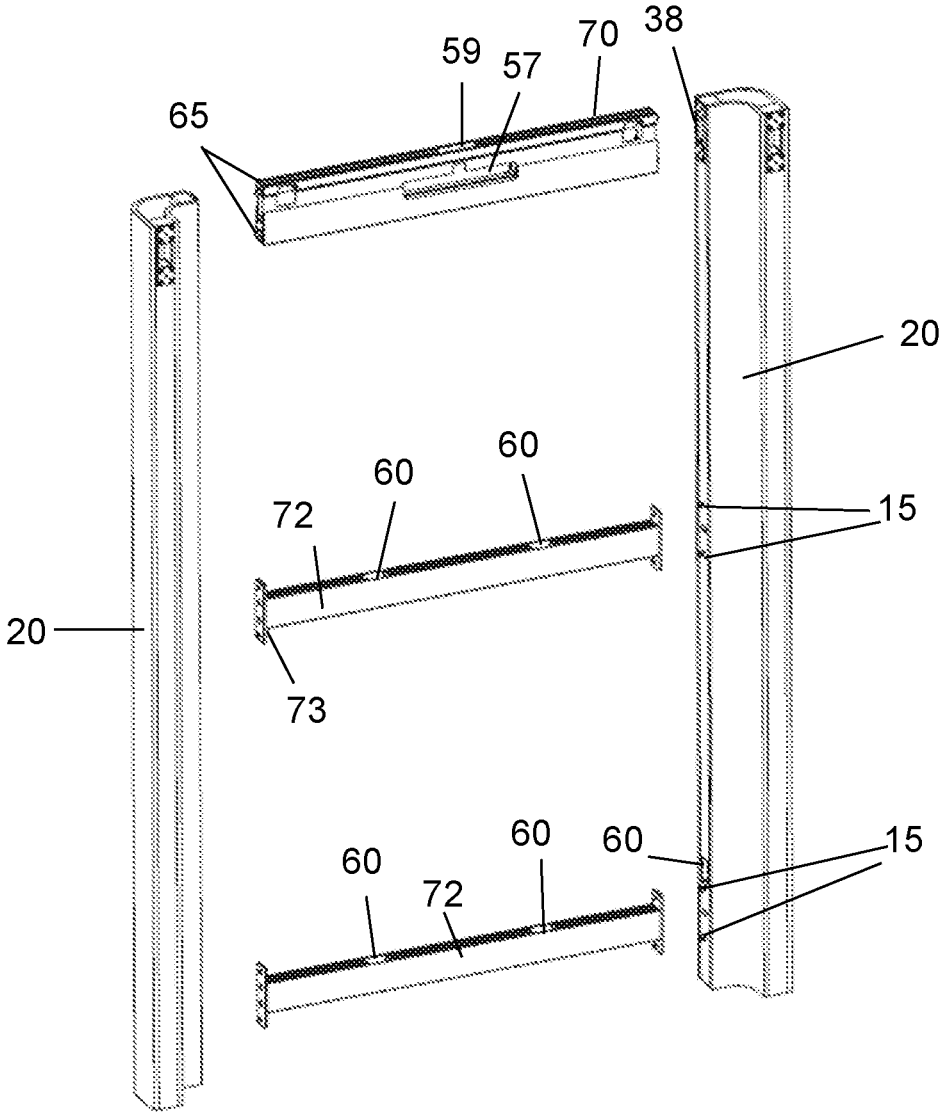

FIG. 51 shows how a top rail and two cross or side rails can be attached to posts and the attachment arrangements on the vertical rails of the posts.

Figure 52:
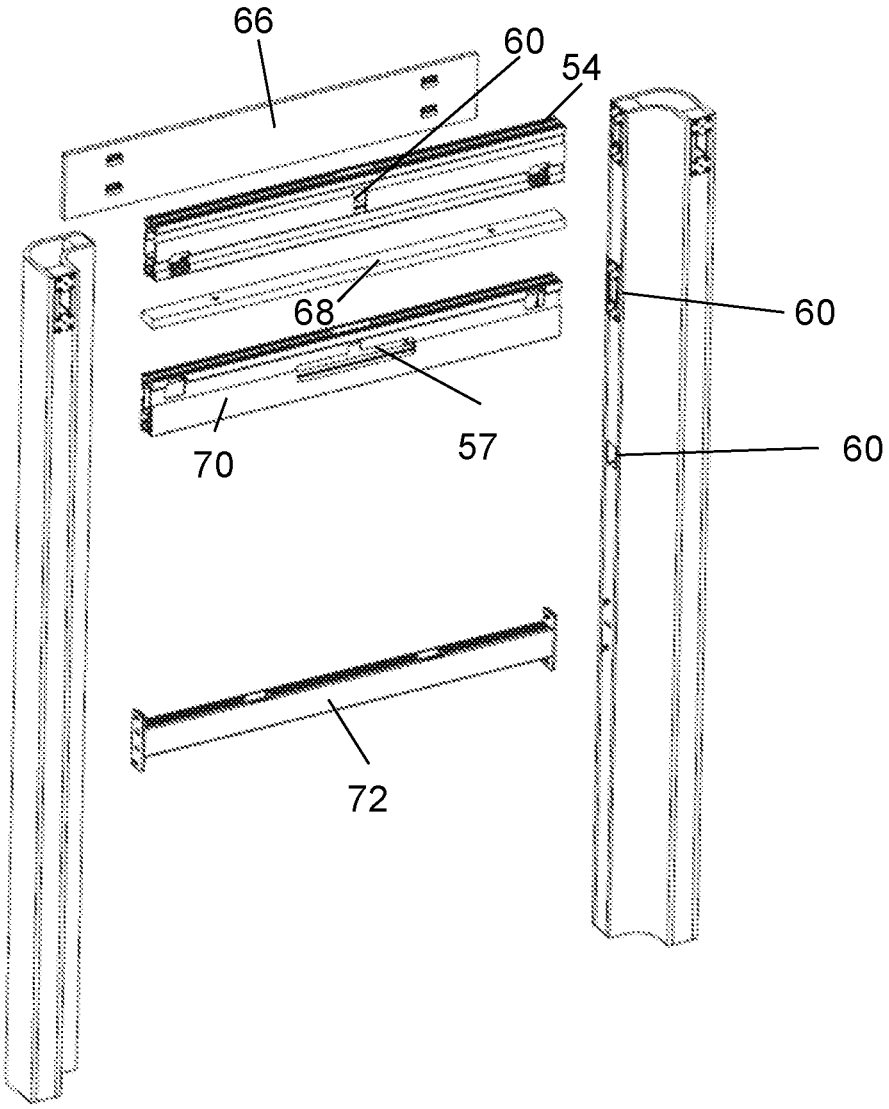

FIG. 52 shows how a beam, top rail, and side or cross rail can be attached to posts.

Figure 53:
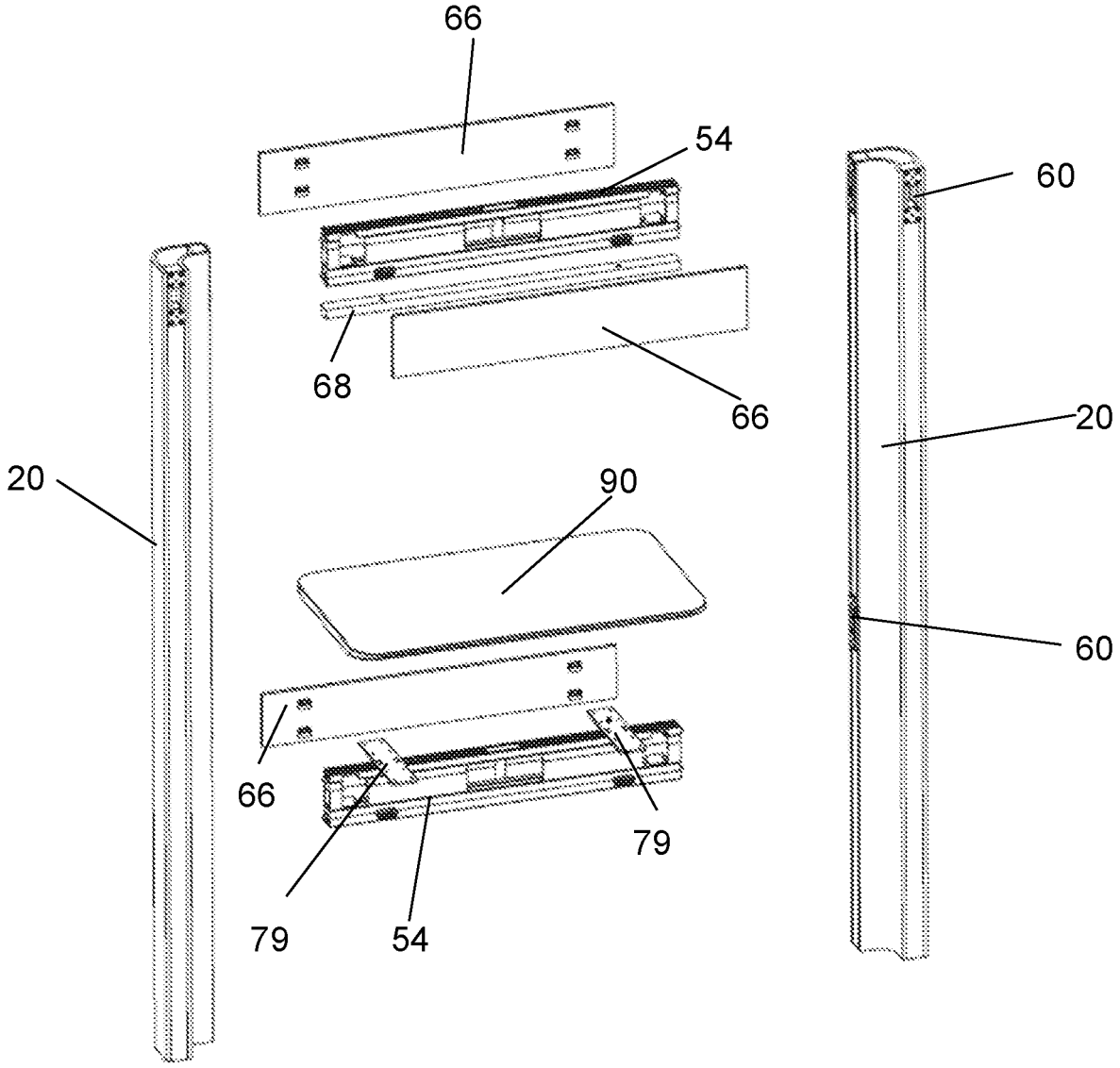

FIG. 53 shows how a pair of beams, the lower rail having a table attached thereto, can be attached to posts.

Figure 54:
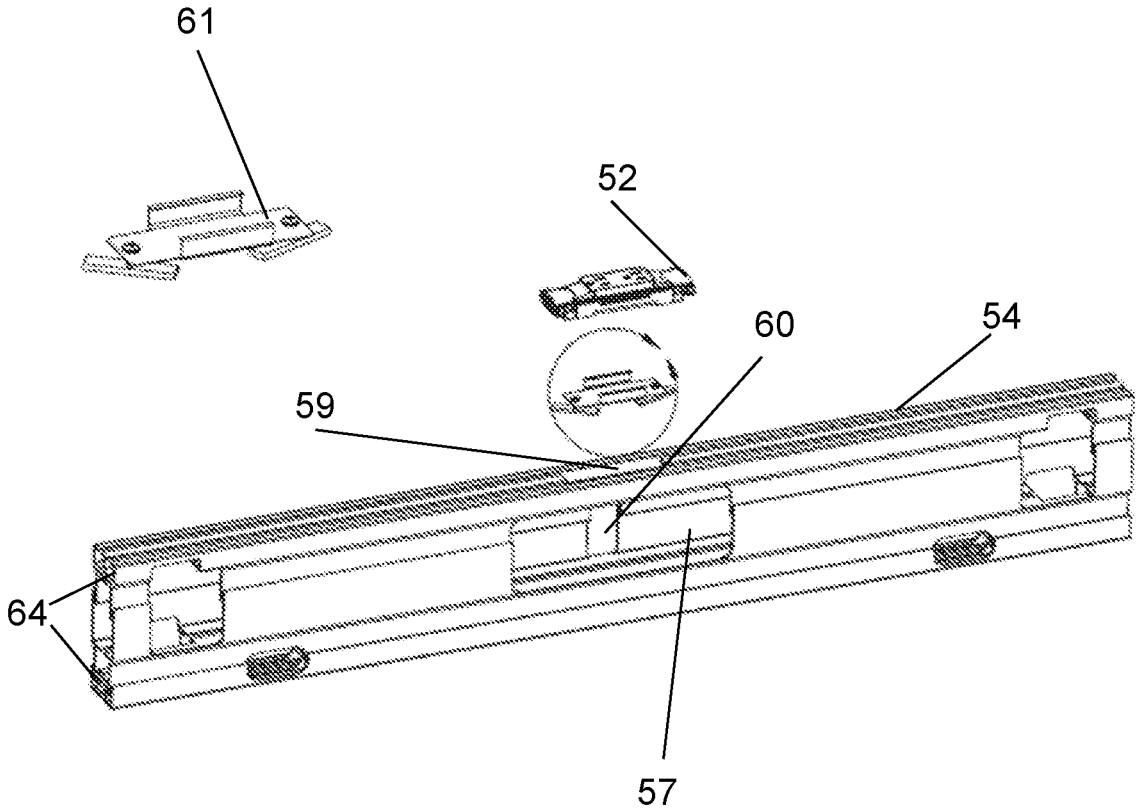

FIG. 54 shows a beam and a receptacle mounting bracket and receptacle for insertion into the mounting cavity in a beam.

DETAILED DESCRIPTION OF THE ILLUSTRATED EMBODIMENTS

For the purposes of promoting an understanding of the principles of the invention disclosed herein, reference will now be made to one or more embodiments, which may or may not be illustrated in the drawings, and specific language will be used to describe the same. It will nevertheless be understood that no limitation of the scope of the disclosure is thereby intended; any alterations and further modifications of the described or illustrated embodiments, and any further applications of the principles of the disclosure as illustrated herein are contemplated as would normally occur to one skilled in the art to which the disclosure relates. At least one embodiment of the disclosure is shown in great detail, although it will be apparent to those skilled in the relevant art that some features or some combinations of features may not be shown for the sake of clarity.

Any reference to "invention" within this document is a reference to an embodiment of a family of inventions, with no single embodiment including features that are necessarily included in all embodiments, unless otherwise stated. Furthermore, although there may be references to benefits or advantages provided by some embodiments, other embodiments may not include those same benefits or advantages, or may include different benefits or advantages. Any benefits or advantages described herein are not to be construed as limiting to any of the claims.

Specific quantities (spatial dimensions, temperatures, pressures, times, force, resistance, current, voltage, concentrations, wavelengths, frequencies, heat transfer coefficients, dimensionless parameters, etc.) may be used explicitly or implicitly herein; such specific quantities are presented as examples only and are approximate values unless otherwise indicated. Discussions pertaining to specific compositions of matter, if present, are presented as examples only and do not limit the applicability of other compositions of matter, especially other compositions of matter with similar properties, unless otherwise indicated.

The numbers used in the drawings relate to the following items detailed below: 10—first of many module combinations; 11—second of many module combinations; 12—third of many module combinations; 13—wire; 15—bolts to mount side rail; 20—corner post; 22—corner post without routed in cap receptacle; 24—T-post; 26—T-post without routed in cap receptacle; 28—4-way post; 29—4-way post without routed in cap receptacle; 30—vertical rail; 31—outward face; 32—side adjacent outward face; 34—beam or top rail mounting plate attachment configuration; 35—pilot holes (8); 36—bolt openings (2); 37—wire management openings; 38—beam or top rail mounting plate; 39—countersunk screw receptacles (8); 40—threaded bolt receptacles (2); 41—wire management opening; 42—cross rail attachment configuration; 43—barrel nuts (2); 45—wire management cutouts; 46—post support; 48—leveling glide; 49—routed in top cap receptacle; 50—power sleeve; 52—duplex receptacle power outlet; 54—extruded beam; 56—hanging rail for cladding; 57—receptacle mounting cavity; 58—mounting T-slot; 59—receptacle access opening; 60—wire management opening; 61—receptacle mounting bracket; 62—T-slot for receptacle mounting; 64—bolt channel; 65—bolt; 66—cladding or side trim; 67—clip; 68—trim strip; 70—extruded top rail; 71—hanging rail for full or split wall panel; 72—extruded cross or side rail; 73—mounting plate; 74—full wall panel; 76—duplex receptacle; 78—short wall panel; 80—first framed wall panel; 81—second framed wall panel; 82—third framed wall panel; 83—fourth framed wall panel; 84—fifth framed wall panel; 85—sixth framed wall panel; 86—seventh framed wall panel; 87—framed wall panel with inserts; 88—acoustic framed wall panel; 89—dining table; 90—bar height table; 91—bench seat; 92—bench seat with tables; 93—perch seat; 94—boomerang table; 95—angled table; 96—rectangular table; 97—serpentine table; 98—bottleneck table; 99—opposing tables; 100—delta table; 101—internal bar height table; 102—external bar height table; 103—central bar height table; 106—first ceiling component; 107—elongated rod; 108—baffle; 109—hole; 110—clip; 112—second ceiling component; 113—baffle; 114—baffle upper straight portion; 115—baffle lower angled portion; 118—lighting batten; 119—lighting element; and 120—clip.

Embodiments of a modular workspace system include a plurality of posts, beams and or rails, and panels. Corner posts 20 or 22 allow for 90° connections, T or 3-way posts 24 or 26 allow for connections at 90° and 180°. The 4-way posts 28 or 29 allow for a four way connection at 90° increments. The posts are preferably made of wood in order to permit each vertical rail 30 of the posts to be specifically configured to receive and have attached thereto desired beams, top rails, and/or cross of side rails between a vertical rail of one post and a facing vertical rail of another post. By configuring the vertical rails 30 of each post used, it is key that multiple, multiple, multiple modular workspace system options are possible using the items described herein.

Three sample options are shown in FIGS. 40, 41, and 42. FIG. 40 shows two 3×3 modules joined by a 4-way post 28. Six posts 20 are also used in this configuration. As will be explained in more detail in reference to other figures, a full wall panel 74, a short wall panel 78, a first framed wall panel 80, a fifth framed wall panel 84, and first ceiling component 106 are utilized. When this option was designed, the facing vertical rails 30 on each of the posts 20 and 28 were then configured to receive the required beams and rails.

FIG. 41 shows three 1×1 modules with two 1×3 modules. As is seen, five corner posts 20, three T-posts 24, and two 4-way posts 28 are employed in this option. Also, second framed wall panels 81, bench seat 91, and boomerang table 94, angled table 95, and rectangular table 96 are used. When this option was designed, the facing vertical rails 30 on each of the posts 20, 24, and 28 were then configured to receive the required beams and rails.

FIG. 42 shows three 3×3 modules in a linear relationship. This configuration employs four corner posts 20 and four T-posts 26. The build out also includes beams 54, full wall panels 74, short wall panel 78, first framed wall panel 80, fifth framed wall panel 84, framed wall panel with inserts 87, and an internal bar height table 101. As with the other options, there are openings for traffic flow. When this option was designed, the facing vertical rails 30 on each of the posts 20 and 26 were then configured to receive the required beams and rails.

A corner post 20 or 22 (FIGS. 1 and 45) has two vertical rails 30, a T-post 24 or 26 (FIGS. 2 and 44) has three vertical rails 30, and a 4-way post 28 or 29 (FIGS. 3 and 43) has four vertical rails 30. Each of these vertical rails 30 has an outward face 31 and two sides 32 adjacent to their outward face 31. Post supports 46 are glued to one side 32 of a vertical rail 30 and also to one side 32 of a different vertical rail 30 for each post. In the preferred construction, these post supports 46 are made from layers of veneer with layers of glue between each layer. The corner post 20 or 22 will have two arcuate supports 46; the T-post 24 or 26 will have two arcuate supports 46 and one straight support 46; and the 4-way post 28 or 29 will have four arcuate supports 46. In general, the post supports 46 will have 9-11 layers of veneer, the interior layers of popular or similar wood and the outside layer of premium grade ash, oak, walnut, or similar wood. To make the post supports of desired shape, the layers of veneer with glue therebetween are placed in a mold and formed to the desired shape. Assembly fixtures are then used to glue the sides 32 of each vertical rail 30 to the inside of the corresponding post support 46 to form the desired corner, T, or 4-way post. As is seen, the posts have a hollow core which permits wire management through the posts. Once the posts are manufactured, the face 31 of each vertical rail 30 is routed or drilled at the proper location or locations to provide for attachment of one or more of a beam 54, a top rail 70, a cross or side rail 72, or a wire management opening 60, as needed to configure the desired modular workspace system, such as for those examples shown in FIGS. 40-42.

FIGS. 1A-1G depict first post 20 having a generally L-shaped top and bottom, an elongated curved outer wall extending between the top and bottom and an elongated curved inner wall extending between the top and the bottom. These curved outer and inner walls are post supports 46. Corner post 20 also has two elongated ends oriented 90 degrees from each other, each end extending horizontally between the curved outer wall and the curved inner wall and extending vertically between the top and the bottom. These ends are a pair of vertical rails 30 having outward face 31 and a pair of sides 32 adjacent to the outward face 31. At the top of post 20 into vertical rail 30, there is a routed in recess 49, preferably about 1/16 inch deep, which could receive a cap or cover so that the interior of the post would not be seen from above. If a cap or cover is not desired, the recess 49 can be omitted, as seen in post 22 of FIG. 45, which is otherwise the same as post 20.

Figure 1A:
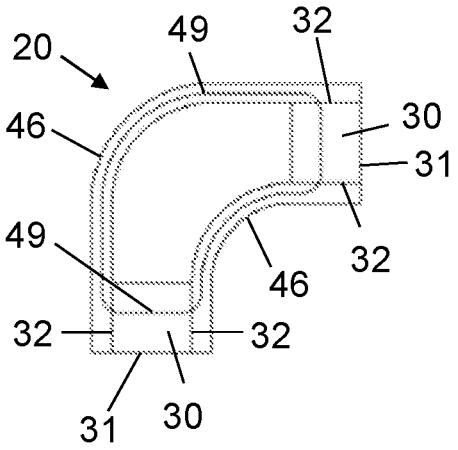
FIG. 1A is a top plan view of a first or corner post.
Figure 1B:
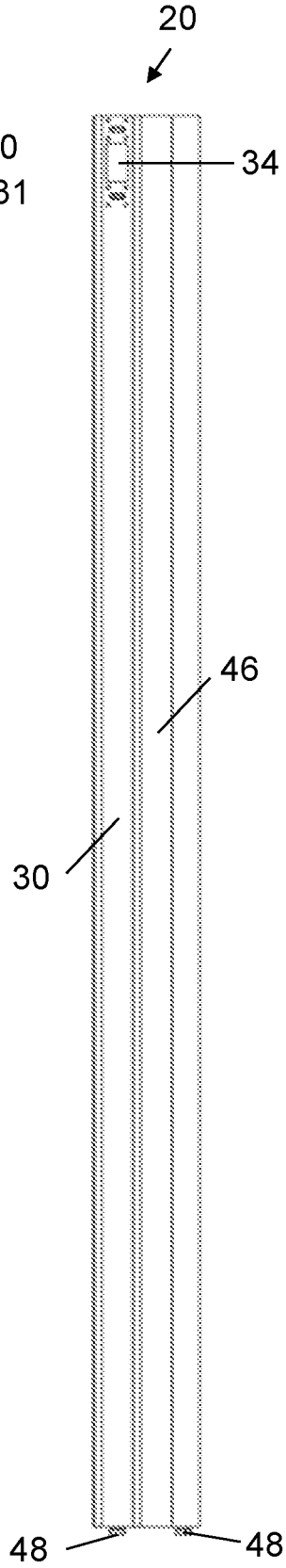
FIG. 1B is a first side elevation view of the first post.
Figure 1C:
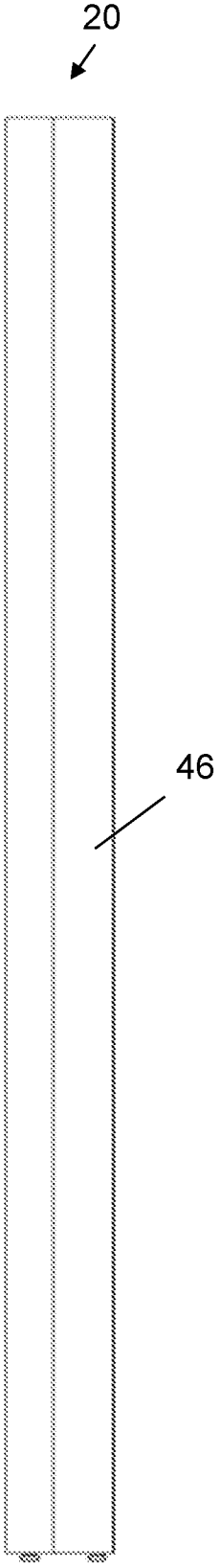
FIG. 1C is a second side elevation view of the first post.
Figure 1D:
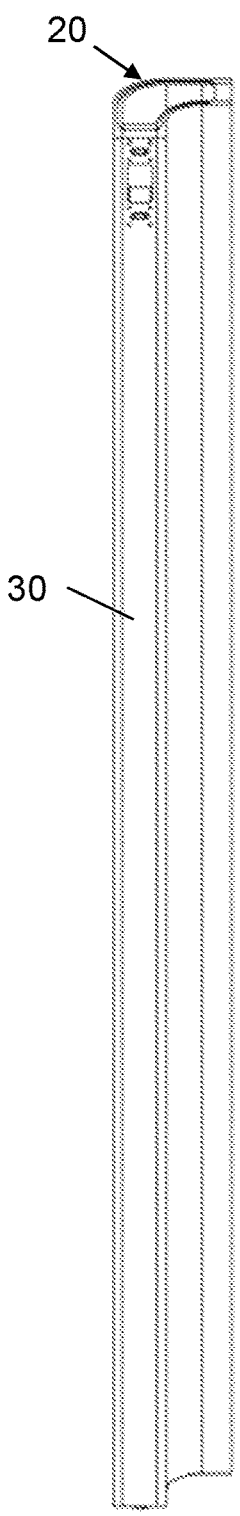
FIG. 1D is a first side perspective view of the first post.
Figure 1E:
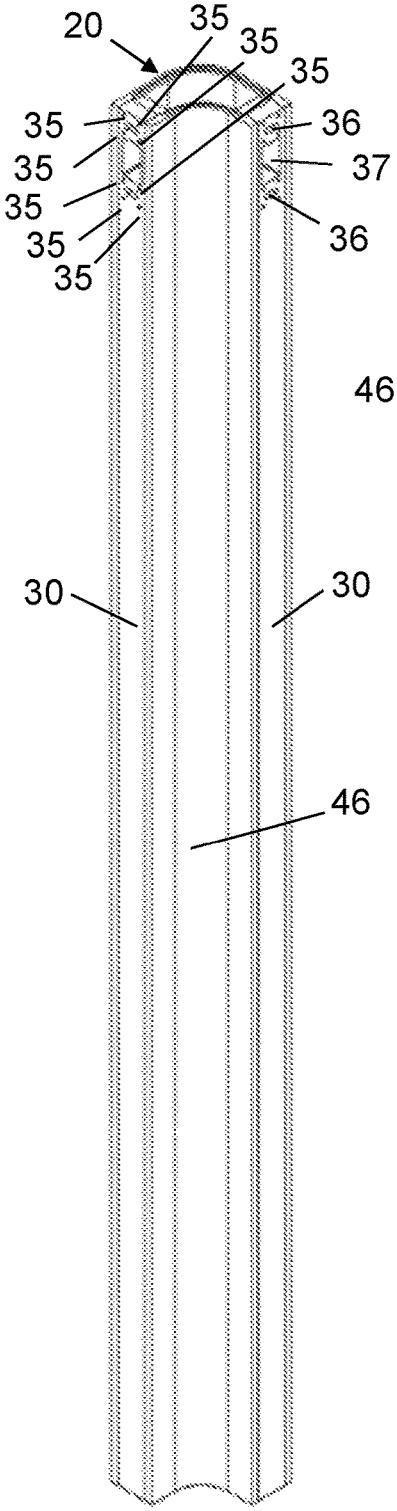
FIG. 1E is a second side perspective view of the first post.
Figure 1F:
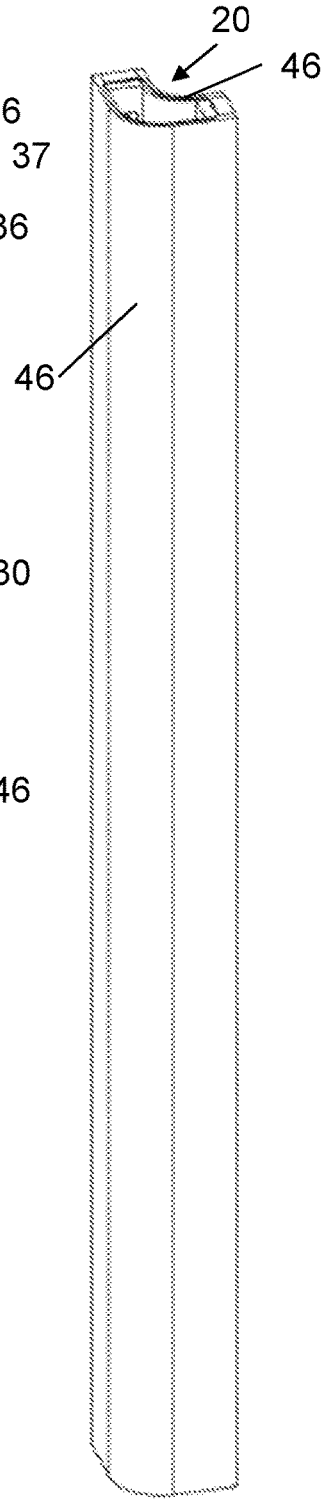
FIG. 1F is a third side perspective view of the first post.
Figure 1G:
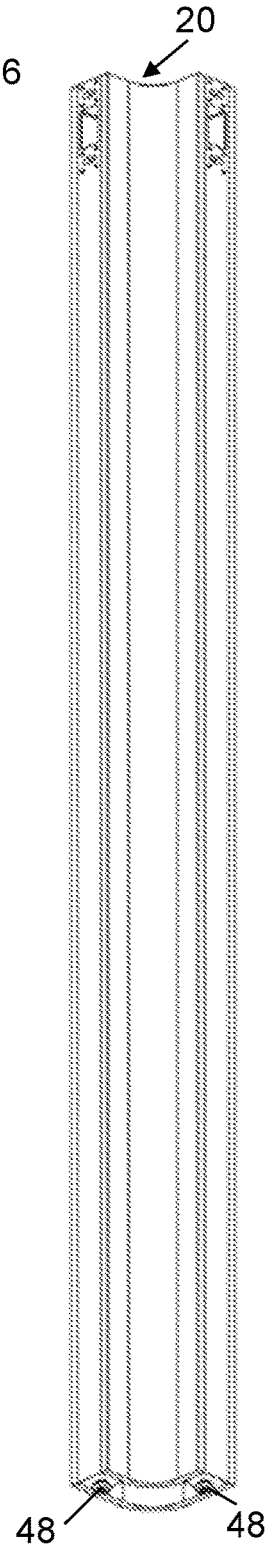
FIG. 1G is the side perspective view of the post of FIG. 1E, but from below horizontal.
Figure 2A:
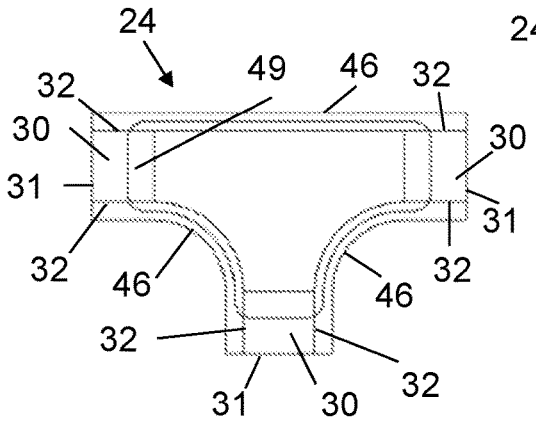
FIG. 2A is a top plan view of a second or T-post.
Figure 2B:
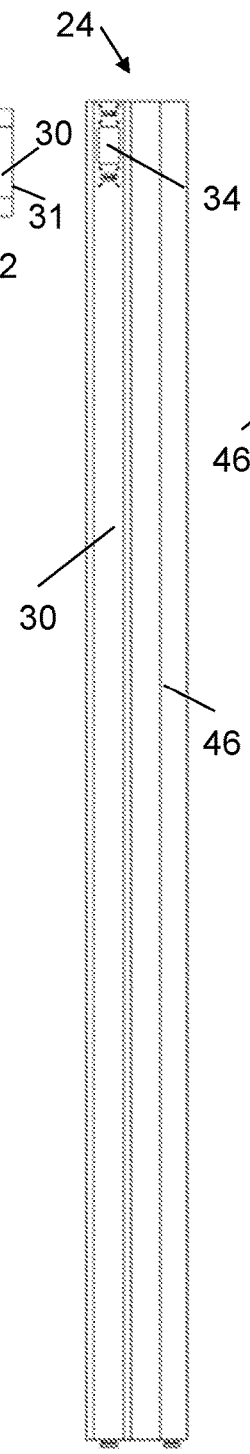
FIG. 2B is a first side elevation view of the second post.
Figure 2C:
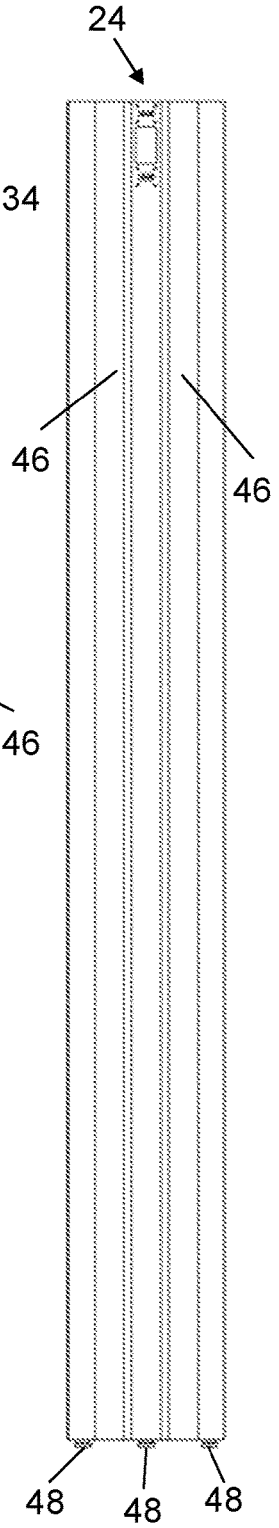
FIG. 2C is a second side elevation view of the second post.
Figure 2D:
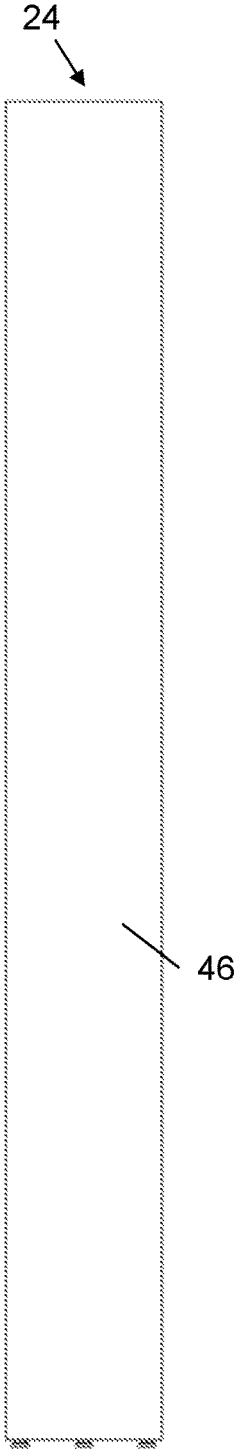
FIG. 2D is a third side elevation view of the second post.
Figures 2E, 2F, 2G, 2H:
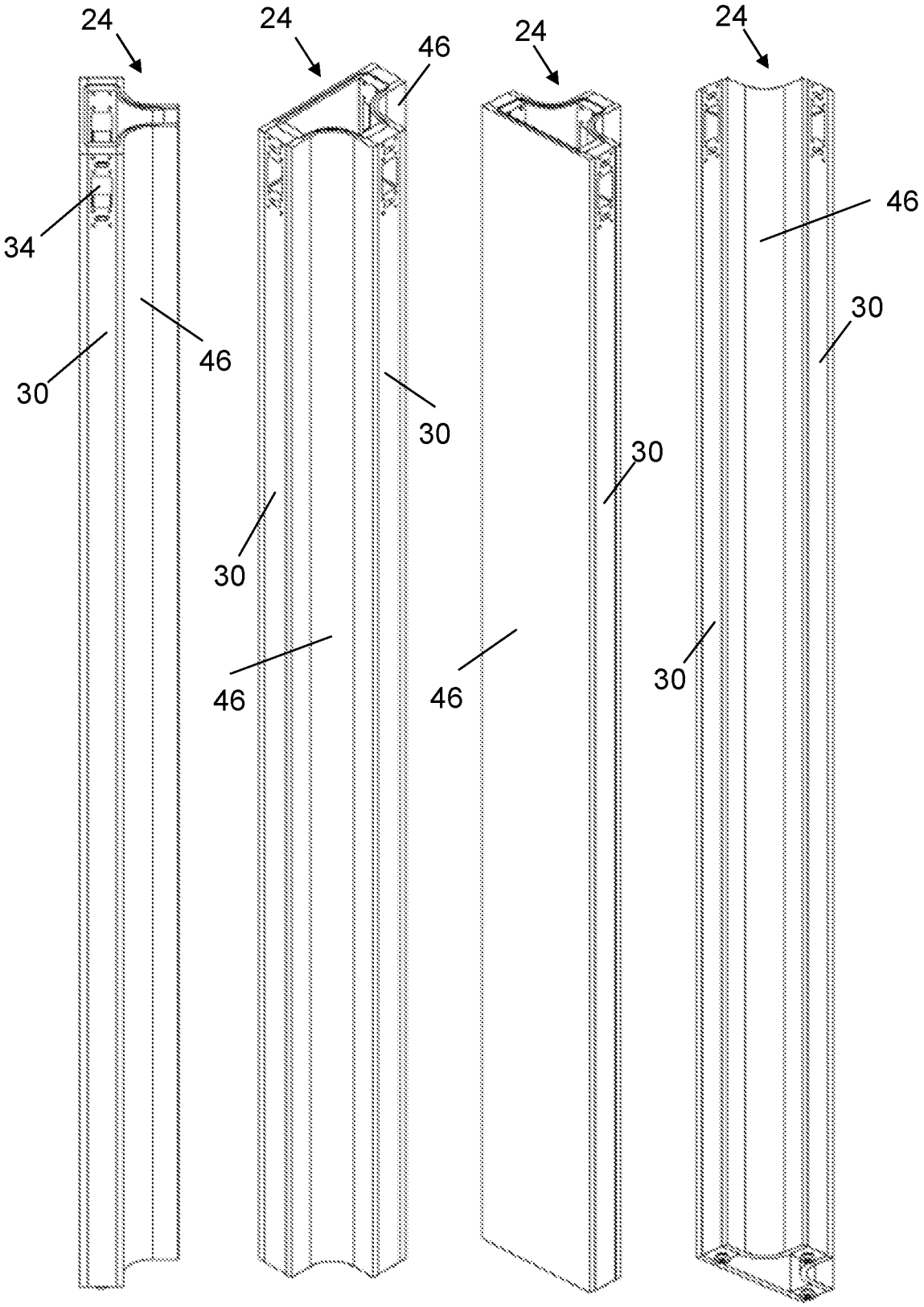
FIG. 2E is a first side perspective view of the second post.
FIG. 2F is a second side perspective view of the second post.
FIG. 2G is a third side perspective view of the second post.
FIG. 2H is a fourth side perspective view of the second post, but from below horizontal.
Figure 3A:
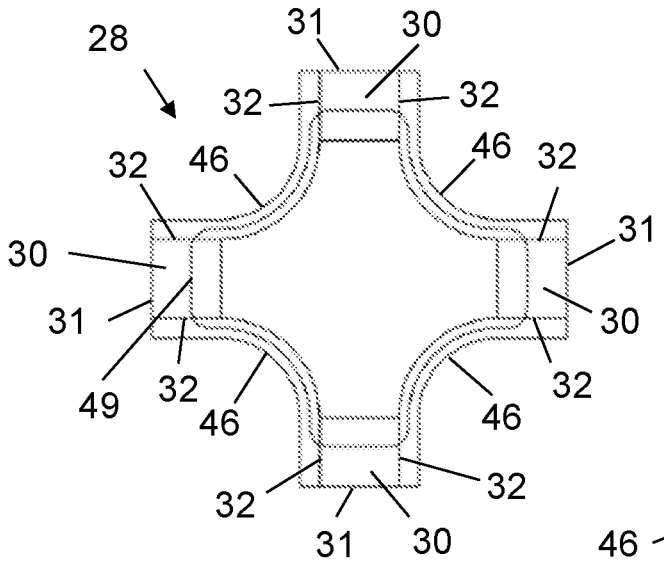
FIG. 3A is a top plan view of a third or 4-way post.
Figure 3B:
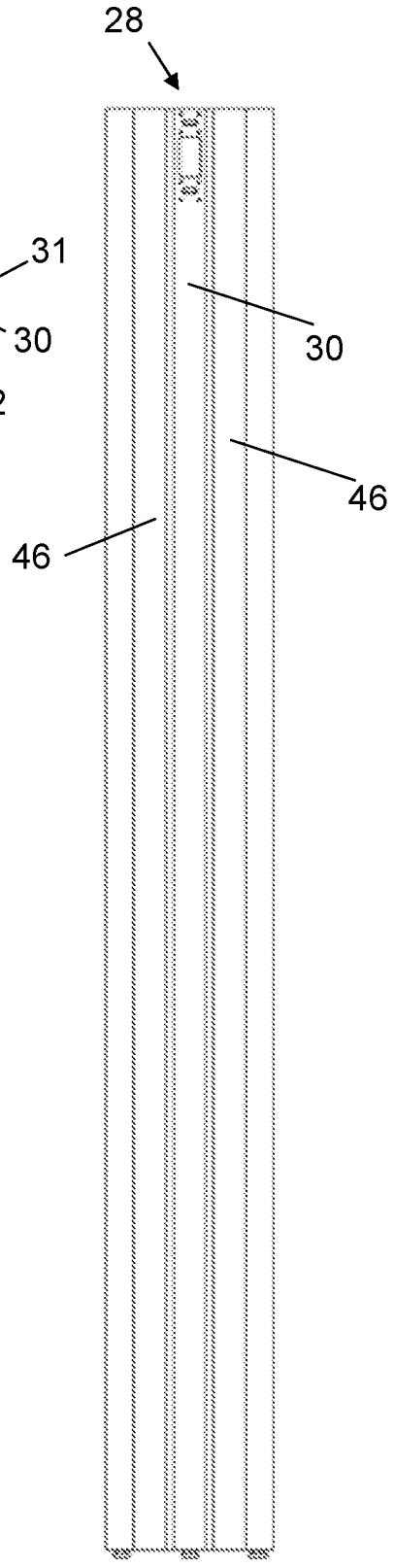
FIG. 3B is a side elevation view of the third post.
Figure 3C:
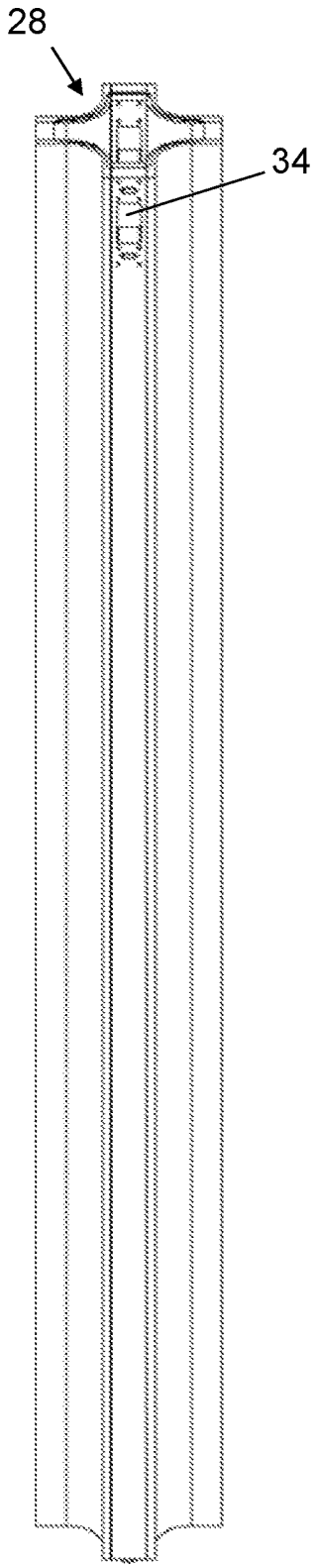
FIG. 3C is a first side perspective view of the third post.
Figure 3D:
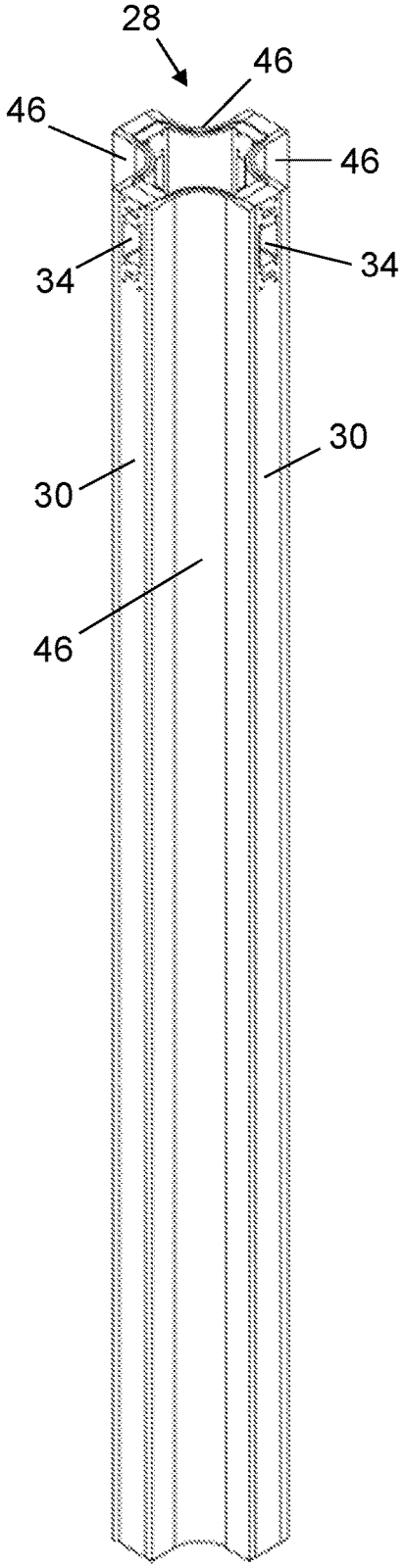
FIG. 3D is a second side perspective view of the third post.
Figure 3E:
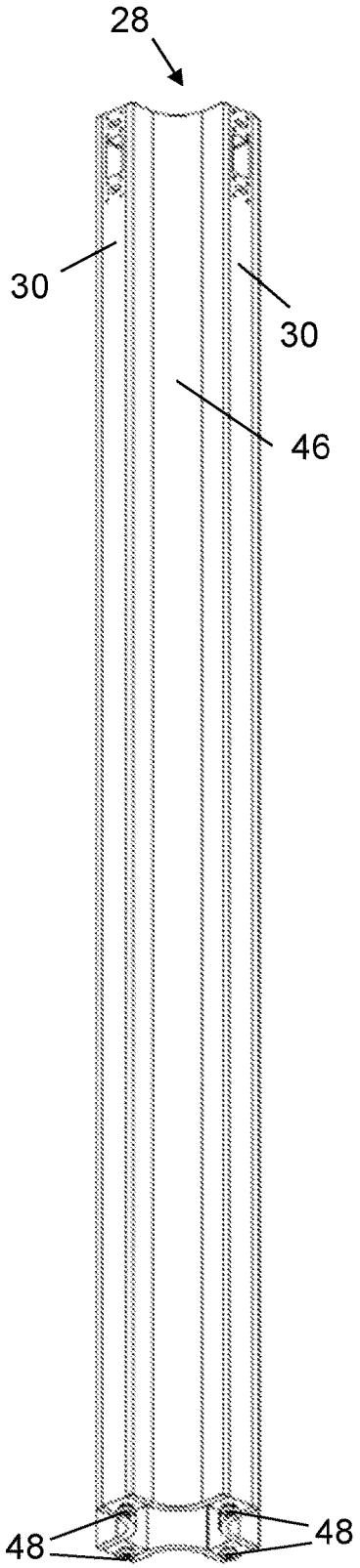
FIG. 3E is a third side perspective view of the third post, but from below horizontal.

FIGS. 1B, 1D, 1E, 1G, and 49 show the beam or top rail mounting plate attachment configuration 34. A mounting plate 38, seen for example in FIG. 7E, will be attached to this configuration 34. As seen in FIGS. 1E and 49, attachment configuration 34 includes eight pilot holes 35 drilled into outward face 31 of vertical post 30, where screws will be used to attach the plate 38 thereto. Also two bolt openings 40 are drilled or routed into vertical post 30, each bolt opening 40 preferably centered between four of the pilot holes 35. There is also a wire management opening 37 routed into vertical post 30 and extending into the hollow interior of post 20. Also, leveling glides 48 are shown, which permit leveling of the modular workspace system when installation is completed.

FIGS. 2A-2H depict a second post having a generally T-shaped top and bottom, an elongated straight outer wall extending between the top and bottom, two elongated inner walls extending between the top and bottom, and three elongated ends extending between the top and the bottom. Two ends are oriented 180 degrees from each other and are bordered by the outer wall and a different inner wall. The third end is oriented 90 degrees from each of the other two ends and is bordered by the two inner walls. As with post 20, the T-post 24 of FIG. 2 includes a routed top cap recess 49, while the T-post 26 of FIG. 44 does not include a recess 49. Otherwise, T-posts 24 and 26 are identical. T-post 24 includes three vertical rails 30, each with an outward face 31 and two sides 32 being adjacent thereto. The straight and curved outer walls are post supports 46. The T-posts 24 are manufactured with the same materials and in the same manner as was discussed above with corner post 20. Also, the inclusion of attachment configuration 34 and leveling glides 48 is the same as was discussed with corner post 20.

FIGS. 3A-3E depict a third post having a generally plus-shaped top and bottom, four elongated curved inner walls extending between the top and the bottom, and four elongated ends extending between the top and bottom, each end bordered on each side by a curved inner wall. Each end is oriented 90 degrees from the two adjacent ends with which it shares a curved inner wall, and is oriented 180 degrees from the opposite end with which it does not share a curved inner wall. This 4-way post 28 of FIG. 3 and the 4-way post of FIG. 43 differ only in that post 28 includes a routed top cap recess 49 and post 29 does not. The 4-way post 28 includes four vertical rails 30, each with an outward face 31 and two sides 32 being adjacent thereto. The four curved outer walls are post supports 46. The 4-way posts 28 are manufactured with the same materials and in the same manner as was discussed above with corner post 20 and T-post 24. Also, the inclusion of attachment configuration 34 and leveling glides 48 is the same as was discussed with corner post 20.

As was mentioned, the two vertical rails of corner post 20, the three vertical rails 30 of the T-post 24, and the four vertical rails 30 of the 4-way post 28 each include an attachment configuration 34 at or in proximity to the top end, which along with a mounting plate 38 is for mechanically interlocking the post 20/24/28 with other components of the modular workspace system. The posts 20/24/28 respectively include two, three or four adjustable feet, or leveling glides 48 for leveling the posts and spacing the posts above the floor. The posts 20/24/28 each have hollow interiors such that cabling or wire 13, including power lines, phone lines, and data lines, may route through the interiors of the posts. In some embodiments, the cabling is routed from an exterior power, phone connectivity or data connectivity source, through the gap between the post and the floor created by the adjustable feet, and into the hollow interior of the post. The posts 20/24/28 are preferably constructed using similar dimensions, such that the vertical rails 30 and post supports 46 are interchangeable between all three posts types.

Figure 4A:
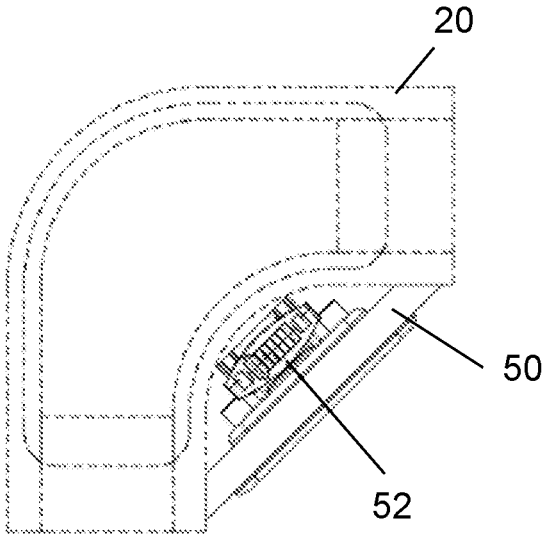
FIG. 4A is top plan view of a power panel mounted on a first post.
Figure 4B:
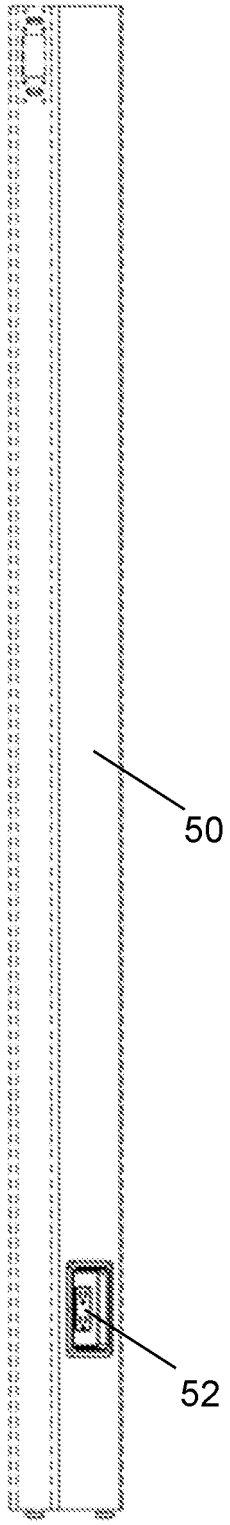
FIG. 4B is a first angled side elevation view of the power panel mounted on the first post.
Figure 4C:
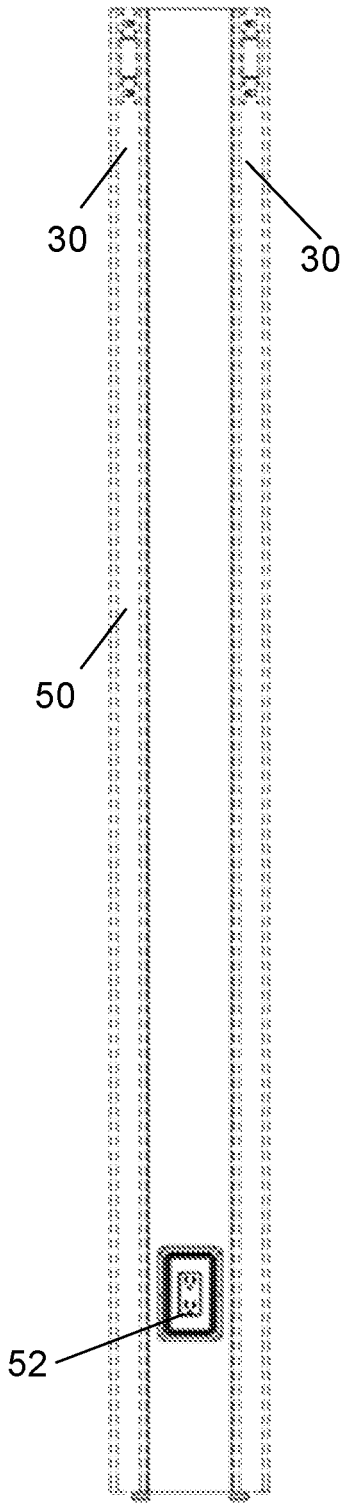
FIG. 4C is a front elevation view of the power panel mounted on the first post.
Figure 4D:
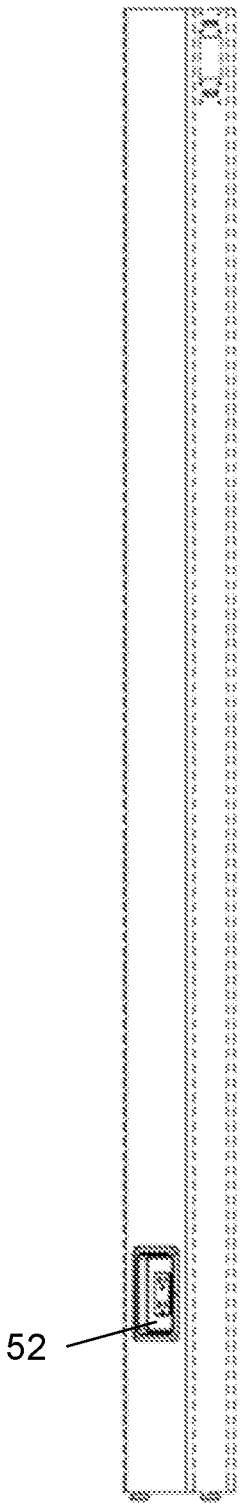
FIG. 4D is a second angled side elevation view of the power panel mounted on the first post.
Figure 4E:
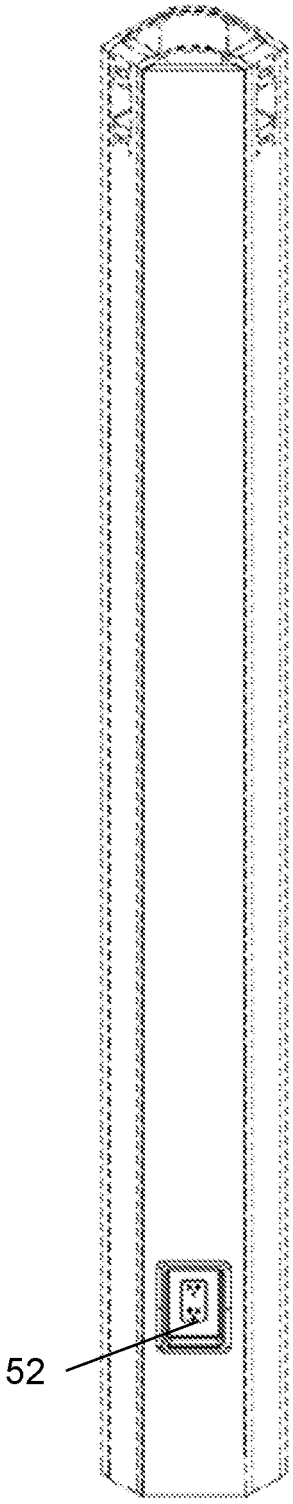
FIG. 4E is a front perspective view of the power panel mounted on the first post.
Figure 5A:
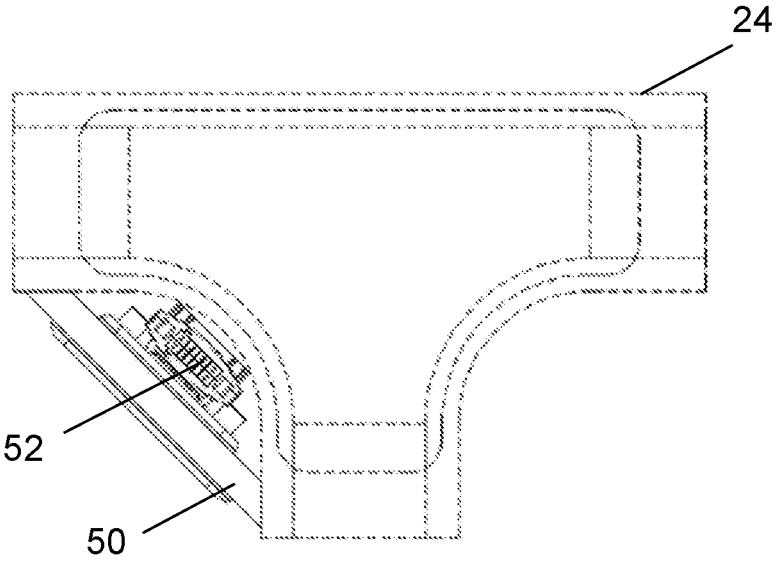
FIG. 5A is top plan view of a power panel mounted on a second post.
Figure 5B:
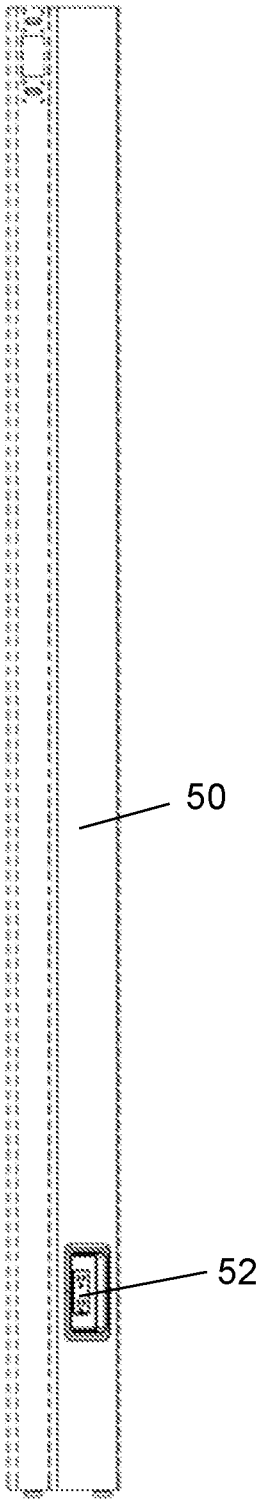
FIG. 5B is a first angled side elevation view of the power panel mounted on the second post.
Figure 5C:
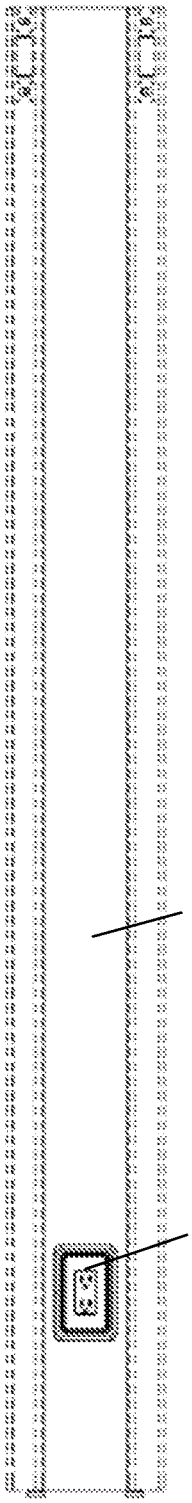
FIG. 5C is a front elevation view of the power panel mounted on the second post.
Figure 5D:
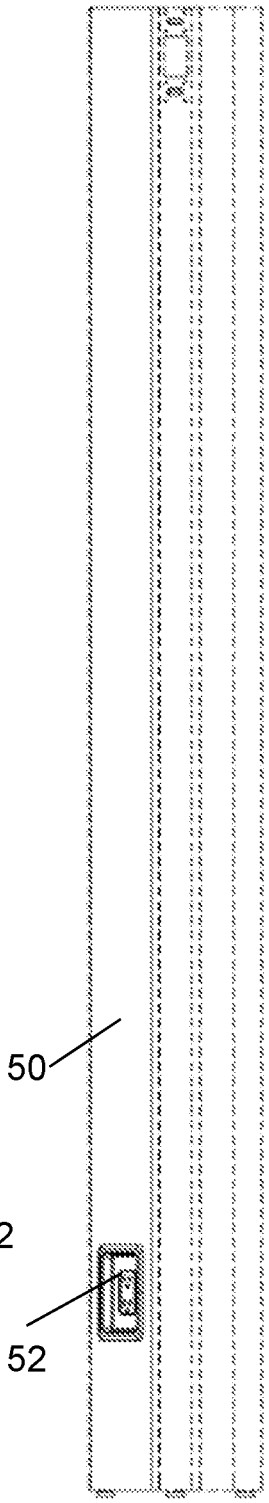
FIG. 5D is a second angled side elevation view of the power panel mounted on the second post.
Figure 5E:
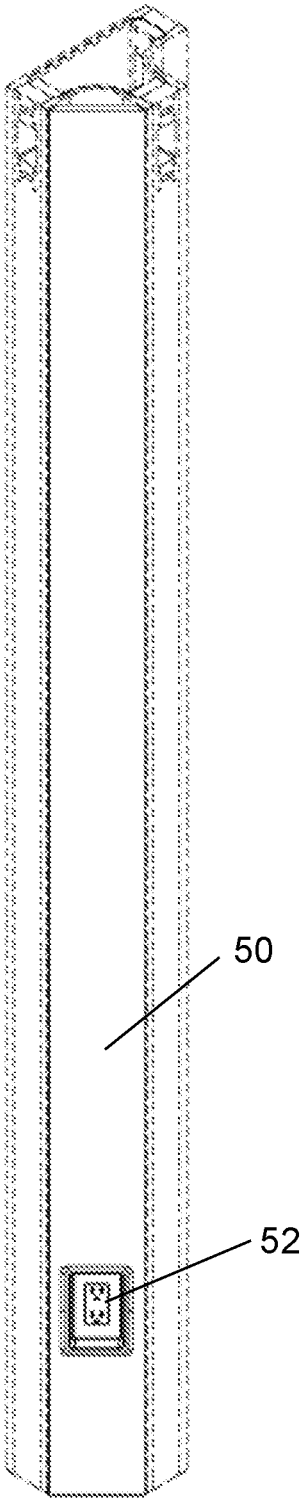
FIG. 5E is a front perspective view of the power panel mounted on the second post.
Figure 6A:
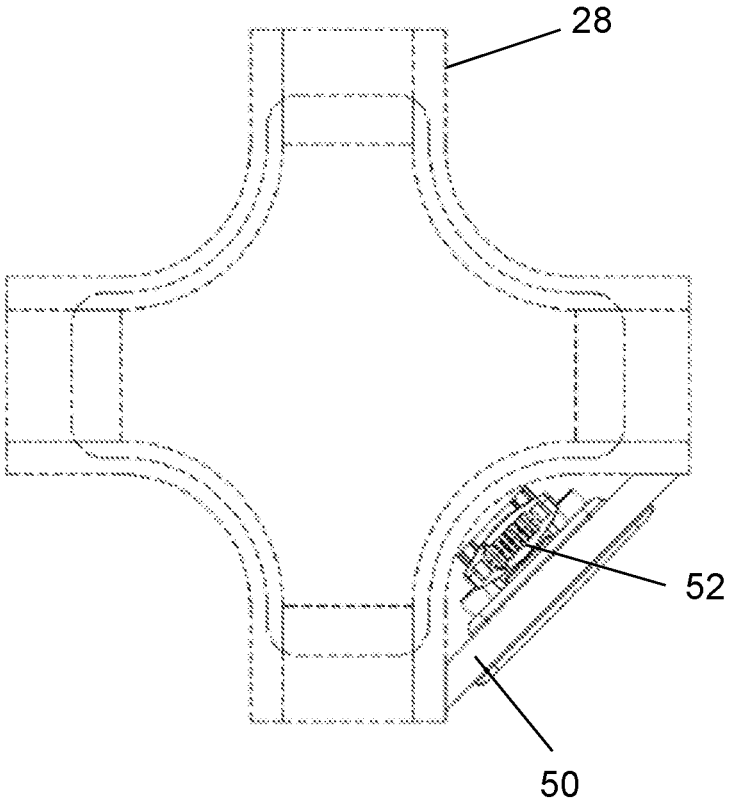
FIG. 6A is top plan view of a power panel mounted on a third post.
Figure 6B:
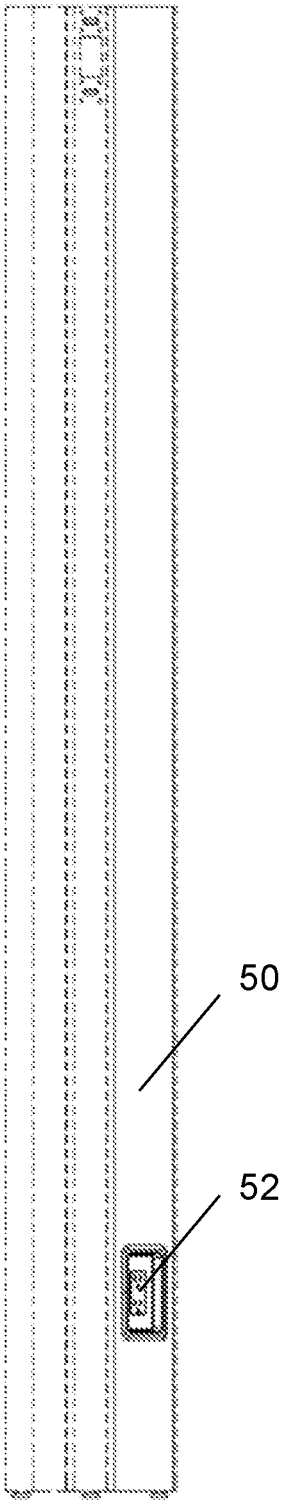
FIG. 6B is a first angled side elevation view of the power panel mounted on the third post.
Figure 6C:
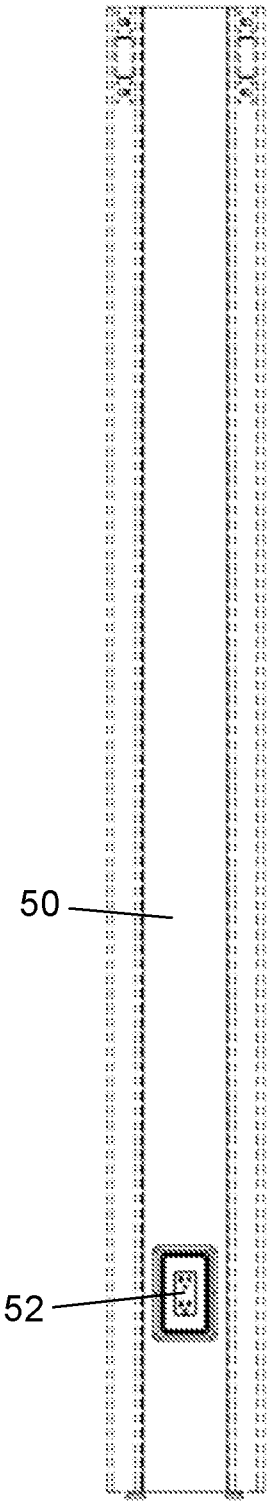
FIG. 6C is a front elevation view of the power panel mounted on the third post.
Figure 6D:
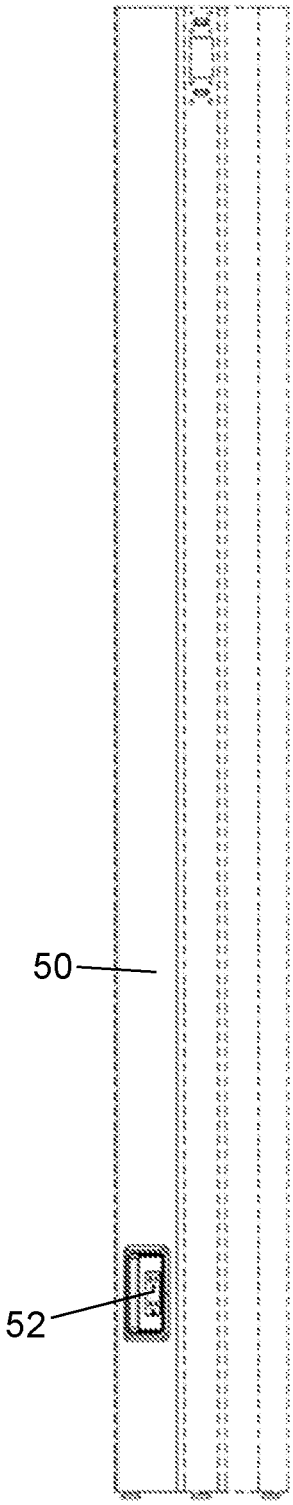
FIG. 6D is a second angled side elevation view of the power panel mounted on the third post.
Figure 6E:
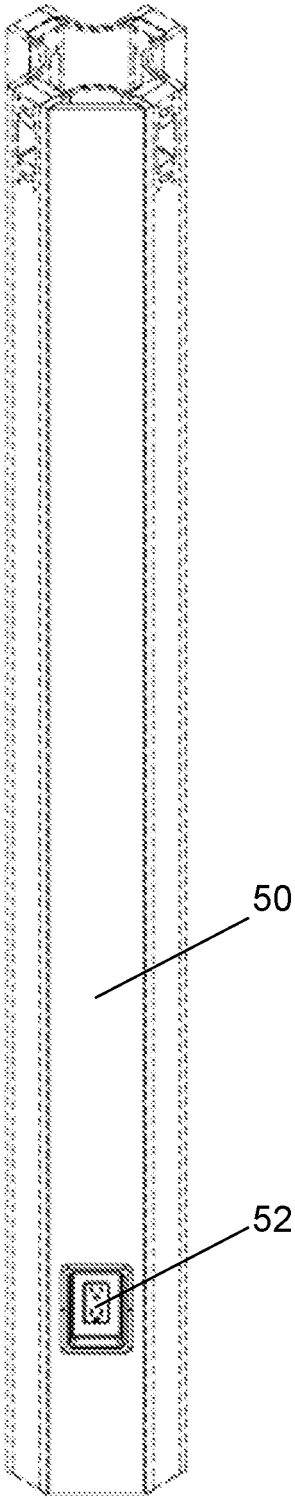
FIG. 6E is a front perspective view of the power panel mounted on the third post.

FIGS. 4A-4E, 5A-5E, and 6A-6E each depict a power sleeve 50 mounted respectively on a first post 20, second post 24, or third post 28. A power sleeve 50 is an elongated trapezoidal shaped panel with a front face, a rear face, and a pair of angled sides. As most easily seen in FIGS. 4A, 5A, and 6A, the dimensions of the faces and the angles of the sides are selected such that the power panel fits snugly within the curved inner wall of any of the first post 20, second post 24, or third post 28. The power panel includes a recessed power outlet or duplex receptacle 52 which is preferably in electrical communication with a power line extending through the interior of the corresponding post. In some embodiments, the power line is routed from an exterior power source, through the gap between the bottom of the power panel and the floor, and into the space between the power panel and the inner walls. In some embodiments, the posts 20/24/28 include cutouts, such that power lines extending through the hollow interiors of the posts 20/24/28 can be routed to the power outlets.

Figure 7A:
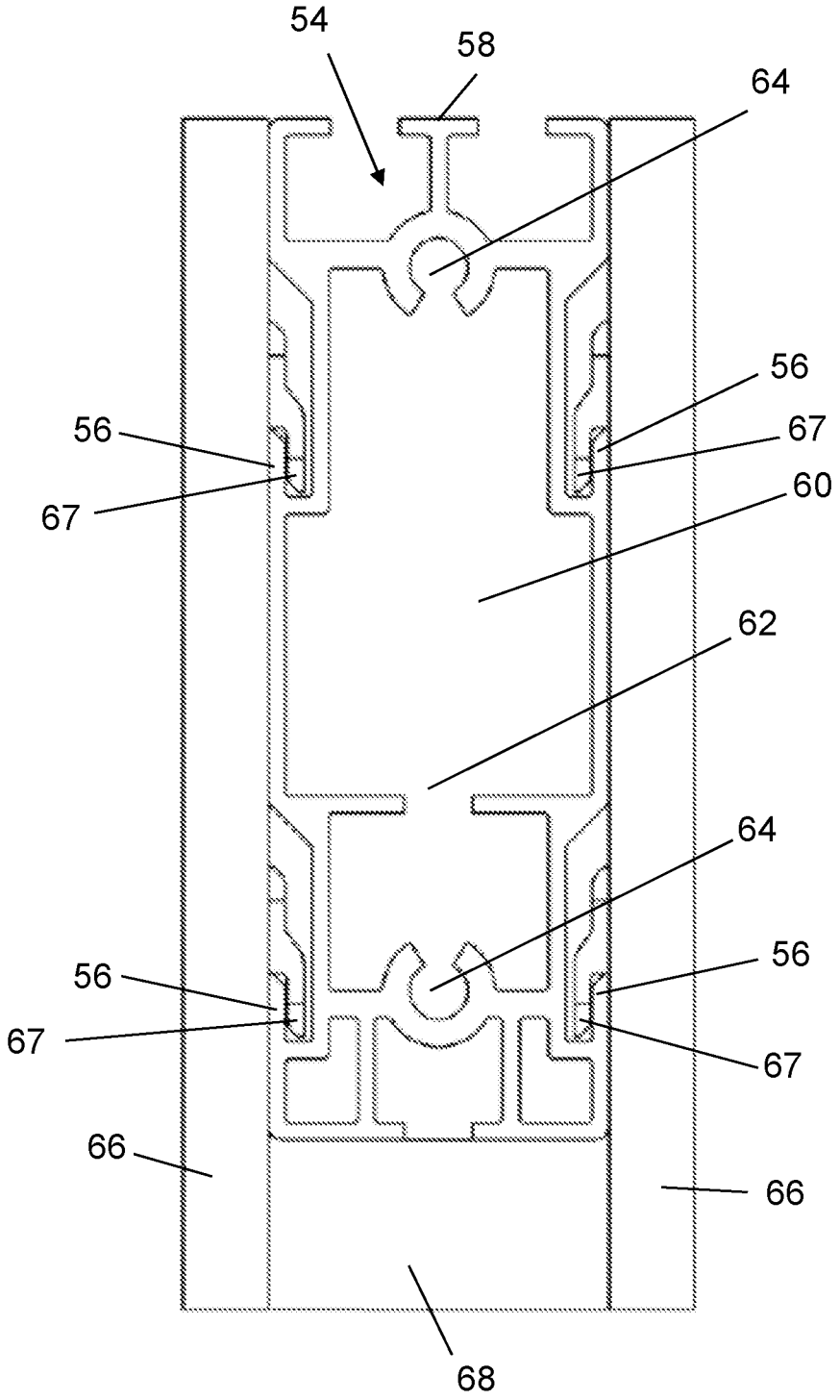
FIG. 7A is an end elevation view of a beam.
Figure 7B:
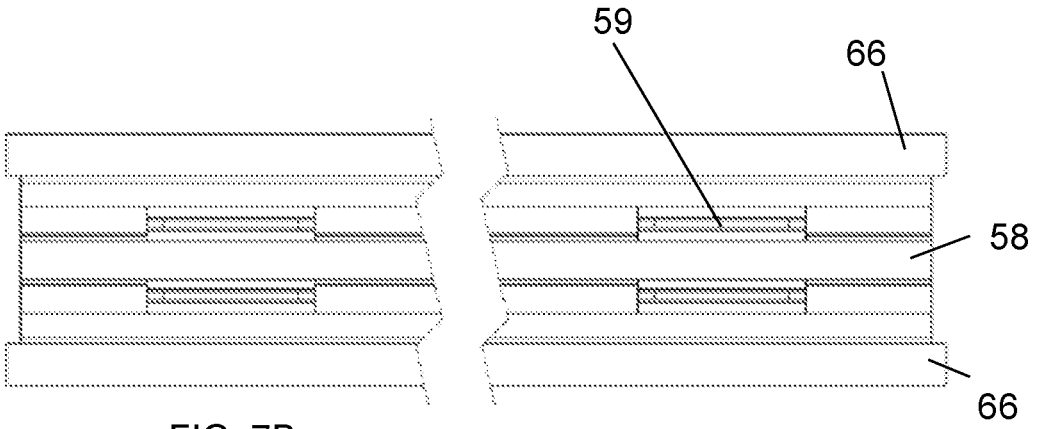
FIG. 7B is a top plan view of the beam.
Figure 7C:
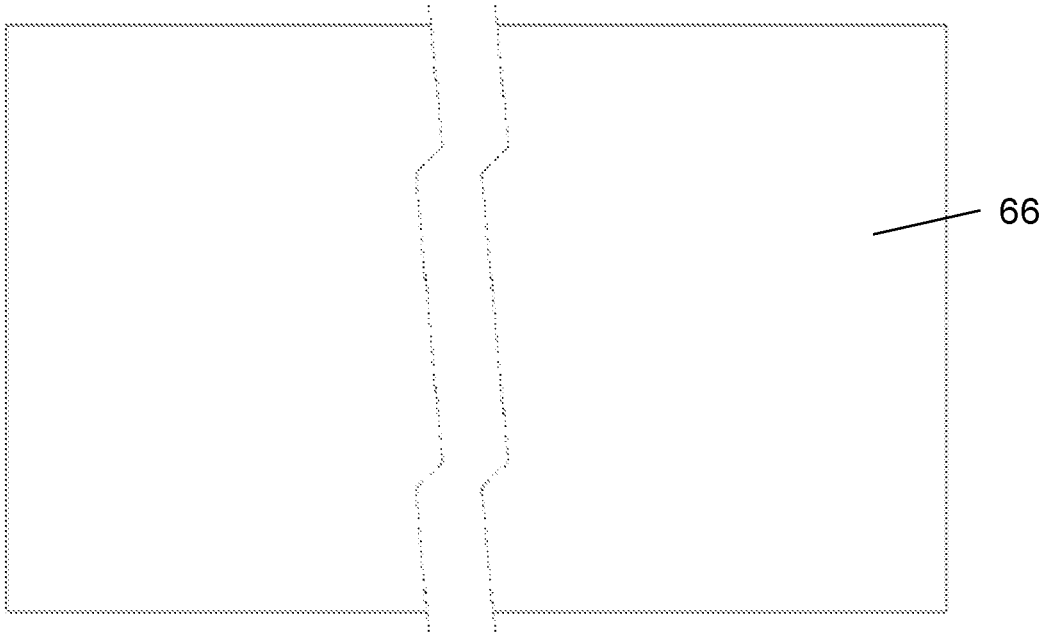
FIG. 7C is a side elevation view of the beam.
Figure 7D:
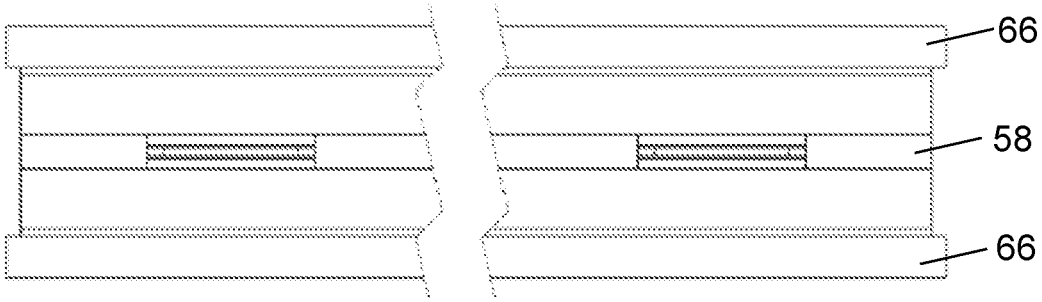
FIG. 7D is a bottom plan view of the beam with the bottom trim omitted for clarity.

FIGS. 7A-7F depict an elongated extruded beam 54 including an elongated frame, an optional bottom trim strip 68 attached to the bottom of the beam 54, and optional side trims or cladding 66 attached to opposite sides of the beam 54. Each side of the beam 54 includes a pair of hanging rails 56 for receiving corresponding clips 67 on the side trims 66, such that the side trims 66 are removably carried on the beam 54. The beam 54 includes a hollow interior such that cabling or wire 13, such as power lines, phone lines, and data lines, may route through the interior of the beam 54. Beam 54 further includes mounting T slots 58 top and bottom, wire management opening 60, T-slot 62 for receptacle mounting, a pair of bolt channels 64, a pair of bolts 65 (FIG. 50), and, as seen in FIG. 54, receptacle mounting cavity 57, receptacle access 59, and receptacle mounting bracket 61. As indicated by FIGS. 7B-7D, the length of the beam may vary.

Figure 7F:
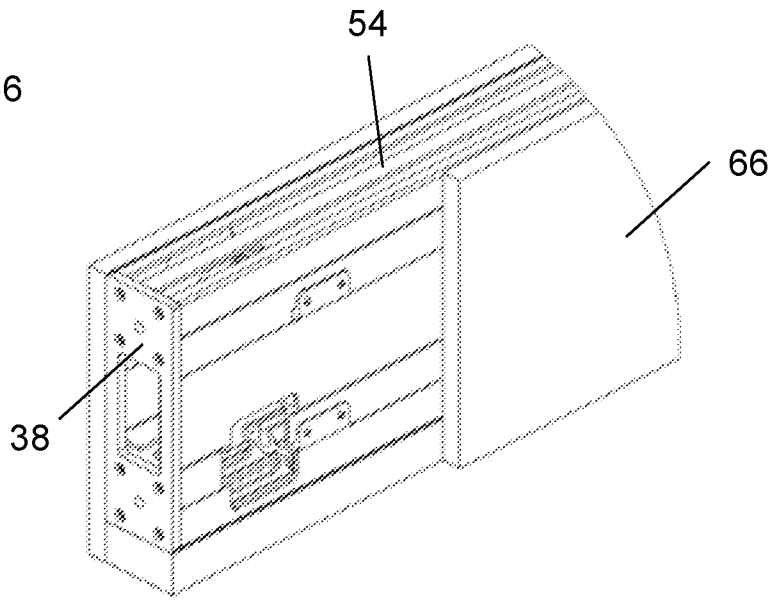
FIG. 7F is a side perspective view of the beam with a portion of the side trim omitted, the view, the view further showing the relationship of the mounting plate which will be first attached to the post and then to the beam.
Figure 7E:
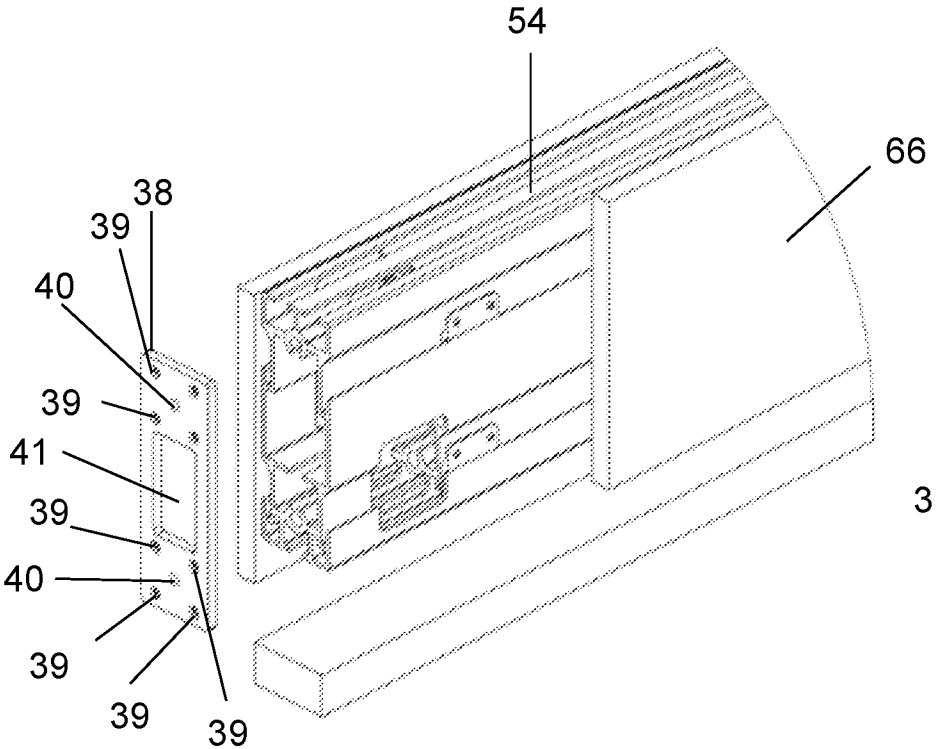
FIG. 7E is a side perspective view of the beam with a portion of the side trim omitted, the view showing the relationship of the mounting plate which will be first attached to the post and then to the beam.

With reference to FIGS. 7E, 7F, and 50, a beam or top rail mounting plate 38 is shown. Mounting plate 38 is preferably made of steel and is one quarter inch thick. Mounting plate 38 includes eight countersunk screw receptacles 39, two threaded bolt receptacles 40, and wire management opening 41. In FIG. 7E, plate 38 is shown as it would match up with the end of beam 54. In FIG. 7F, plate 38 is placed up against the end of beam 38 to better demonstrate the placement. FIG. 50 shows the actual attachment of the plate 38 to attachment configuration 34, previously described, using wood screws inserted through screw receptacles 39 and into pilot holes 35. Bolts 65 are inserted through bolt openings 36 and threaded into their respective threaded bolt receptacles 40. The ends of the bolt threaded through receptacles 40 are received into bolt openings 36. It is the secure attachment of the bolts 65 through the threaded bolt receptacles that secures an end of beam 54 to the vertical rail 30 of a post 20/24/28.

FIG. 7A shows the end of extruded beam 54 with cladding 66 and trim strip 68 attached. FIG. 46 shows the same end of extruded beam 54 without cladding 66 or strip 68 attached. For comparison, FIG. 47 shows the end of extruded top rail 70 and FIG. 48 shows the end of extruded cross or side rail 72. FIG. 46 shows the end of beam 54 with hanging rails 56 for cladding, mounting T slot 58, wire management opening 60, T-slot 62 for receptacle mounting, and bolt channels 64. FIG. 47 shows the end of top rail 70 with mounting T slot 58, wire management opening 60, T-slot 62 for receptacle mounting, bolt channels 64, and hanging rail 71 for a full or split wall panel. FIG. 48 shows the end of cross or side rail 72 with wire management opening 60 and hanging rail 71 for a full or split wall panel. Beam 54 or top rail 70 both attach to a mounting plate 38, as previously described. The preferred height of beam 54 and top rail 70 is 6 inches, while preferred width of beam 54 is 2 inches and top rail 70 is 1⅞ inches.

Figure 8A:
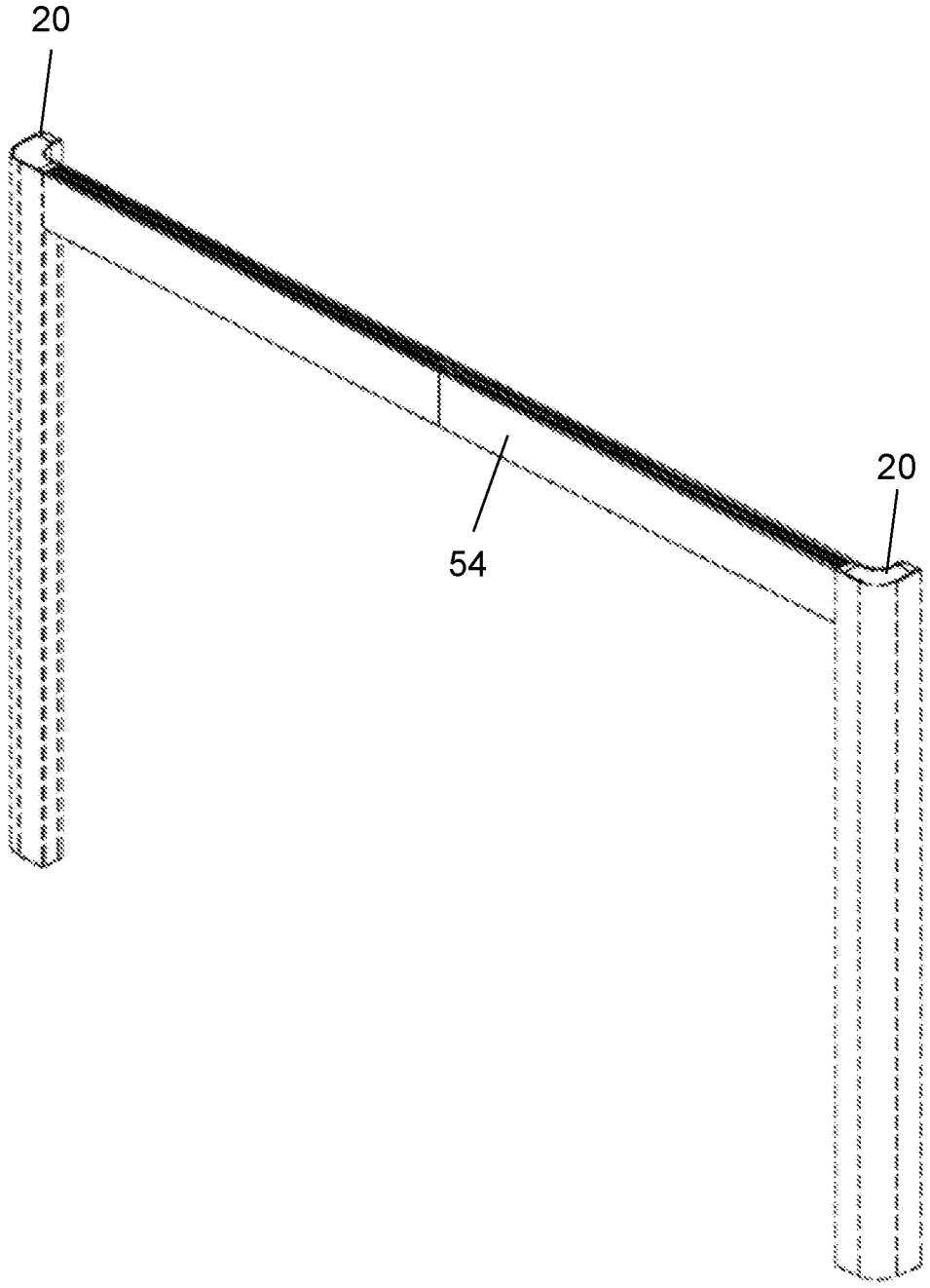
FIG. 8A is a side perspective view of a beam extending between two first posts.
Figure 8B:
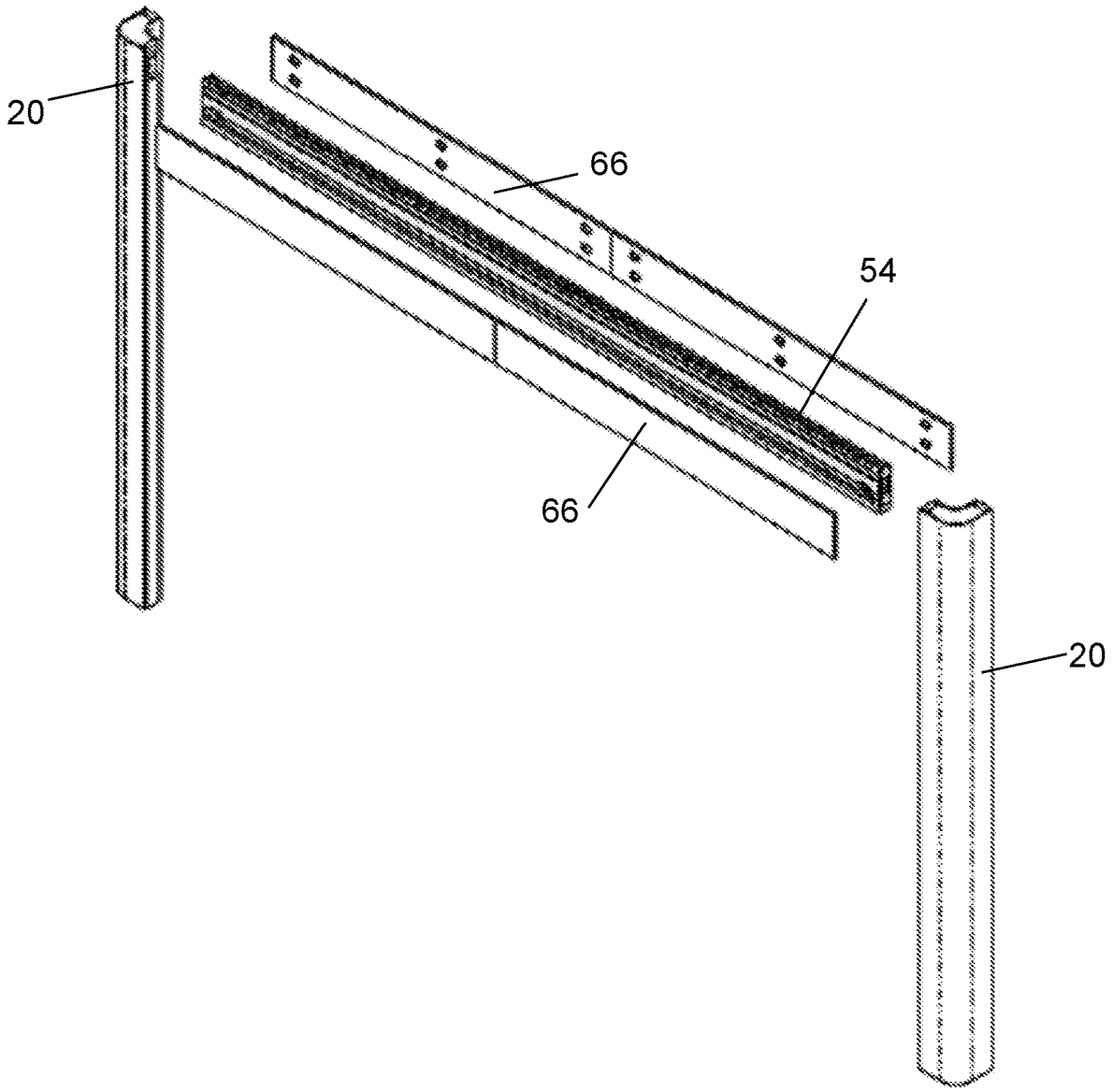
FIG. 8B is an exploded side perspective view of a beam extending between two first posts.

The modular workspace system may be assembled in a variety of sizes and shapes. FIGS. 8A-8F depict a beam 54 extending between a pair of spaced apart first posts 20, whereby the beam 54 and the mounting plate 38 attached to vertical rail 30 of each post 20 are mechanically connected using bolts 65. FIG. 8B shows cladding 66 which is attached to the outsides of beam 54 using clips, as described with the discussion of FIG. 7A. FIG. 8D shows the receptacle access 59 in the top of beam 54.

Figure 9:
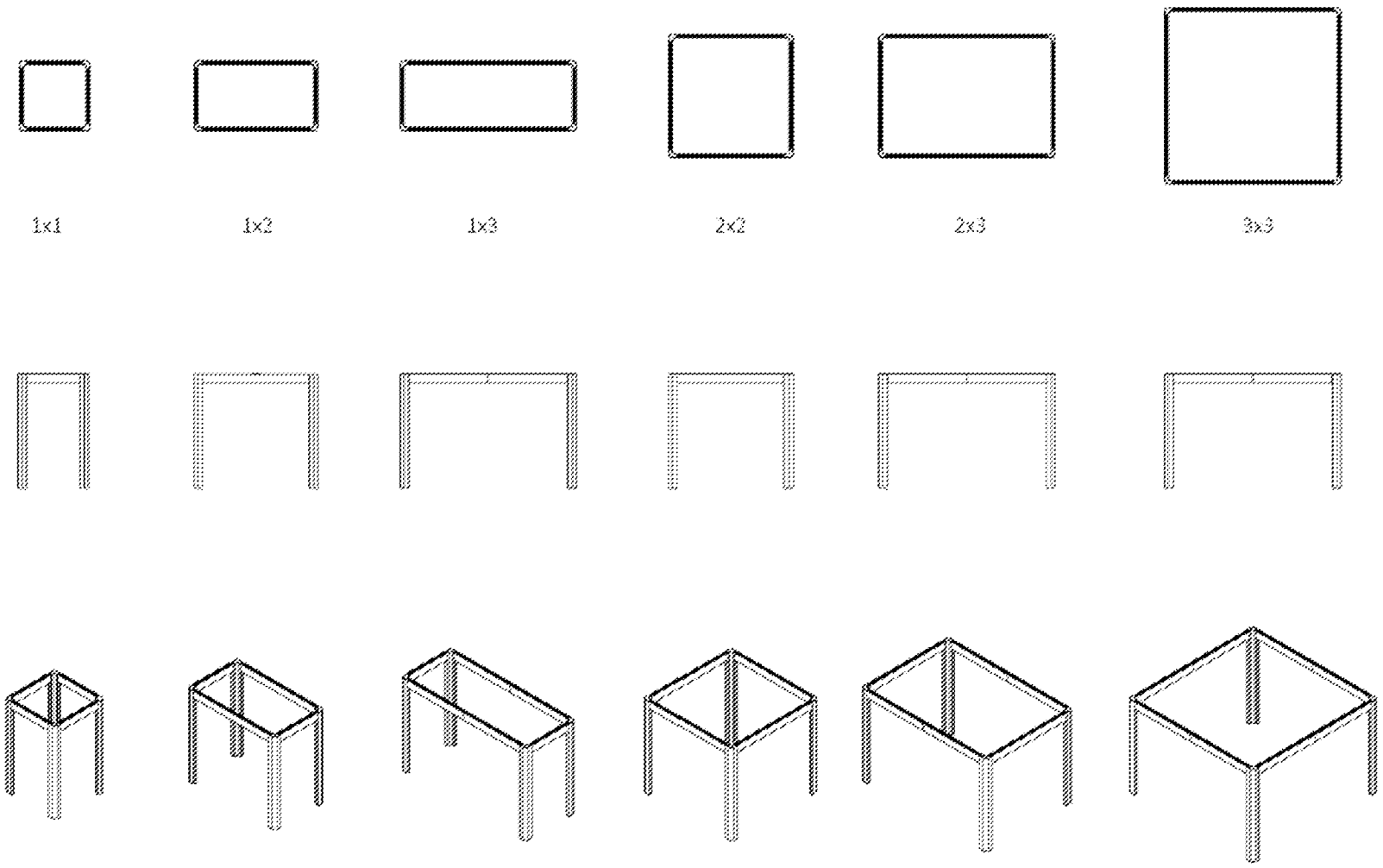
FIG. 9 depicts top plan views (top row), side elevation views (middle row), and perspective views (bottom row) of exemplary modular room structures.

As shown in FIG. 9, this basic assembly of beams and posts may be arranged in square or rectangular configurations of modular room structures (i.e., beams and posts) of various sizes and shapes based on the lengths of the beams. In the embodiments shown in FIG. 9, beams may be single, double, or triple length. In other embodiments, other variations of beam length may be used. For convenience, a modular workspace system formed by four first posts connected by four single length beams in a square shape is referred to as a 1×1 module. Similarly, a modular workspace system formed by four first posts connected by two single length beams and two double length beams in a rectangular shape is referred to as a 1×2 module. While FIG. 9 depicts modules ranging from 1×1 to 3×3, it should be understood that other configurations are within the scope of the invention, and multi-room modules may be constructed by replacing first posts with second posts or third posts.

Modular room structures are converted into modular rooms with the additions of panels. As used herein, the term "panel" broadly refers to an element which extends generally parallel to the beam and occludes at least a portion of the space between the posts. Depending on the type of panel and its positioning, the panel may be attached to a post, a beam, or a cross rail or other supporting structure. Preferably, panels are provided in a standardized, predetermined width corresponding to the width of a single length beam. For example, two posts spaced apart by a triple length beam may fit three panels between the posts. All three panels may be identical, or may differ, based on the intended function of the modular room.

Figure 10A:
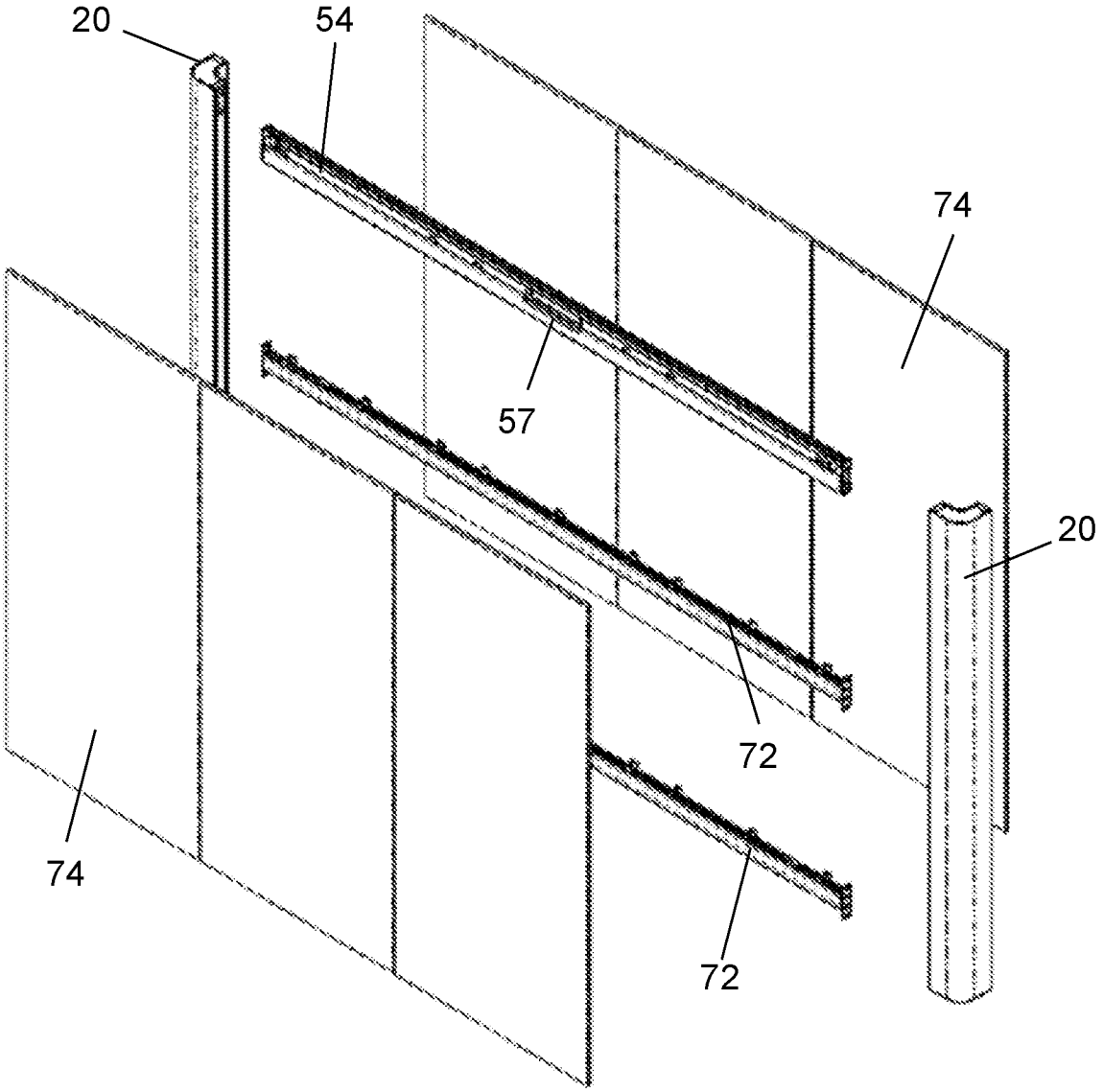
FIG. 10A is an exploded view of a twin layered wall panel mounted on a beam and first posts.
Figure 10B:
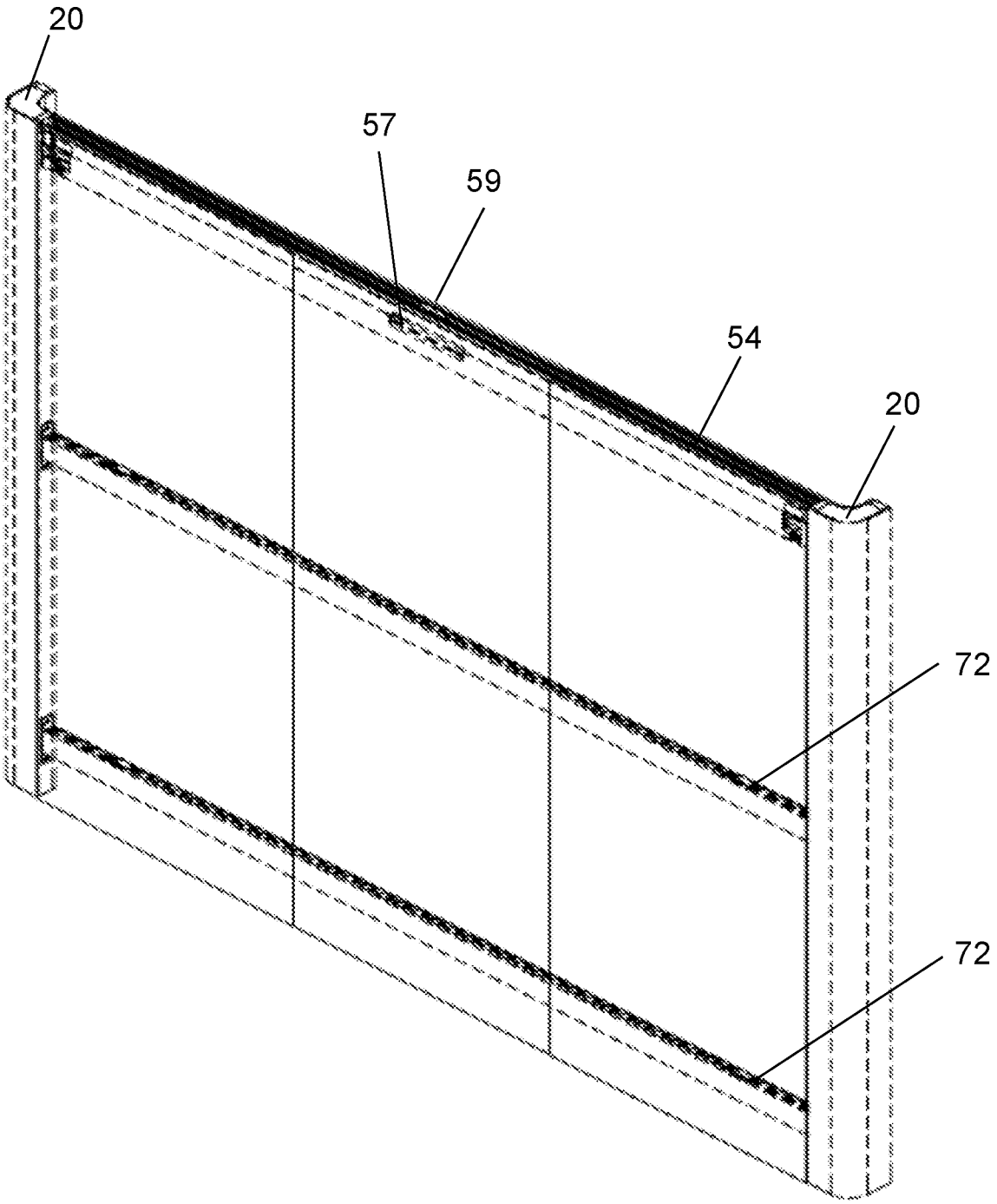
FIG. 10B is a side perspective view of a twin layered wall panel mounted on a beam and first posts.
Figures 10C, 10D, 10E, 10F:
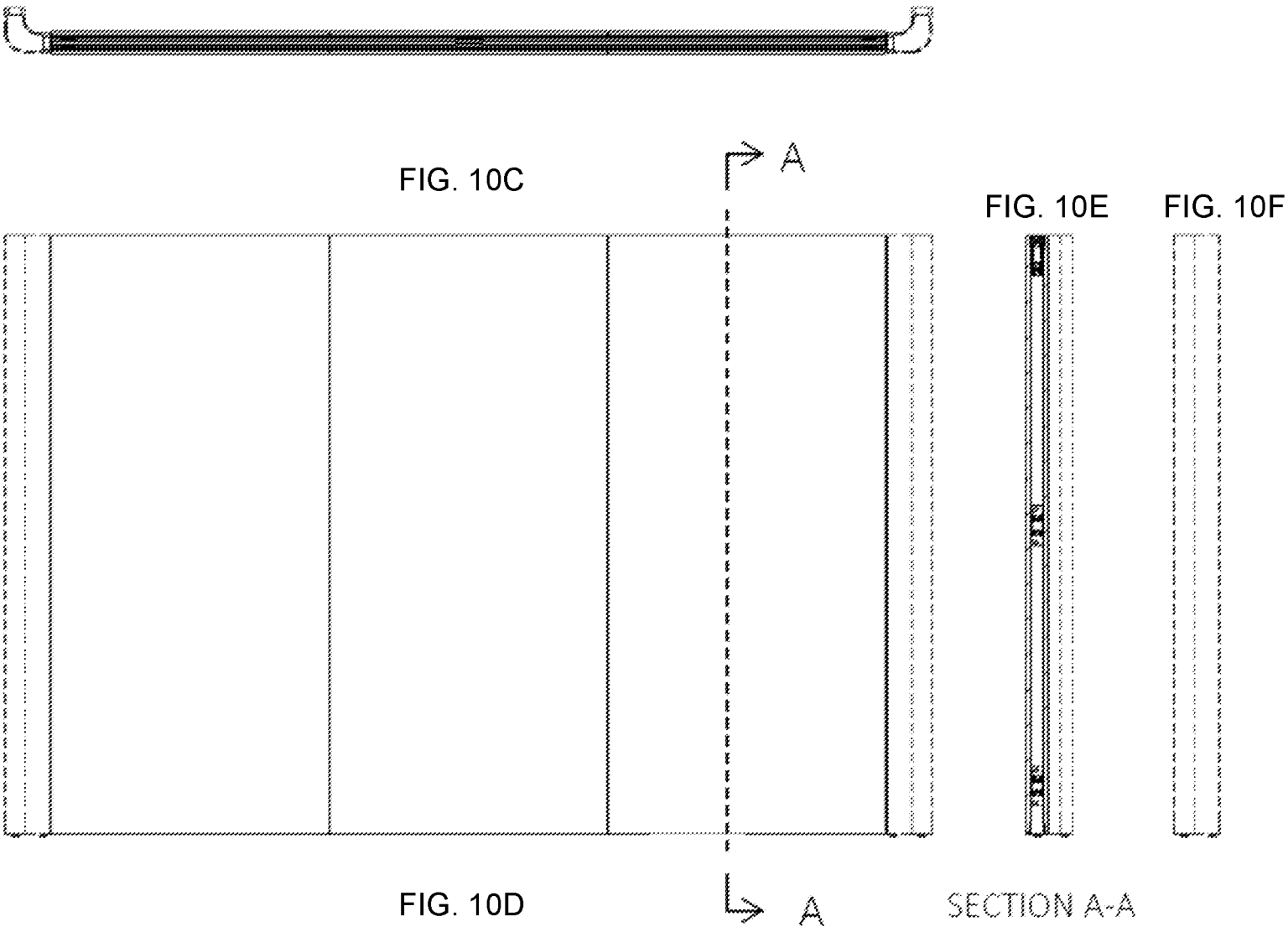
FIG. 10C is a top plan view of the twin layered wall panel mounted on a beam and first posts.
FIG. 10D is a side elevation view of the twin layered wall panel mounted on a beam and first posts.
FIG. 10E is a cross-sectional drawing of the twin layered wall panel mounted on a beam and first posts along lines A-A of FIG. 10D.
FIG. 10F is an end view of the twin layered wall panel mounted on a beam and first posts.
Figure 11A:
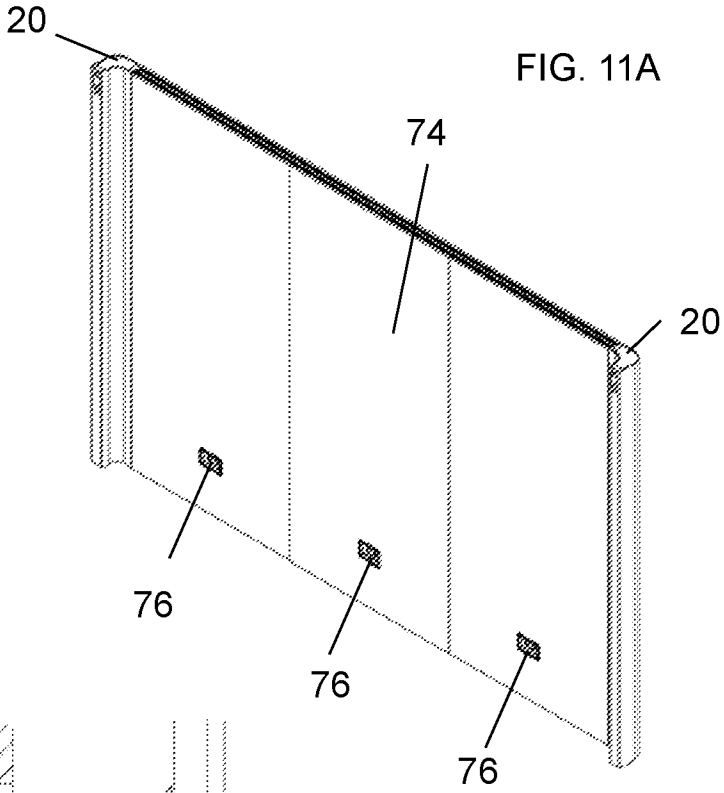
FIG. 11A is a side perspective view of a twin layered wall panel with recessed power outlets.
Figure 11G:
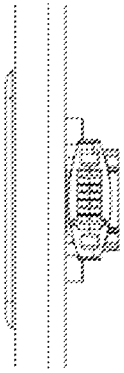
FIG. 11G is a side elevation view of a recessed wall outlet mounted in a layer.
Figure 11F:
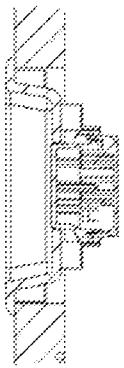
FIG. 11F is a cross-sectional side elevation view of a recessed wall outlet mounted in a layer.
Figure 11B:
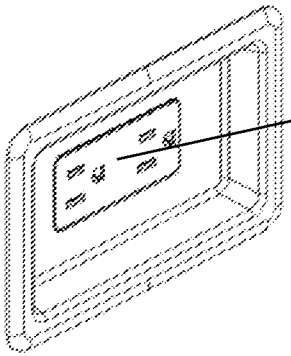
FIG. 11B is a front perspective view of a recessed wall outlet.
Figure 11C:
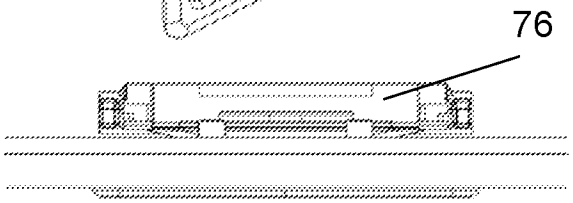
FIG. 11C is a top plan view of a recessed wall outlet mounted in a layer.
Figure 11D:
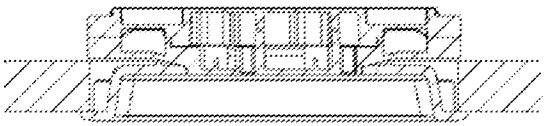
FIG. 11D is a cross-sectional top plan view of a recessed wall outlet mounted in a layer.
Figure 11E:
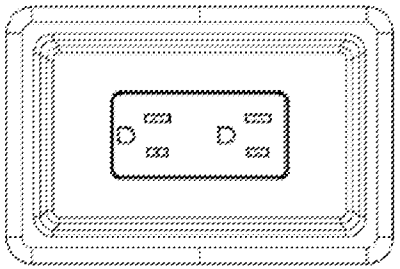
FIG. 11E is a front view of a recessed wall outlet.

FIGS. 10A-10F depict a twin layered wall panel 74 mounted between two spaced apart first posts 20. A triple length beam 54 extends between the tops ends of the posts 20, two vertically spaced apart cross or side rails 72 extend between the posts 20 below the beam 54, three elongated rectangular wall panels 74 attach to a first side of the beam 54 and cross rails 72 and three elongated rectangular wall panels 74 attach to an opposite second side of the beam 54 and cross rails 72. In some embodiments, the cross rails 72 are elongated frames with brackets or mounting plates 73 affixed to either opposing end, with channels on either side for receiving clips mounted on the rears of the wall panels. In these embodiments, the cross rails 72 are structurally similar to the frames and brackets of the beams 54, but smaller sized (See FIGS. 46-48 for relative sizes of beam 54, top rail 70, and cross rail 72). In FIGS. 10A and 10B, the receptacle mounting cavity 57 and the receptacle access 59 are identified. In certain embodiments, posts intended for use with twin layered wall panels may include additional connection assemblies for receiving the brackets of the cross rails. As shown in FIG. 10D, wall panels extend vertically from the top end of the posts to the bottom end of the posts, and collectively extend horizontally between the spaced apart first posts, such that the twin layer wall panels function as a wall.

As shown in FIGS. 11A-11F, embodiments of the twin layered wall panel may include recessed outlets 76. Power lines for the outlets may extend through cavity between the wall panels and into the beam or the posts. Some embodiments of cross rails 72 may include wire management cutouts 60 in the top and bottom of the frame to allow passage of power lines vertically through the cross rails 72 (FIG. 51).

Figure 12A:
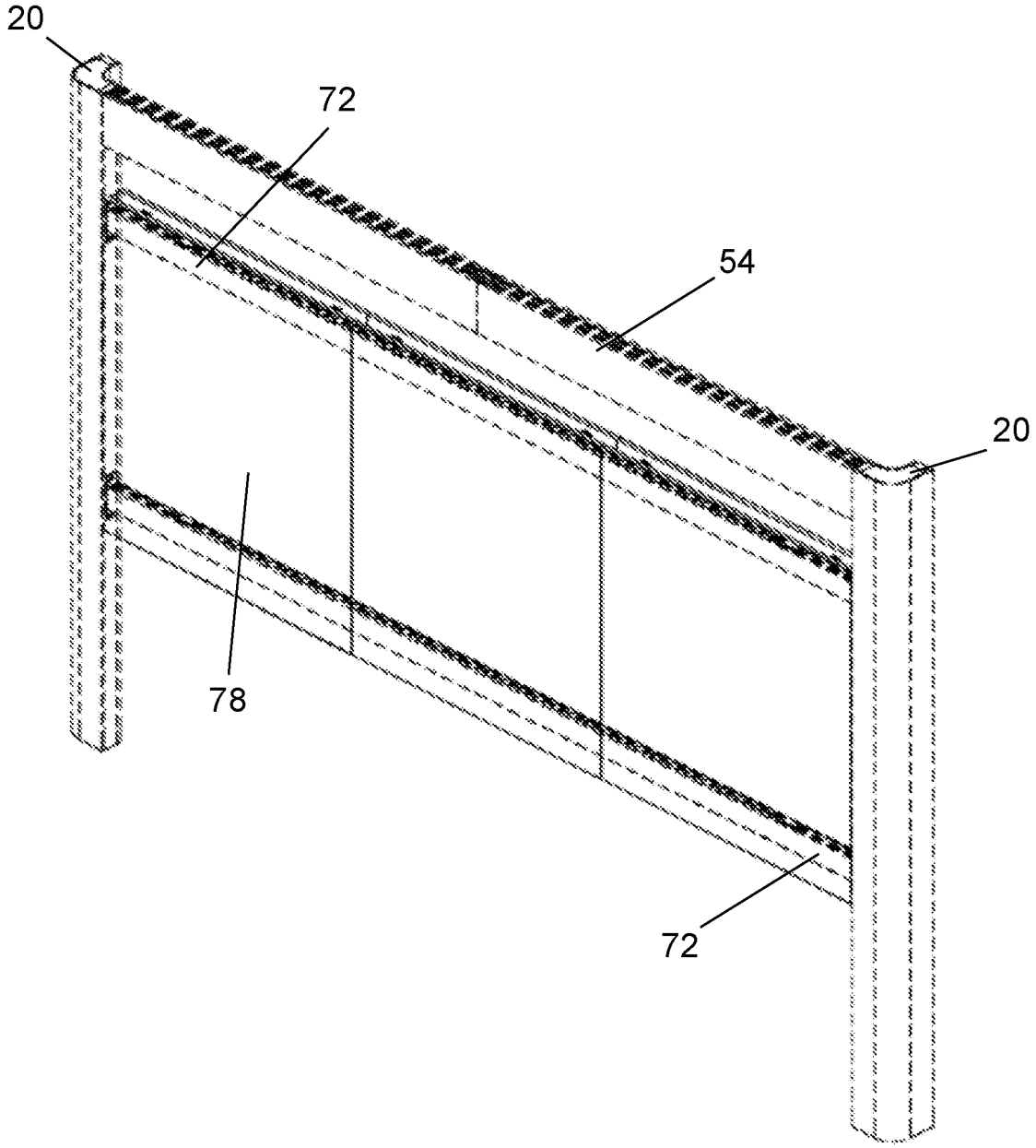
FIG. 12A is a side perspective view of a shortened twin layered wall panel mounted on a beam and first posts.
Figures 12B, 12C, 12D, 12E:
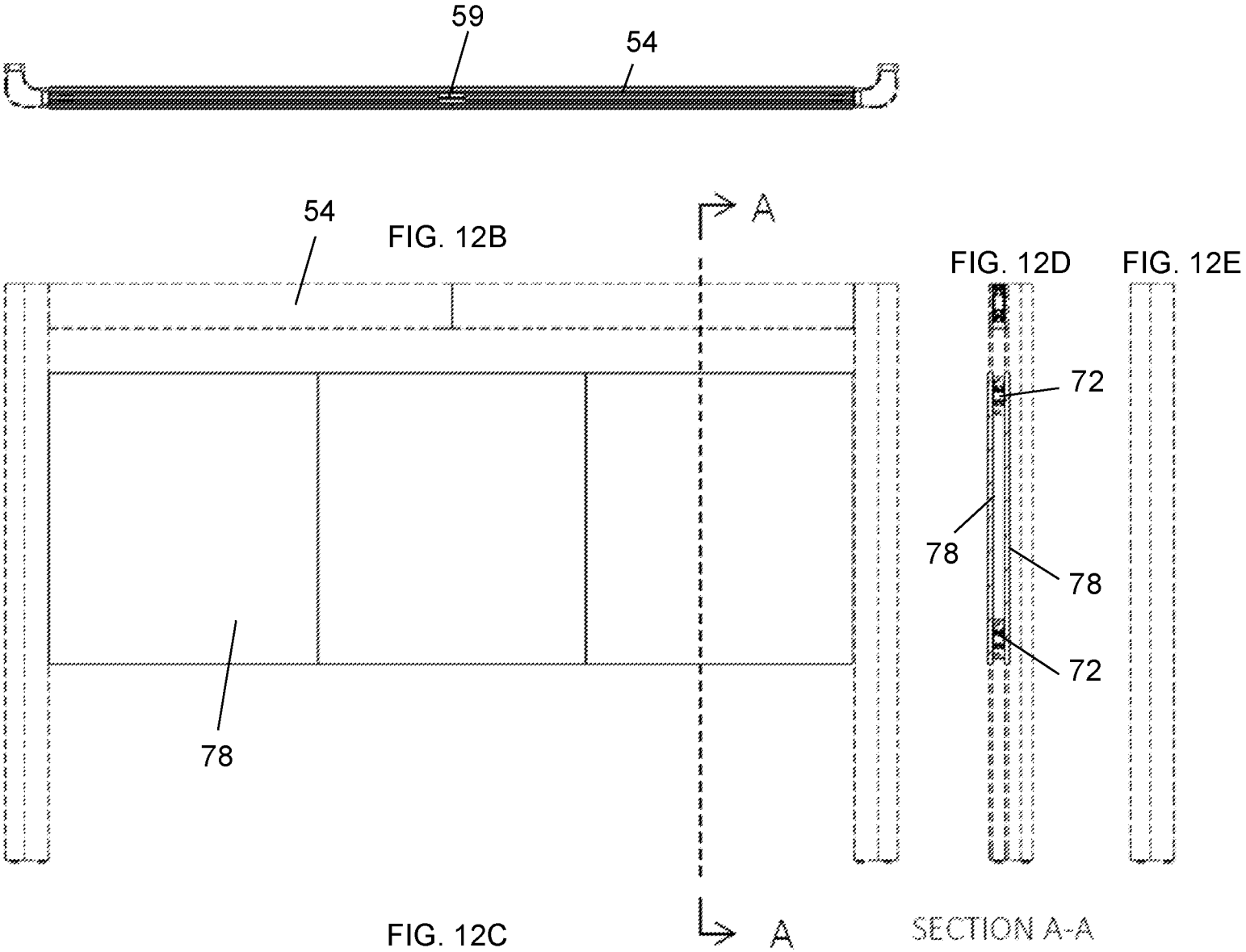
FIG. 12B is a top plan view of the shortened twin layered wall panel mounted on a beam and first posts.
FIG. 12C is a side elevation view of the shortened twin layered wall panel mounted on a beam and first posts.
FIG. 12D is a cross-sectional drawing of the shortened twin layered wall panel mounted on a beam and first posts along lines A-A of FIG. 12C.
FIG. 12E is an end view of the shortened twin layered wall panel mounted on a beam and first posts.

FIGS. 12A-12E depict a shortened twin layered wall panel 78 mounted between two spaced apart first posts 20. A triple length beam 54 extends between the tops ends of the posts 20, two vertically spaced apart cross rails 72 extend between the posts 20 below the beam 54, three rectangular shortened wall panels 78 attach to a first side of the cross rails 72 and three rectangular shortened wall panels 78 attach to an opposite second side of the cross rails 72. As shown in FIG. 12D, the panels 78 are spaced apart from the beam 54, and the beam 54 includes side trims and bottom trim. The panels 78 extend substantially from the upper cross rail 72 to the lower cross rail 72, and are spaced apart from the beam 54 and from the bottom end of the posts 20. The shortened twin layered wall panels 78 function as a partial wall, preventing individuals from walking between the posts, but providing greater connectivity between areas than the full length twin layers wall panels 74 shown in FIGS. 10A-10F.

Figure 13A:
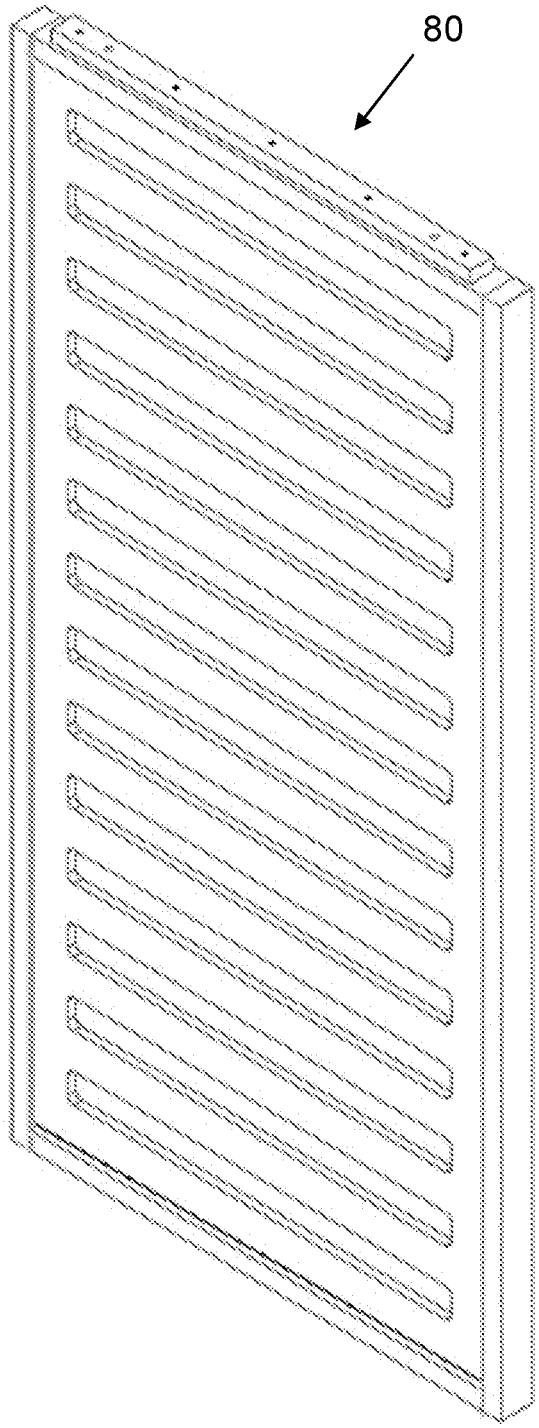
FIG. 13A is a side perspective view of a first embodiment of a framed wall panel.
Figure 13F:
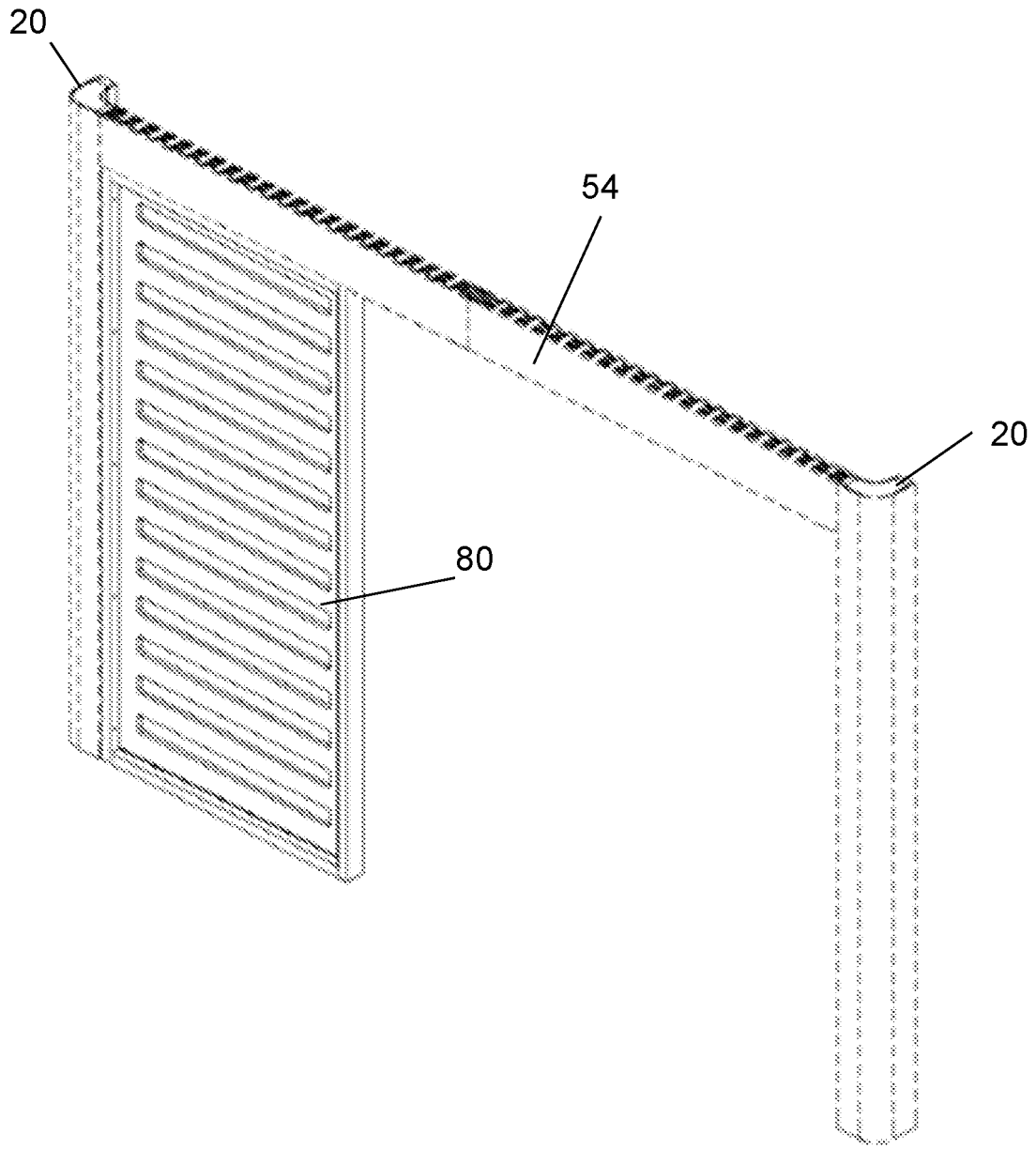
FIG. 13F is a side perspective view of the first embodiment of a framed wall panel mounted on a beam and first posts.
Figures 13G, 13H, 13I, 13J:
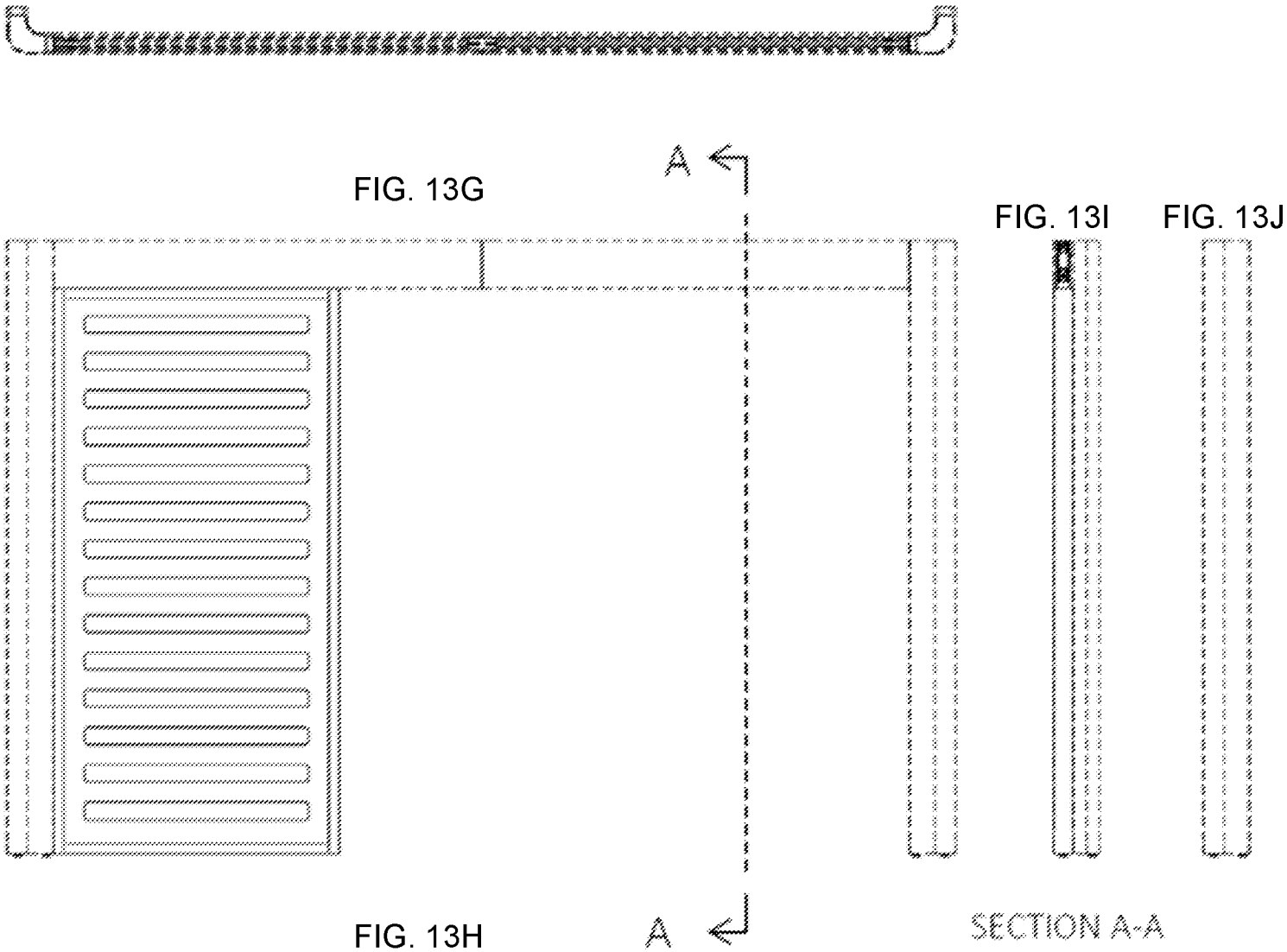
FIG. 13G is a top plan view of the first embodiment of a framed wall panel mounted on a beam and first posts.
FIG. 13H is a side elevation view of the first embodiment of a framed wall panel mounted on a beam and first posts.
FIG. 13I is a cross-sectional drawing of the first embodiment of a framed wall panel mounted on a beam and first posts along lines A-A of FIG. 13H.
FIG. 13J is an end view of the first embodiment of a framed wall panel mounted on a beam and first posts.
Figure 14A:
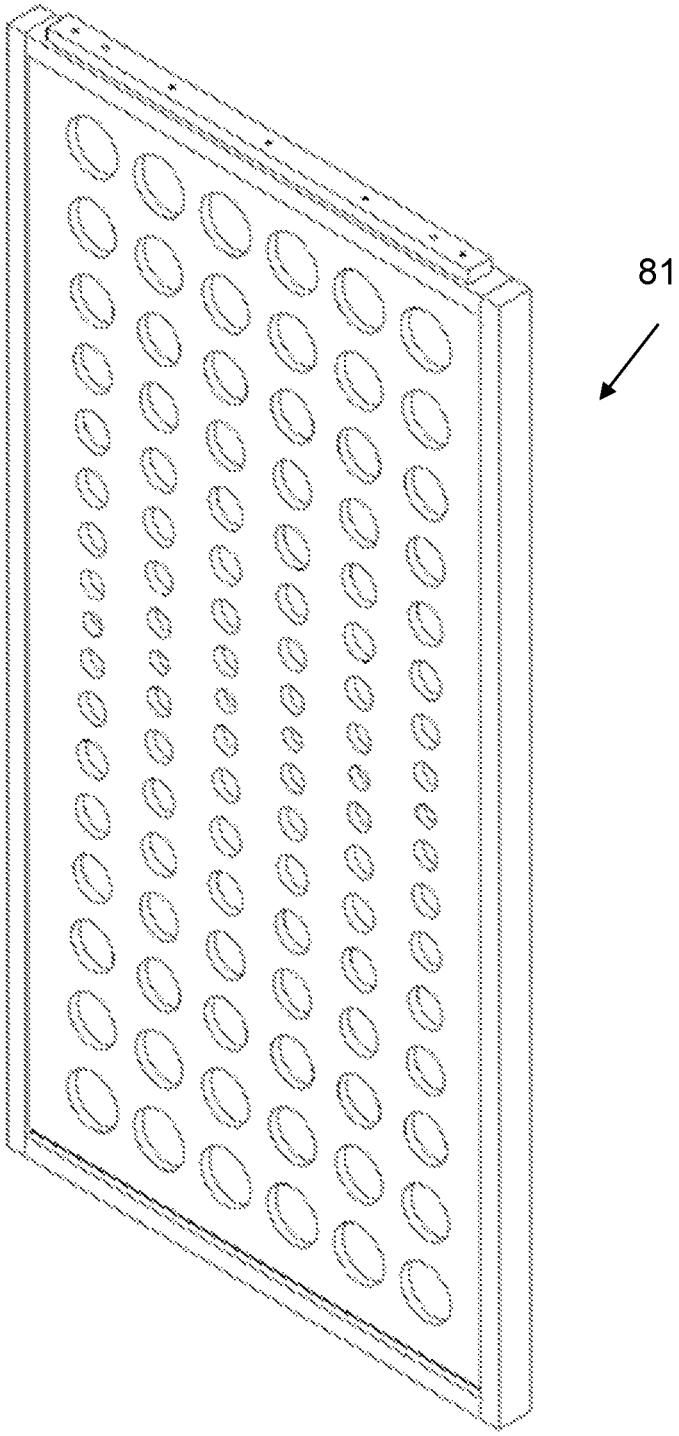
FIG. 14A is a side perspective view of a second embodiment of a framed wall panel.
Figure 15A:
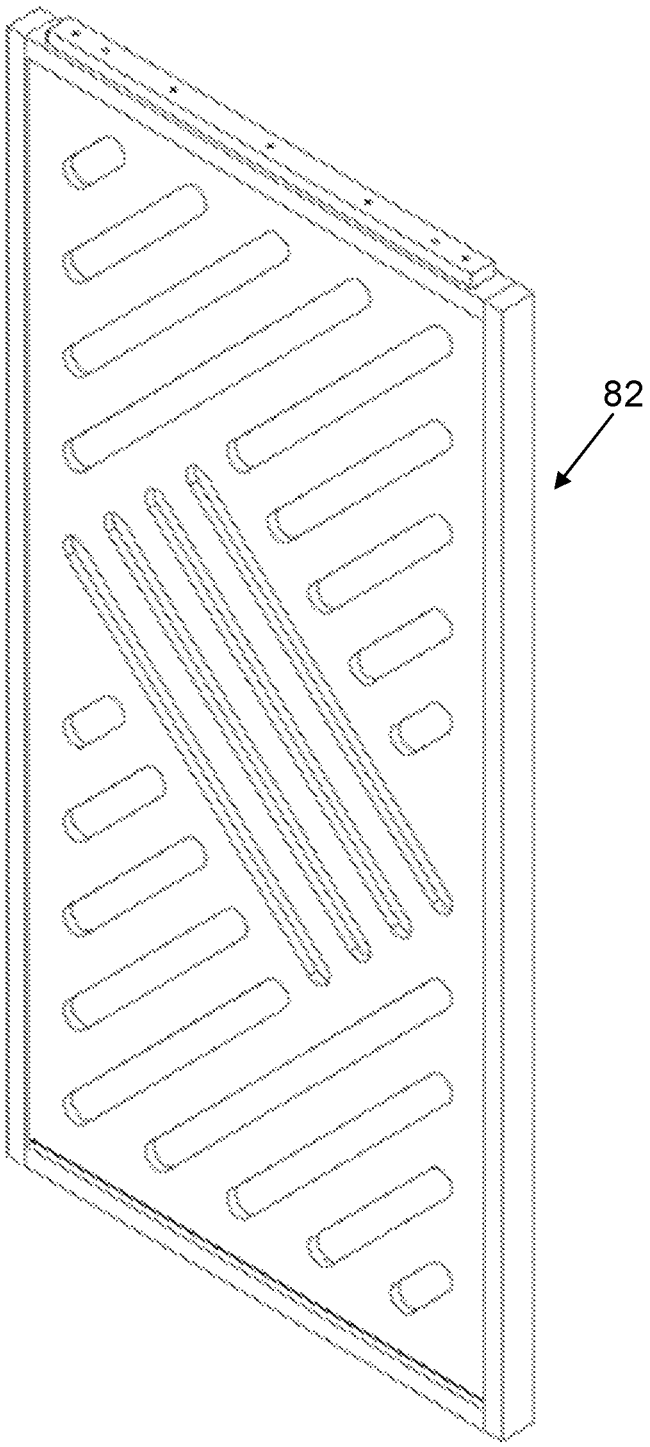
FIG. 15A is a side perspective view of a third embodiment of a framed wall panel.
Figure 16A:
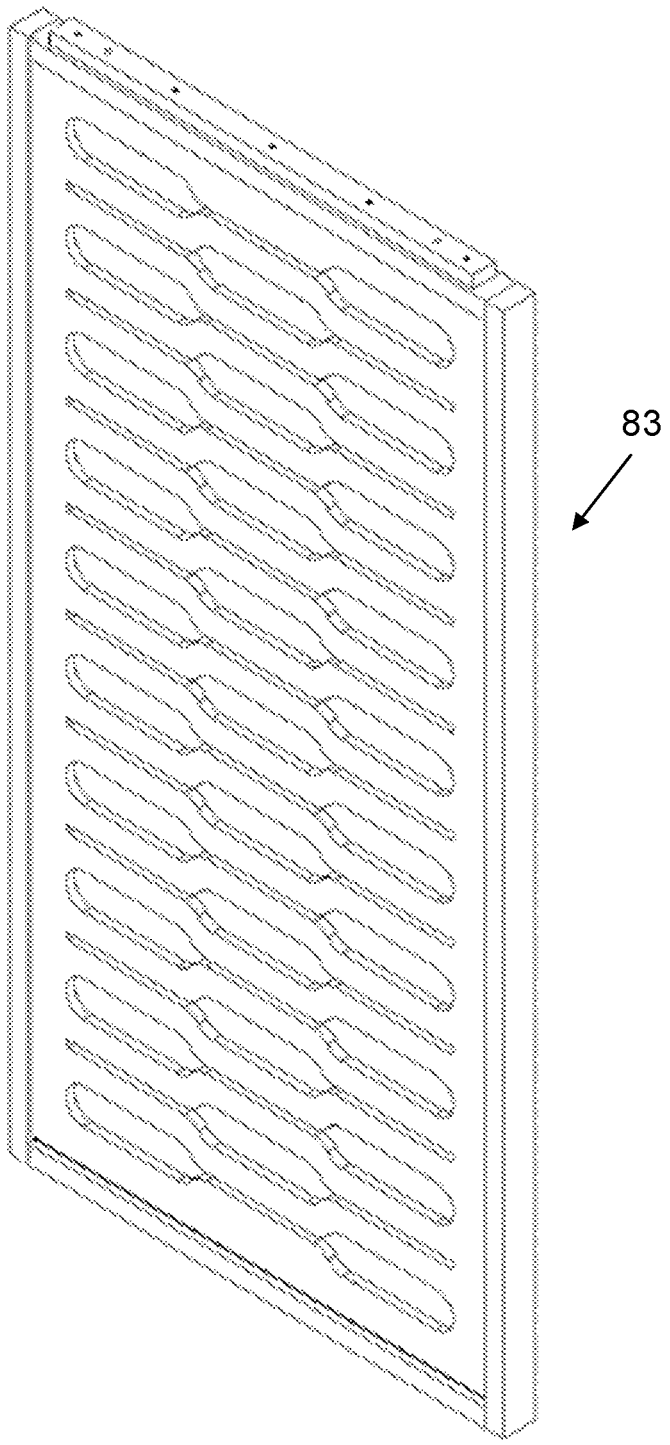
FIG. 16A is a side perspective view of a fourth embodiment of a framed wall panel.
Figure 17A:
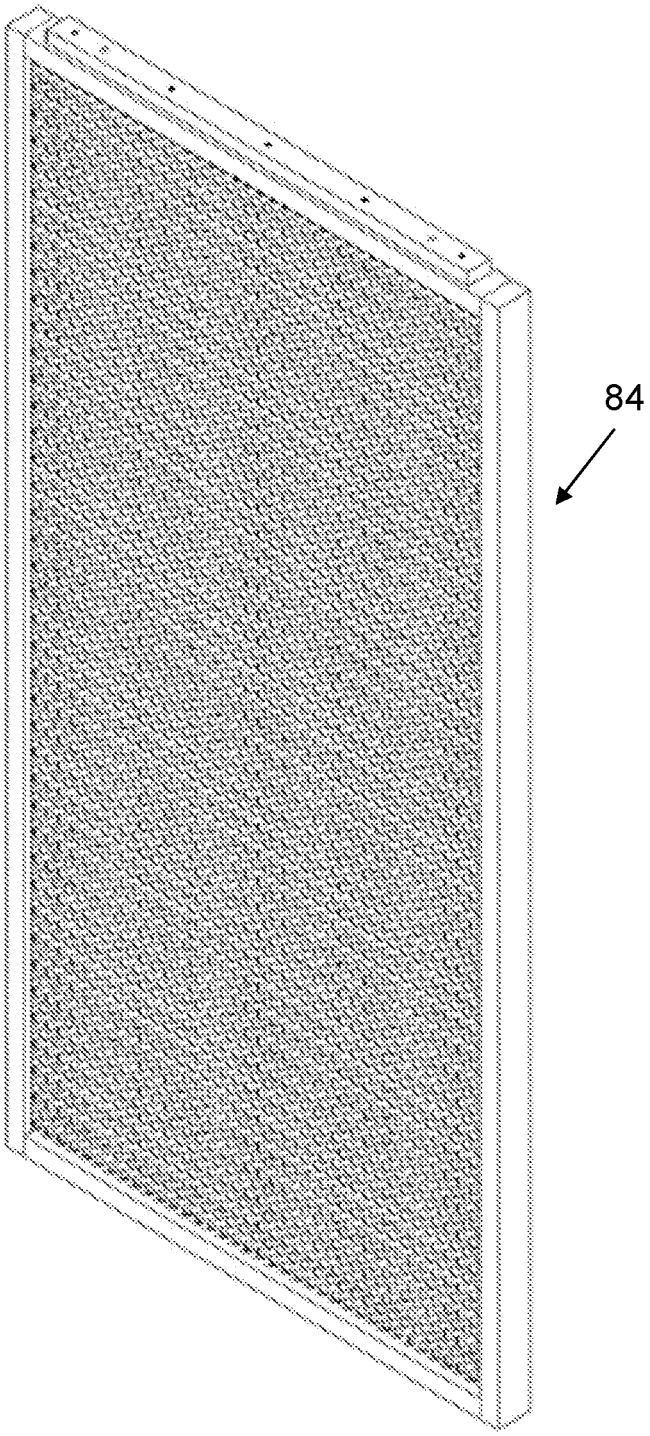
FIG. 17A is a side perspective view of a fifth embodiment of a framed wall panel.
Figure 17B:
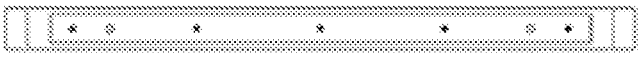
FIG. 17B is a top plan view of the fifth embodiment of a framed wall panel.
Figure 17C:
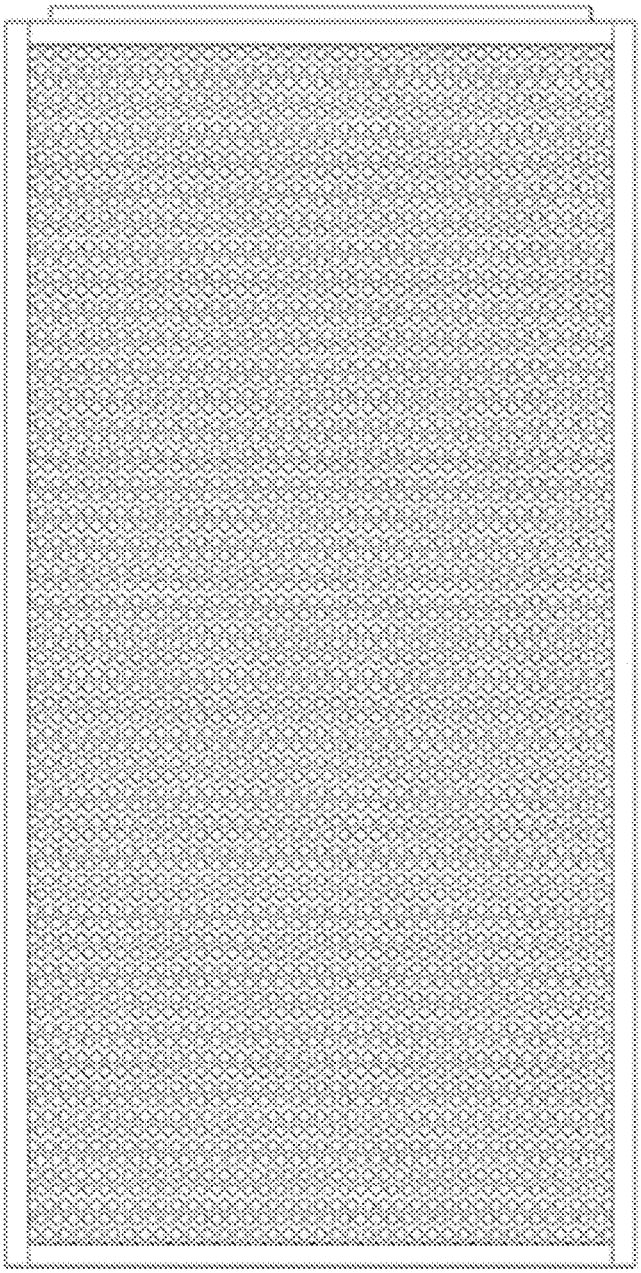
FIG. 17C is a side elevation view of the fifth embodiment of a framed wall panel.
Figure 17E:
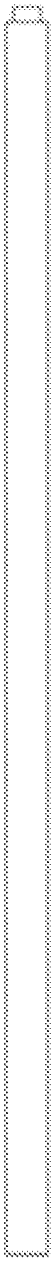
FIG. 17E is an end elevation view of the fifth embodiment of a framed wall panel.
Figure 17D:
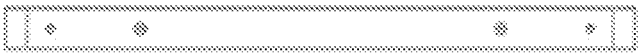
FIG. 17D is a bottom plan view of the fifth embodiment of a framed wall panel.
Figure 18A:
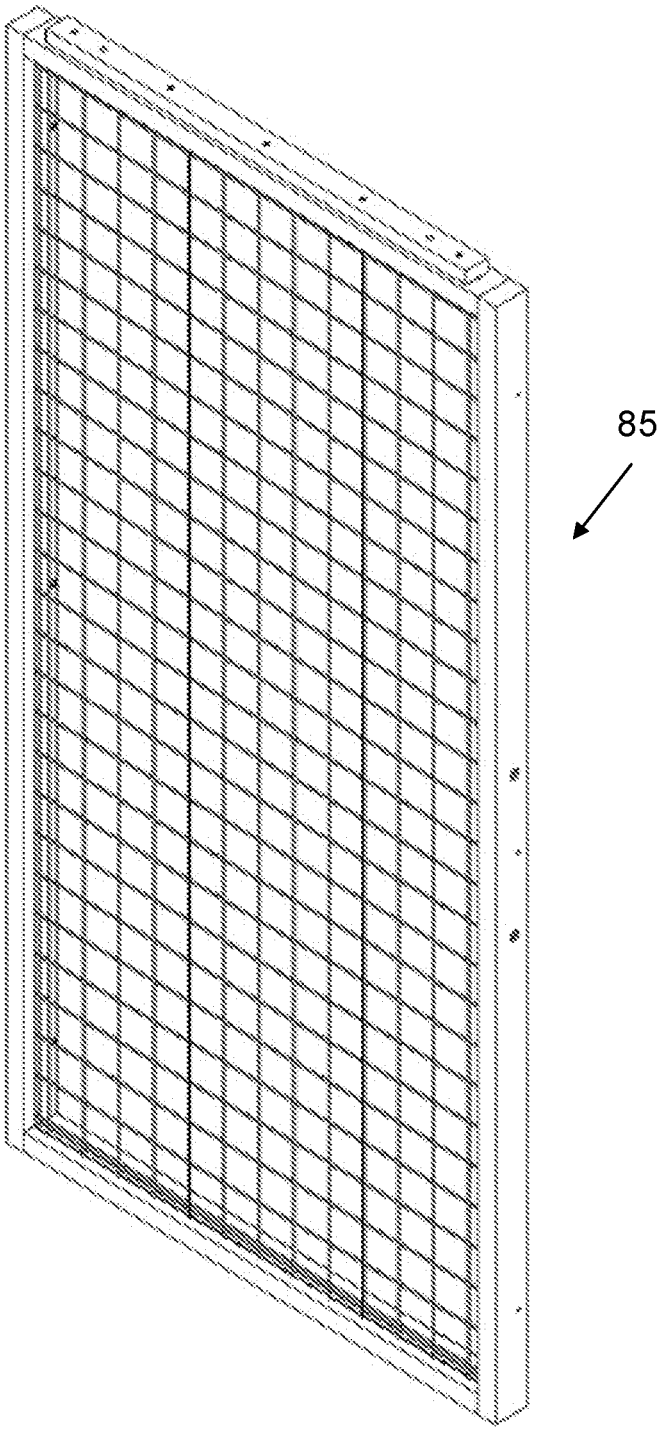
FIG. 18A is a side perspective view of a sixth embodiment of a framed wall panel.
Figure 19A:
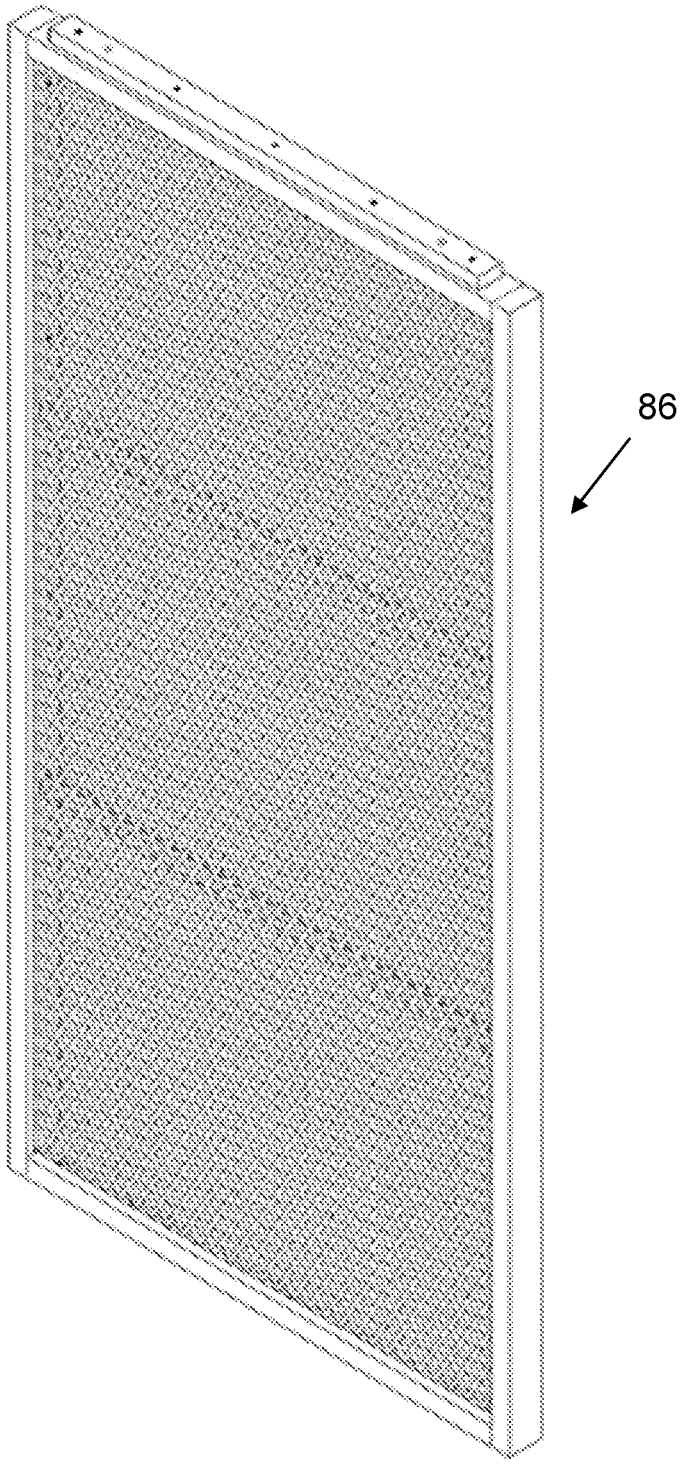
FIG. 19A is a side perspective view of a seventh embodiment of a framed wall panel.
Figure 19B:
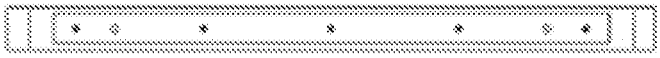
FIG. 19B is a top plan view of the seventh embodiment of a framed wall panel.
Figure 19C:
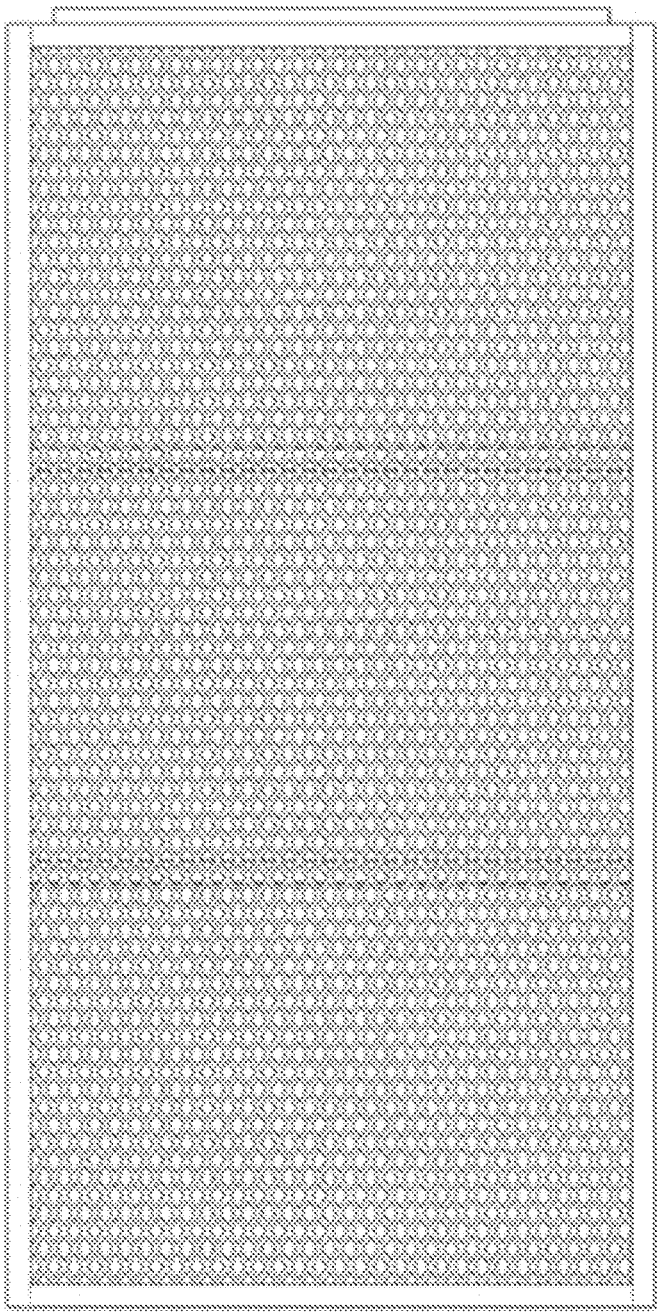
FIG. 19C is a side elevation view of the seventh embodiment of a framed wall panel.
Figure 19E:
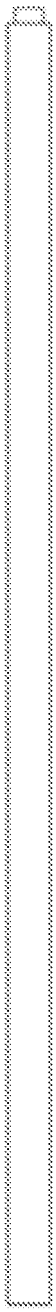
FIG. 19E is an end elevation view of the seventh embodiment of a framed wall panel.
Figure 19D:
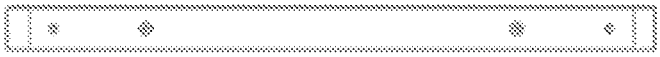
FIG. 19D is a bottom plan view of the seventh embodiment of a framed wall panel.

Embodiments of the modular workspace system may include a wide variety of panels. FIGS. 13A-13E depict a first embodiment of a framed wall panel 80. The framed wall panel 80 includes a rectangular framework with a plurality of horizontal channels extending therethrough. FIGS. 13F-13J depicts the first embodiment framed wall panel 80 mounted on a first post 20 spaced apart from another first post 20 by a triple length beam 54. As seen in FIGS. 13A, B, C, and E, the first embodiment framed wall panel 80 includes a ridge on the top of the frame. In some embodiments, the ridge has dimensions similar to the bottom trim, such that the ridge mechanically interlocks with a beam 54 carrying side trims by fitting the ridge between the side trims.

As additional exemplary embodiments, FIGS. 14A-14E (panel 81), 15A-15E (panel 82), 16A-16E (panel 83), 17A-17E (panel 84), 18A-18E (panel 85), and 19A-19E (panel 86) respectively depict second, third, fourth, fifth, sixth, and seventh embodiments of framed wall panels, each including a rectangular framework and, positioned within the framework, an insert including a plurality of opening in various shapes and patterns. In some embodiments, each of the second 81, third 82, and fourth 83 embodiments of framed wall panels include wooden inserts with channels or circular openings as depicted. In some embodiments, each of the fifth 84, sixth 85, and seventh 86 embodiments of framed wall panels have metal inserts, which may be perforated steel (fifth embodiment), steel wire (sixth embodiment), or steel mesh (seventh embodiment). Each of the second, third, fourth, fifth, sixth, and seventh embodiments of framed wall panels includes a ridge on the top of the frame. In some embodiments, the ridge has dimensions similar to the bottom trim, such that it is adapted to mechanically interlock with a beam as described above in connection with the first embodiment of a framed wall panel. As should be understood, wall panels constructed of different materials and having other patterns or designs of openings are within the scope of this invention.

Figure 20A:
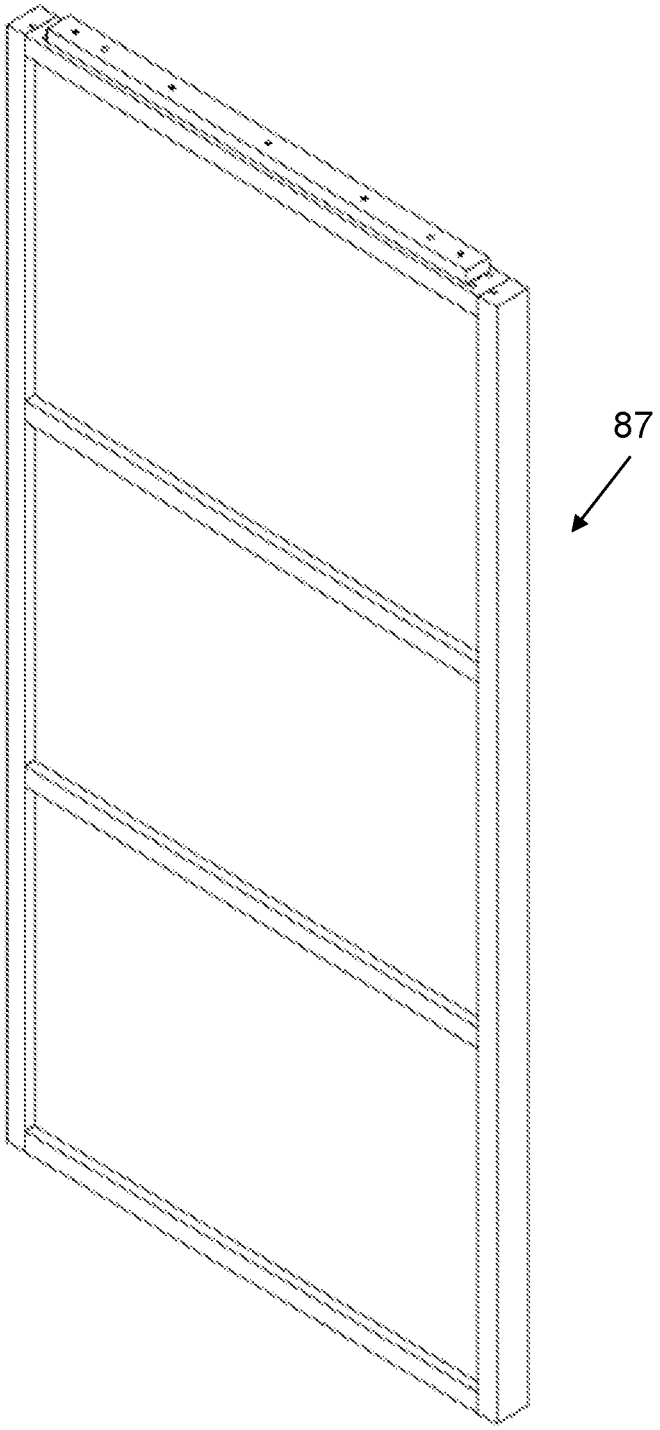
FIG. 20A is a side perspective view of a framed wall panel with inserts.
Figure 20B:
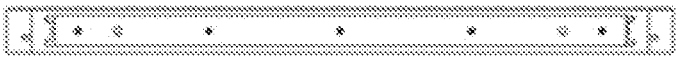
FIG. 20B is a top plan view of the framed wall panel with inserts.
Figure 20C:
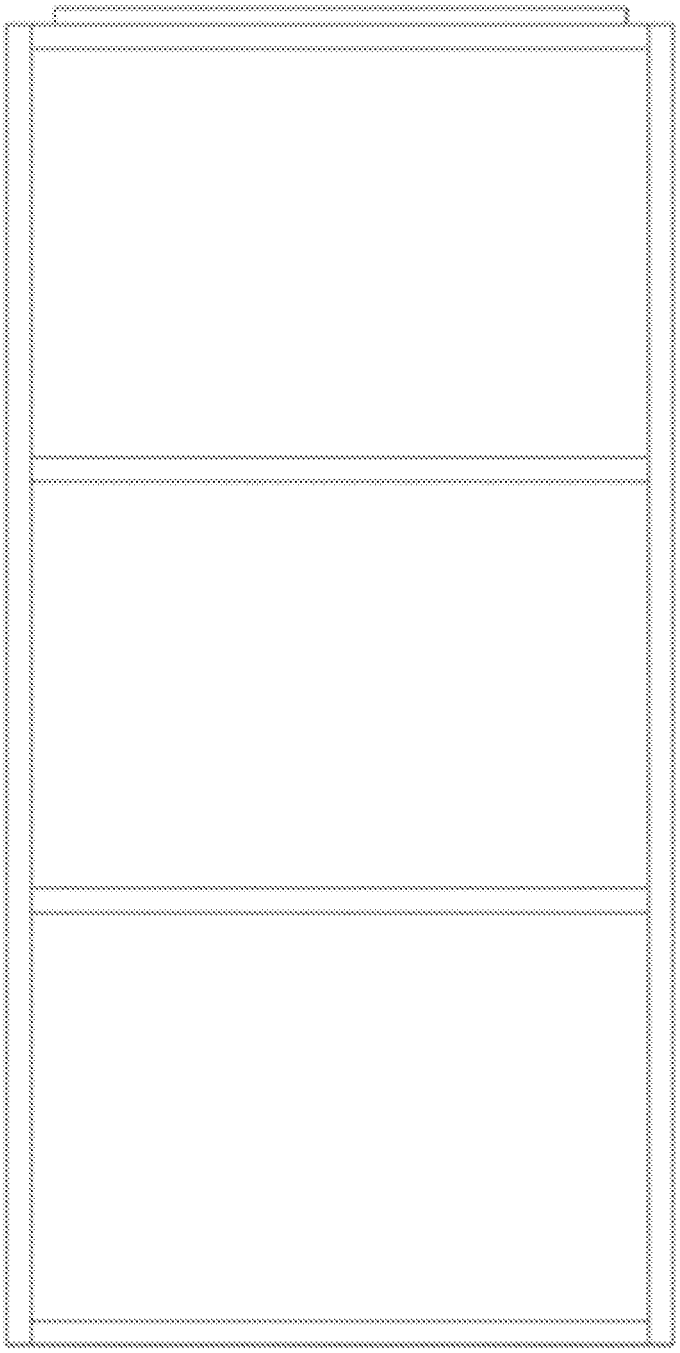
FIG. 20C is a side elevation view of the framed wall panel with inserts.
Figure 20E:
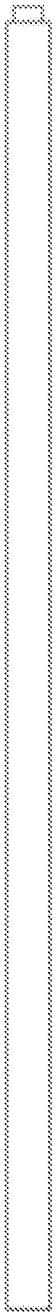
FIG. 20E is an end elevation view of the framed wall panel with inserts.
Figure 20D:
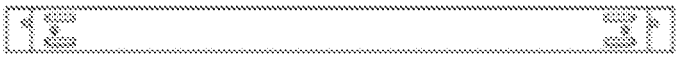
FIG. 20D is a bottom plan view of the framed wall panel with inserts.
Figure 20F:
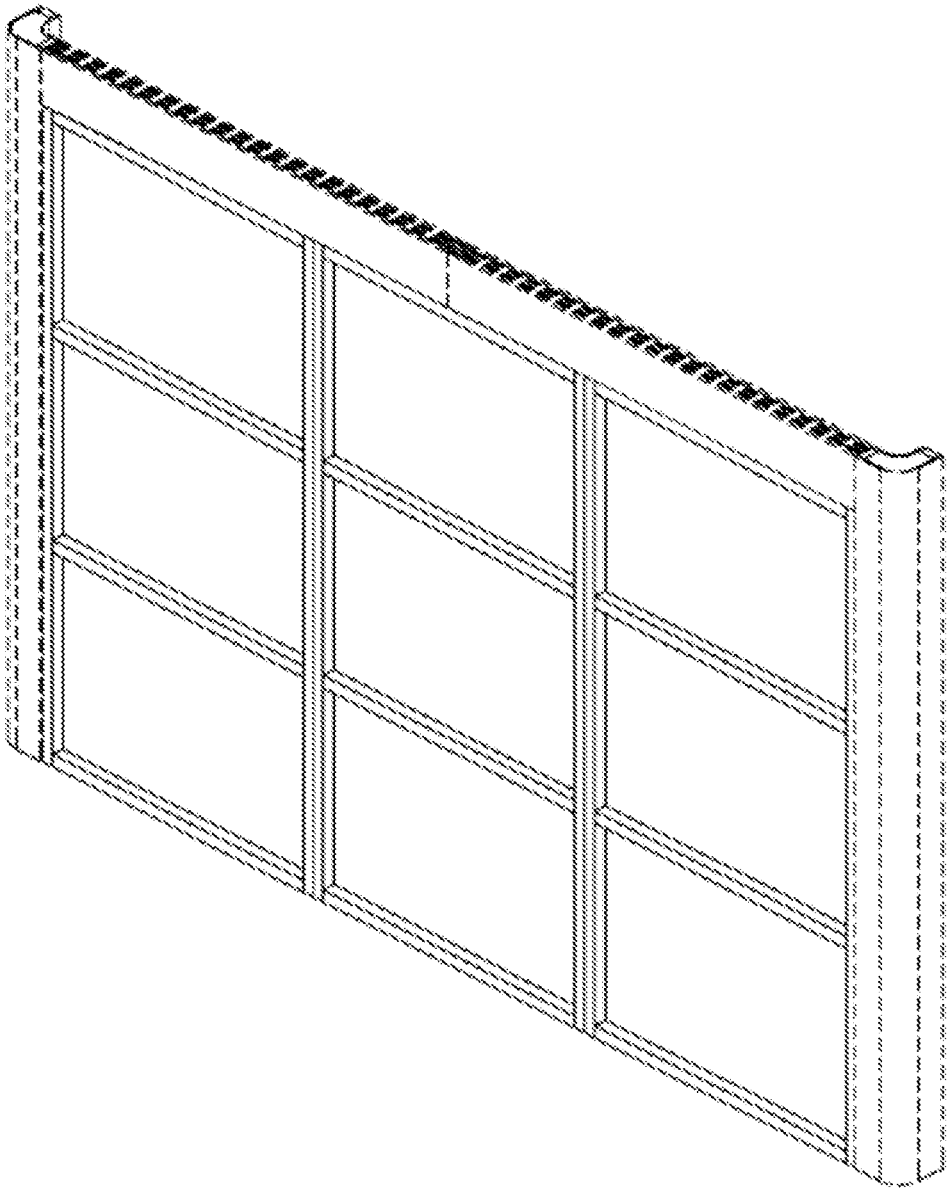
FIG. 20F is a side perspective view of the framed wall panels with inserts mounted on a beam and first posts.
Figures 20G, 20H, 20I, 20J:
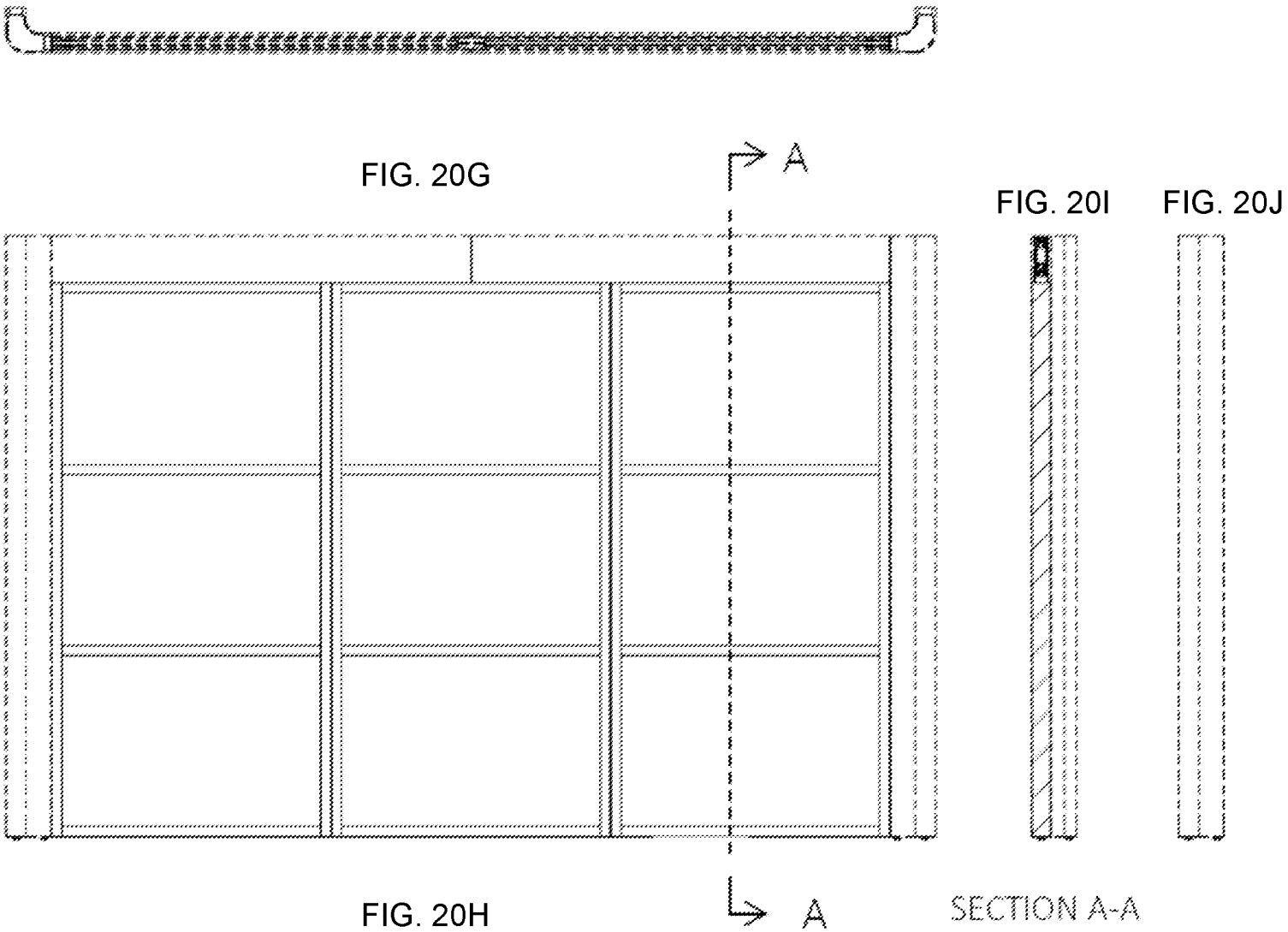
FIG. 20G is a top plan view of the framed wall panels with inserts mounted on a beam and first posts.
FIG. 20H is a side elevation view of the framed wall panels with inserts mounted on a beam and first posts.
FIG. 20I is a cross-sectional drawing of the framed wall panels with inserts mounted on a beam and first posts along lines A-A of FIG. 20H.
FIG. 20J is an end view of the framed wall panels with inserts mounted on a beam and first posts.

FIGS. 20A-20E depict a framed wall panel 87 with inserts. In the depicted embodiment, the framed wall panel 87 with inserts includes a rectangular frame with equally spaced horizontal cross members, the frame and cross members collectively defining three equally sized apertures. An insert, such as transparent or translucent glass or similar material, is placed within each aperture such that the framed wall panel allows passage of light and, in embodiments where the insert is transparent, allows the framed wall panel with inserts to function as a window. In other embodiments, the inserts may be opaque, such that the framed wall panel with inserts blocks the passage of light, or may be a reflective material or include a reflective coating, such that the framed wall panel with inserts functions as a mirror. As seen in FIGS. 20A, B, C, and E, the first embodiment framed wall panel includes a ridge on the top of the frame. In some embodiments, the ridge has dimensions similar to the bottom trim, such that the ridge mechanically interlocks with a beam carrying side trims by fitting the ridge between the side trims. FIGS. 20F-20J depicts three framed wall panels with inserts mounted on a first post spaced apart from another first post by a triple length beam.

Figure 21A:
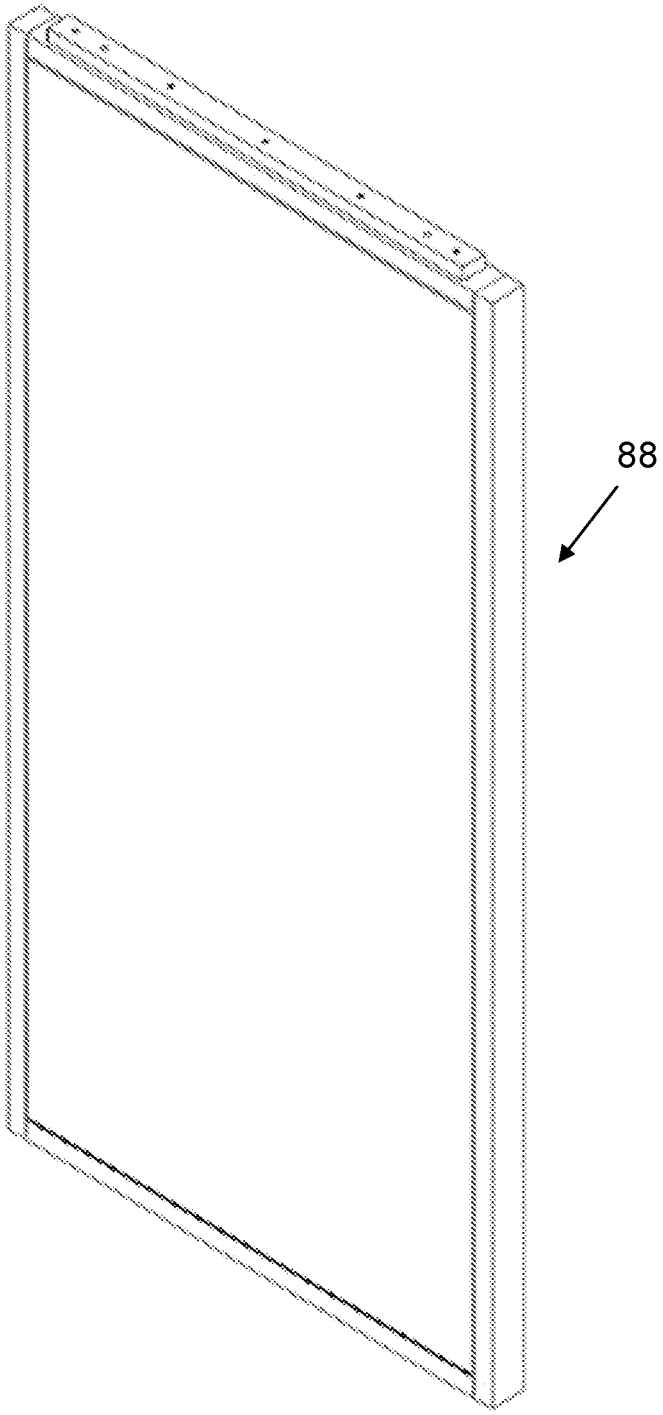
FIG. 21A is a side perspective view of an acoustic framed wall panel.
Figure 21B:
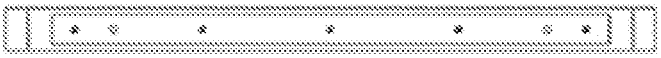
FIG. 21B is a top plan view of the acoustic framed wall panel.
Figure 21C:
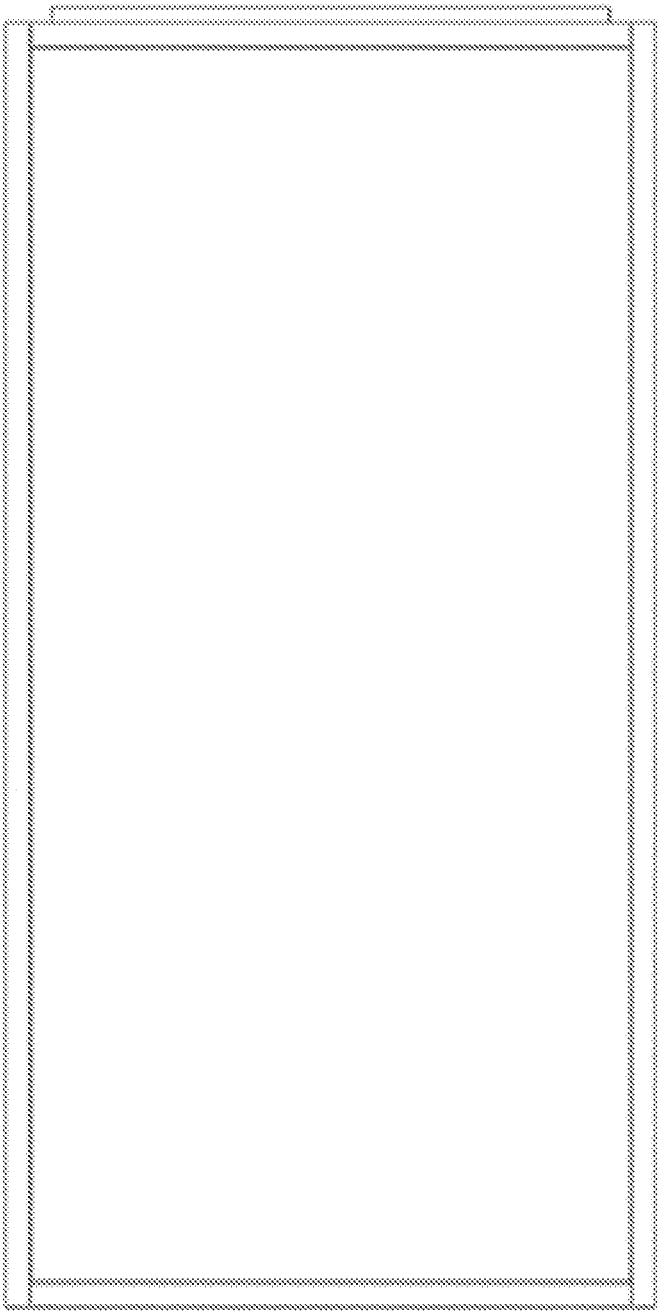
Figure 21E:
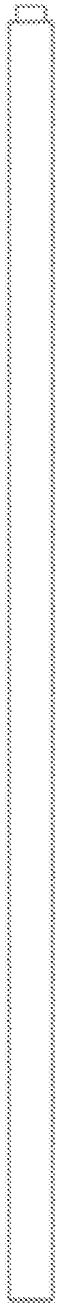
Figure 21D:
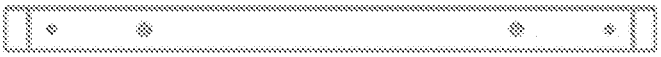
Figure 21F:
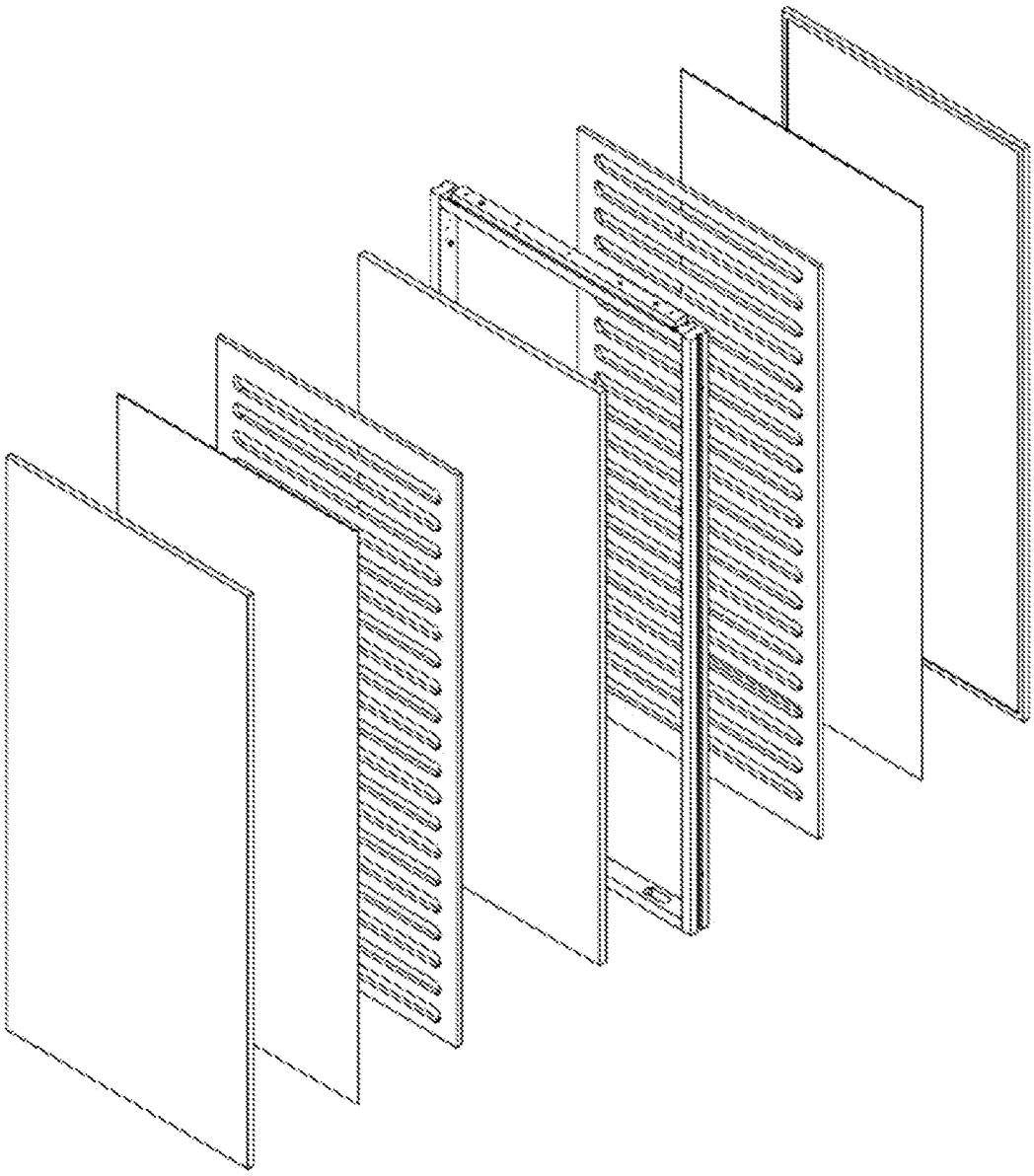
Figure 22A:
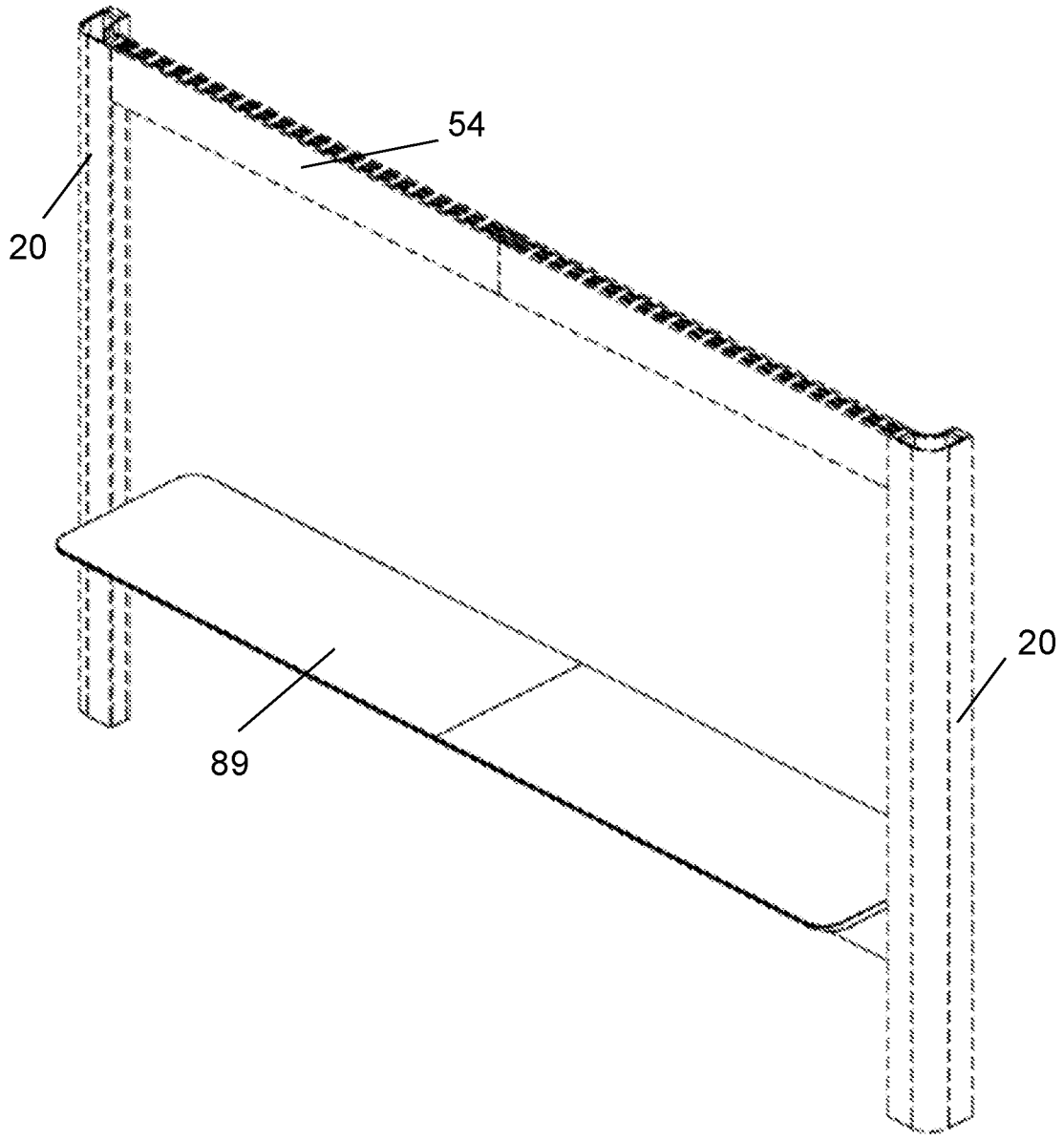

FIGS. 21A-21F depict an acoustic framed wall panel 88. In the depicted embodiment, the acoustic framed wall panel 88 includes a rectangular frame with a plurality of inserts placed serially within. As shown in FIG. 21F, the inserts are, sequentially, an upholstery fabric insert, an acoustic porous material insert, a machined medium density fiberboard (MDF) insert, an acoustic adsorption material insert, such as, for example, recycled denim filling material, a MDF insert, an acoustic porous material insert, and an upholstery fabric insert, such that only the outermost upholstery fabric inserts are visible. These acoustic framed wall panels 88 dampen sound, such that a modular workspace including posts, beams, and one or more acoustic framed wall panels may be used for confidential meetings, phone calls, or other purposes where privacy is desirable.

The disclosed modular workspace system may include integrated functional components, such as tables and seating, which extend between posts. FIGS. 22A-22E and FIGS. 23A-23 respectively depict dining height table 89 and bar height table 90 suspended between spaced apart first posts. FIGS. 24A-24E depict a seating bench 91 suspended between spaced apart first posts. FIG. 25 depicts a seating bench 92 similar to that shown in FIGS. 24A-24E, but with small tables supported by rods extending through the bench. FIG. 26 depicts a perch-style support or seat 93 suspended between spaced apart first posts. Individuals may rest against this perch-style support in a position intermediate between sitting and standing. In some embodiments, a beam with side and bottom trim extends between posts, and the table or bench is affixed to the top of the beam by fasteners. In certain embodiments, posts intended for use with tables, benches, or perch-style supports may include additional connection assemblies for receiving the brackets of the beams supporting the tables or benches or receiving brackets attached to the perch-style supports.

The disclosed modular workspace system may include other integrated functional components, such as tables, designed to fit alongside panels. FIGS. 27A-27F (boomerang table 94), 28A-286F (angled table 95), 29A-29F (rectangular table 96), 30A-30F (serpentine table 97), 31A-31F (bottleneck table 98), 32A-32F (opposing tables 99), and 33A-33F (delta table 100) each depict 1×1 modules incorporating various combinations of wall panels and integrated tables. The wall panels include one or more cutouts, and a bracket fixed to a cross rail within the wall panel extends out through the cutout. A generally planar tabletop of various shape is fastened to and supported by the brackets. FIGS. 27A-27F depict a 1×1 module including two twin skinned panels oriented ninety degrees from each other, with a boomerang-shaped table 94 extending along the two panels and intervening post. FIGS. 28A-28F depict a 1×1 module including two twin skinned panels oriented ninety degrees from each other, with an angled table 95 extending along one panel, the intervening post, and a portion of the other panel. FIGS. 29A-29F depict a 1×1 module including two twin skinned panels oriented ninety degrees from each other, with a rectangular table 96 extending along one panel, the intervening post, and a portion of the other panel. FIGS. 30A-30F depict a 1×1 module including two twin skinned panels oriented 180 degrees from each other, with a serpentine-shaped table 97 attached to the opposing panels and extending across the module. FIGS. 31A-31F depict a 1×1 module including two twin skinned panels oriented 180 degrees from each other, with a bottleneck-shaped table 98 attached to the opposing panels and extending across the module. FIGS. 32A-32F depict a 1×1 module including two twin skinned panels oriented 180 degrees from each other, with a small table 99 attached to each opposing panel, with an angled brace extending downward from the table to the panel to provide additional support. FIGS. 33A-33F depict a 1×1 module including two twin skinned panels oriented 180 degrees from each other, with a delta-shaped table 100 attached to one of the panels and including an angled brace extending downward from the table to the panel to provide additional support.

Additional integrated functional components in the disclosed modular workspace system include tables adapted for larger modules. FIGS. 34A-34E, 35A-35E, and 36A-36E each depict 3×3 modules incorporating various combinations of panels and integrated tables. FIGS. 34A-34E depict a 3×3 module including three twin skinned panels extending between two first posts. FIGS. 35A-35E depict a 3×3 module including three twin skinned panels extending between two first posts and three twin skinned panels extending between two other first posts, such that the panels collectively form opposing walls. In both sets of drawings, a rectangular table extends along the one set of panels with three angled braces extending downward and outward from the table to contact the floor, providing additional support to the table. The table shown in FIGS. 35A-35E is identical to the table shown in FIGS. 34A-34E, but is attached to panels such that the table 101 is internal to the modular room in FIGS. 34A-34E and the table 102 is external to the modular room in FIGS. 35A-35E. It should be understood that various other integrated functional components disclosed herein may also be attached to the interior or exterior of a modular room or modular room structure.

FIGS. 36A-36E depict a 3×3 module including three twin skinned panels extending between two first posts and three twin skinned panels extending between two other first posts, such that the panels collectively form opposing walls. A rectangular table 103 is attached to the centermost panel on each opposing wall, extending across the modular room. The table 103 includes a pair of angled braces located at the center of the table, the braces extending downward and outward from the table to contact the floor, providing additional support to the table.

Embodiments of the modular workspace system include ceiling components. While ceiling components may be optional in modular workspace systems assembled within a larger space, they can provide lighting, sound dampening, a sense of enclosure or privacy, and other desirable features. FIGS. 37A-37D depict a first ceiling component 106. This first ceiling component 106 includes a pair of elongated rods 107 extending parallel to each other. A plurality of vertically aligned baffles 108 are suspended from the rods, each baffle including a pair of holes 109 through which the rods extend. Each end of each rod 107 includes a clip 110 for attaching the rod to the top of a beam 54. FIGS. 37E-37G show a 2×2 module carrying two, three, or six first ceiling components 106.

FIGS. 38A-38D depict a second ceiling component 112. This second ceiling component 112 includes a pair of elongated rods 107 extending parallel to each other. A plurality of baffles 113 are suspended from the rods 107, each baffle 113 including a pair of holes 109 through which the rods 107 extend. While the baffles 108 in the first ceiling component 106 are vertically aligned, the baffles 113 in the second ceiling component 112 each have an upper straight vertical portion 114 and bifurcated lower portion 115, wherein each part of the bifurcated lower portion 115 extends at an angle with respect to the straight upper portion 114. As shown in FIG. 38B, the baffles 113 in the second ceiling component 112 have an upside-down Y-shape when viewed from the side, wherein the upper straight portion 114 forms the straight leg of the Y, and the two oppositely angled parts of the lower portion 115 form the split arms of the Y. Each end of each rod 107 includes a clip 110 for attaching the rod 107 to the top of a beam 54. In preferred embodiments, the rods 107 and clips 110 in the first ceiling component 106 and second ceiling component 112 are interchangeable. FIGS. 37E-37G show a 2×2 module carrying two, three, or six second ceiling components 112.

FIGS. 39A-39E depict a lighting batten 118 for use with the modular workspace system. The lighting batten 118 includes an elongated member containing a lighting element 119 and a clip 120 on either end of the elongated member. FIG. 39F depicts a lighting batten 118 carried on and extending across a 1×1 module, wherein each clip 120 attaches to a beam 54 of the module. FIG. 39G depicts a 2×2 module with an additional central beam bisecting the module. Four lighting battens 118 are carried on the 2×2 module, each extending from the central beam 54 to one of the perimeter beams 54. As shown in FIG. 39H, lighting battens 118 and ceiling components 106/112 may be combined in a single module.

As was explained earlier, by using second posts 24 and third posts 28, the modular workspace system can create complex workspaces including multiple rooms. Exemplary multi-room modular workspaces are shown in FIGS. 40A-40D (combination 10), 41A-41F (combination 11), and 42A-42F (combination 12). As is evident, a nearly infinite variety of modular workspaces can be assembled using the various posts, beams, wall panels, ceiling components, lighting battens, and functional components such as tables and seating disclosed herein.

FIG. 51 has been discussed before, but it does show a pair of cross or side rails 72 with mounting plates 73 attached to each end. Post 20 on the right side of FIG. 51 shows two pair of bolts 15, each bolt threaded into a preferably ⅝ inch barrel nut assembly which has been threaded into a hole bored into face 31. Mounting plate 73 on each end of rail 72 slides onto corresponding bolts 15 and bolts 15 are then tightened to secure the rail 72 between the two posts 20. FIG. 51 also shows wire management openings 60 through rails 72 as well as in post 20. Top rail 70 is shown with bolts 65 for attachment of the top rail 70 to mounting plate 38. Also top rail 70's receptacle mounting cavity 57 and the receptacle access 59 are shown.

FIG. 52 shows a pair of posts 20 which will have a beam 54 with cladding 66 and trim strip 69 attached thereto, the beam 54 to be securely attached toward the top of posts 20. A top rail 70 is to be attached to posts 20 below the beam 54 and a cross rail 72 is to be attached below top rail 70. This configuration could be used, for example, to add a short wall panel 78 to the top rail 70 and cross rail 74, as seen in FIG. 12. Wire management openings in posts 20, beam 54, top rail 70, and cross rail 72 permit wiring to be run as needed. FIG. 54 shows a receptacle mounting bracket 61 can be used to insert an outlet 52 into mounting cavity 57 of beam 54 and outlet 52 can be accessed via receptacle access 59 in the top of beam 54.

FIG. 53 shown how a table 90, such as shown in FIG. 23, can be attached between two posts 20. This configuration has a beam 54, with cladding 66 and trim strip 68 attached thereto, attached toward the top of the two posts 20. A second beam 54, having a pair of table mounting brackets 79 attached thereto, is attached at the desired table height between the posts 20 and the table 90 is secured to mounting brackets 79. For aesthetics, cladding 66 can also be attached to the lower beam 54.

The foregoing detailed description is given primarily for clearness of understanding and no unnecessary limitations are to be understood therefrom for modifications can be made by those skilled in the art upon reading this disclosure and may be made without departing from the spirit of the invention.

The invention claimed is:

1. A modular workspace system, comprising:

a plurality of vertical posts, each vertical post being a corner post having two vertical rails in a transverse relationship, each of the two vertical rails having an outward face, the outward faces of the two vertical rails having a pair of arcuate post supports attached to their sides adjacent their outward faces; or being a T-post having three vertical rails, two of the three vertical rails in a linear relationship and the third vertical rail transverse thereto, each of the three vertical rails having an outward face, the outward faces of the three vertical rails each having a pair of post supports attached to their sides adjacent their outward faces; or being a 4-way post having four vertical rails in a transverse relationship, each of the four vertical rails having an outward face, the outward faces of the four vertical rails each having a pair of arcuate post supports attached to their sides adjacent their outward faces;

the plurality of vertical posts each receiving at least one of a beam, a top rail, or a cross rail between the outward face of a vertical rail of one post and the outward face of another post, these outward faces facing each other, the facing faces configured such that the at least one of a beam, a top rail, or a cross rail are securely attached to the facing faces and are transverse thereto;

where the post supports attached to the sides of the vertical rails create a hollow center section from the top to the bottom of each of the plurality of vertical posts; and where at least one of a beam or a top rail is securely attached between the outward face of a vertical rail of one post and the outward face of another post by securing bolts passed through bolt channels in the beam or top rail to be threadably received by threaded bolt receptacles in a mounting plate secured to the outward face of the vertical rail of the one post and in a mounting plate secured to the outward face of the vertical rail of the other post.

2. The modular workspace system of claim 1, where each mounting plate includes a wire management opening therethrough and the outward face of the vertical rail to which the mounting plate is secured includes a wire management opening extending from the outward face of the vertical rail into the post hollow center section in alignment with the mounting plate wire management opening.

3. The modular workspace system of claim 2, where the beam or top rail is an extruded member having a wire management opening through its length such that wire can be run from the hollow center section of one post through the wire management openings in that post and mounting plate, through the length of the beam or top post via its wire management opening, through the wire management openings in the other post mounting plate and other post and into the center hollow portion of that other post.

4. The modular workspace system of claim 3, where the beam, top rail, or cross rail include at least one wire management opening other than at their ends.

5. The modular workspace system of claim 4, where the outward face of a post vertical rail includes at least one wire management opening at a location where a beam, top rail, or cross rail is not securely attached thereto.

6. The modular workspace system of claim 1, where the plurality of vertical posts includes at least four vertical posts, where the outward face of each vertical rail of each of the at least four vertical posts is securely attached to the outward face of the vertical rail of another of the at least four vertical posts.

7. The modular workspace system of claim 1, where the plurality of vertical posts includes at least one T-post, where each of the three outward faces of that at least one T-post is securely attached to another vertical post by one of a beam, top rail, or cross rail.

8. The modular workspace system of claim 1, where the plurality of vertical posts includes at least one 4-way post, where each of the four outward faces of that at least one 4-way post is securely attached to another vertical post by one of a beam, top rail, or cross rail.

9. The modular workspace system of claim 7, where the plurality of vertical posts includes at least one 4-way post, where each of the four outward faces of that at least one 4-way post is securely attached to another vertical post by one of a beam, top rail, or cross rail.

10. The modular workspace system of claim 1, where at least one of a beam, top rail, or cross rail secured between two vertical posts supports one of a full wall panel, short wall panel, framed wall panel, acoustic wall panel, table, seat, ceiling component, or lighting batten.

11. The modular workspace system of claim 6, where at least one of a beam, top rail, or cross rail secured between two vertical posts supports one of a full wall panel, short wall panel, framed wall panel, acoustic wall panel, table, seat, ceiling component, or lighting batten.

12. The modular workspace system of claim 3, where the beam or top rail includes at least one hanging rail along its external length, where clips along the side of a piece of cladding or wall panel engage the at least one hanging rail so that the piece of cladding or wall panel is supported by the beam or top rail.

13. The modular workspace system of claim 1, where the plurality of vertical posts are wood.

14. The modular workspace system of claim 13, where the vertical rails are solid wood and the post supports comprise layers of wood veneer.

15. The modular workspace system of claim 1, where the plurality of vertical posts includes at least one corner post, where each of the two outward faces of that at least one corner post is securely attached to another vertical post by one of a beam, top rail, or cross rail.

16. The modular workspace system of claim 15, where the plurality of vertical posts includes at least one T-post, where each of the three outward faces of that at least one T-post is securely attached to another vertical post by one of a beam, top rail, or cross rail.

17. The modular workspace system of claim 15, where the plurality of vertical posts includes at least one 4-way post, where each of the four outward faces of that at least one 4-way post is securely attached to another vertical post by one of a beam, top rail, or cross rail.

18. The modular workspace system of claim 16, where the plurality of vertical posts includes at least one 4-way post, where each of the four outward faces of that at least one 4-way post is securely attached to another vertical post by one of a beam, top rail, or cross rail.

* * * * *